US012178271B2

(12) United States Patent
Ellis et al.

(10) Patent No.: US 12,178,271 B2
(45) Date of Patent: Dec. 31, 2024

(54) PATTERNING SYSTEM FOR SELECTED BODY TYPES AND ARTICLES OF MANUFACTURE PRODUCED THEREFROM

(76) Inventors: Stacey L. Ellis, Rancho Cucamonga, CA (US); Valdavia Ellis, Rancho Cucamonga, CA (US)

( * ) Notice: Subject to any disclaimer, the term of this patent is extended or adjusted under 35 U.S.C. 154(b) by 995 days.

(21) Appl. No.: 14/344,127

(22) PCT Filed: Sep. 13, 2012

(86) PCT No.: PCT/US2012/055158

§ 371 (c)(1),
(2), (4) Date: Oct. 14, 2014

(87) PCT Pub. No.: WO2013/040204

PCT Pub. Date: Mar. 21, 2013

(65) Prior Publication Data

US 2015/0026990 A1 Jan. 29, 2015

Related U.S. Application Data

(60) Provisional application No. 61/534,136, filed on Sep. 13, 2011.

(51) Int. Cl.

| | |
|---|---|
| ***A41H 3/04*** | (2006.01) |
| ***A41H 1/00*** | (2006.01) |
| ***A41H 3/00*** | (2006.01) |

(52) U.S. Cl.

CPC ..... *A41H 3/04* (2013.01); *A41H 1/00* (2013.01); *A41H 3/007* (2013.01)

(58) Field of Classification Search

CPC ..... A41H 3/04
USPC ..... 33/17 R; D2/742
See application file for complete search history.

(56) References Cited

U.S. PATENT DOCUMENTS

| | | | | | |
|---|---|---|---|---|---|
| 4,114,277 | A * | 9/1978 | Chalker | A41H 3/00 | 33/14 |
| 4,860,900 | A * | 8/1989 | Forschner | A41H 3/08 | 2/243.1 |
| 5,031,326 | A * | 7/1991 | Huang | A41H 3/00 | 33/12 |
| 6,978,549 | B2 * | 12/2005 | Ellis | A41H 1/00 | 33/1 C |
| 8,307,560 | B2 * | 11/2012 | Tulin | G06Q 30/0201 | 33/11 |
| 8,789,284 | B1 * | 7/2014 | Clardy | A41H 1/00 | 33/17 R |
| 8,806,765 | B2 * | 8/2014 | Tulin | A41H 1/02 | 33/11 |
| D733,398 | S * | 7/2015 | Ellis | D2/742 | |
| 2009/0234489 | A1 * | 9/2009 | Healy | G06Q 30/02 | 700/130 |

* cited by examiner

*Primary Examiner* — Christopher Fulton
(74) *Attorney, Agent, or Firm* — The Weintraub Group, P.L.C.

(57) ABSTRACT

A method for manufacturing a garment includes creating a database of various body types, the database including variances within a selected body type. After the body type variance is selected the garment is prepared including a pant, skirt, t-shirt or the like. In creating a jean a cup is provided within the buttocks of the wearer to enable the fullness of the buttocks to reside therewithin. The database may be used to prepare it is possible articles of manufactures such as seating which is contoured to the body of the driver.

16 Claims, 77 Drawing Sheets

Fig. 3a

Females' Body Bust Circumference Measurement* Comparisons: Difference Between the Black Body Type, Mixed Black Body Type, Industry-Standard Body Type, Caucasian Body Type, and Asian Body Type.

BUST

| BBT bust=(x) | MBBT bust=(x) | IS(s) | CBT bust=( c) | ABT bust= (a) |
|---|---|---|---|---|
| 31.5 | 31.5 | N/A | 31.5 | 31.5 |
| 32.5 | 32.5 | 28.5 | 32.5 | 32.5 |
| 33.5 | 33.5 | 29.5 | 33.5 | 33.5 |
| 34.5 | 34.5 | 30.5 | 34.5 | 34.5 |
| 35.5 | 35.5 | 31.5 | 35.5 | 35.5 |
| 36.5 | 36.5 | 32.5 | 36.5 | 36.5 |
| 38.5 | 38.5 | 34 | 38.5 | 38.5 |
| 39.5 | 39.5 | 36 | 39.5 | 39.5 |
| 40.5 | 40.5 | 38 | 40.5 | 40.5 |

BBT = Black Body Type
MBBT= Mixed Black Body Type
IS = Industry Standard
CBT = Caucasian Body Type
ABT = Asian Body Type

* All body measurements are in inches. The measurements have a tollerable range : x plus or minus .10

Fig.3b

**Females' Body Waist Circumference Measurement* Comparisons: Difference Between the Black Body Type, Mixed Black Body Type, Industry-Standard Body Type, Caucasian Body Type, and Asian Body Type .**

Waist

| BBT(.80x) | MBBT waist=(.80x+1) | IS(.76s) | CBT waist=(.82c) | ABT waist=(.92a) |
|---|---|---|---|---|
| 25.2 | 26.2 | N/A | 25.83 | 28.98 |
| 26 | 27 | 21 | 26.65 | 29.9 |
| 26.8 | 27.8 | 22 | 27.47 | 30.82 |
| 27.6 | 28.6 | 23 | 28.29 | 31.74 |
| 28.4 | 29.4 | 24 | 29.11 | 32.66 |
| 29.2 | 30.2 | 25 | 29.93 | 33.58 |
| 30.8 | 31.8 | 26.5 | 31.57 | 35.42 |
| 31.6 | 32.6 | 28 | 32.39 | 36.34 |
| 32.4 | 33.4 | 30 | 33.21 | 37.26 |

BBT = Black Body Type
MBBT= Mixed Black Body Type
IS = Industry Standard
CBT = Caucasian Body Type
ABT = Asian Body Type

* All body measurements are in inches. The measurements have a tollerable range : x plus or minus .10

Fig.3c

**Females' Body Hip Circumference Measurement* Comparisons: Difference Between the Black Body Type, Mixed Black Body Type, Industry-Standard Body Type, Caucasian Body Type, and Asian Body Type.**

Hip

| BBT hip=(1.10x) | MBBT hip=(1.10x) | IS(1.07s) | CBT hip=(1.10c) | ABT hip=(1.10a) |
|---|---|---|---|---|
| 34.65 | 34.65 | N/A | 34.65 | 34.65 |
| 35.75 | 35.75 | 30.5 | 35.75 | 35.75 |
| 36.85 | 36.85 | 31.5 | 36.85 | 36.85 |
| 37.95 | 37.95 | 32.5 | 37.95 | 37.95 |
| 39.05 | 39.05 | 33.5 | 39.05 | 39.05 |
| 40.15 | 40.15 | 34.5 | 40.15 | 40.15 |
| 42.35 | 42.35 | 36 | 42.35 | 42.35 |
| 43.45 | 43.45 | 38 | 43.45 | 43.45 |
| 44.55 | 44.55 | 40 | 44.55 | 44.55 |

BBT = Black Body Type
MBBT= Mixed Black Body Type
IS = Industry Standard
CBT = Caucasian Body Type
ABT = Asian Body Type

* All body measurements are in inches. The measurements have a tollerable range : x plus or minus .10

Fig. 4a

Males' Body Chest Circumference Measurement* Comparisons: Difference Between the Black Body Type, Mixed Black Body Type, Industry-Standard Body Type, Caucasian Body Type, and Asian Body Type.

Chest

| BBT chest=(mx) | MBBT chest=(mx) | IS(ms) | CBT chest=( mc) | ABT chest= (ma) |
|---|---|---|---|---|
| 35 | 35 | 32 | 35 | 35 |
| 36 | 36 | 33 | 36 | 36 |
| 37 | 37 | 34 | 37 | 37 |
| 38 | 38 | 35 | 38 | 38 |
| 39 | 39 | 36 | 39 | 39 |
| 40 | 40 | 37 | 40 | 40 |
| 41 | 41 | 38 | 41 | 41 |
| 42 | 42 | 39 | 42 | 42 |
| 43 | 43 | 40 | 43 | 43 |
| 44 | 44 | 41 | 44 | 44 |
| 45 | 45 | 42 | 45 | 45 |

BBT = Black Body Type
MBBT= Mixed Black Body Type
IS = Industry Standard
CBT = Caucasian Body Type
ABT = Asian Body Type

* All body measurements are in inches. The measurements have a tollerable range : ± plus or minus .10

Fig. 4b

**Males' Body Waist Circumference Measurement* Comparisons: Difference Between the Black Body Type, Mixed Black Body Type, Industry-Standard Body Type, Caucasian Body Type, and Asian Body Type.**

Waist

| BBT waist=(.80mx) | MBBT waist=(.80mx + 1) | IS=(ms) | CBT chest=( .74mc) | ABT chest= (.87ma) |
|---|---|---|---|---|
| 28 | 29 | 26.5 | 25.9 | 30.45 |
| 28.8 | 29.8 | 27 | 26.64 | 31.32 |
| 29.6 | 30.6 | 27.5 | 27.38 | 32.19 |
| 30.4 | 31.4 | 28 | 28.12 | 33.06 |
| 31.2 | 32.2 | 28.5 | 28.86 | 33.93 |
| 32 | 33 | 29 | 29.6 | 34.8 |
| 32.8 | 33.8 | 30 | 30.34 | 35.67 |
| 33.6 | 34.6 | 31 | 31.08 | 36.54 |
| 34.4 | 35.4 | 32 | 31.82 | 37.41 |
| 35.2 | 36.2 | 33 | 32.56 | 38.28 |
| 36 | 37 | 34 | 33.3 | 39.15 |

BBT = Black Body Type
MBBT= Mixed Black Body Type
IS = Industry Standard
CBT = Caucasian Body Type
ABT = Asian Body Type

* All body measurements are in inches. The measurements have a tolleralda range : x plus or minus .10

Fig. 4c

Males' Body Hip Circumference Measurement* Comparisons: Difference Between the Black Body Type, Mixed Black Body Type, Industry-Standard Body Type, Caucasian Body Type, and Asian Body Type.

Hip

| BBT waist=(1.01mx) | MBBT waist=(1.01mx) | IS=(ms) | CBT chest=( .97mc) | ABT chest= (.98ma) |
|---|---|---|---|---|
| 28 | 29 | 26.5 | 25.9 | 30.45 |
| 28.8 | 29.8 | 27 | 26.64 | 31.32 |
| 29.6 | 30.6 | 27.5 | 27.38 | 32.19 |
| 30.4 | 31.4 | 28 | 28.12 | 33.06 |
| 31.2 | 32.2 | 28.5 | 28.86 | 33.93 |
| 32 | 33 | 29 | 29.6 | 34.8 |
| 32.8 | 33.8 | 30 | 30.34 | 35.67 |
| 33.6 | 34.6 | 31 | 31.08 | 36.54 |
| 34.4 | 35.4 | 32 | 31.82 | 37.41 |
| 35.2 | 36.2 | 33 | 32.56 | 38.28 |
| 36 | 37 | 34 | 33.3 | 39.15 |

BBT = Black Body Type
MBBT= Mixed Black Body Type
IS = Industry Standard
CBT = Caucasian Body Type
ABT = Asian Body Type

* All body measurements are in inches. The measurements have a tollerable range : x plus or minus .10

Fig. 5

Female: Percentages of Total Height

| | BBT | MBBT | IS | CBT | ABT |
|---|---|---|---|---|---|
| **Front waist height**: length from floor to true waist | 57% | 57% | 60% | 54% | 60% |
| **Top/Apex of head to center front waist**: length from top of head to true waist | 43% | 43% | 40% | 46% | 46% |
| **Side Waist Height**: length from floor to true waist | 60% | 60% | 63% | 54% | 60% |
| **Side hip height**: length from the floor to lower hip along the side or body profile | 52% | 52% | 52% | 51% | 54% |
| **Side waist to side hip**: length from true waist to hip along side or body profile | 8% | 8% | 11% | 10% | 11% |
| **Side waist to side bottom of gluteus**: length from true waist to gluteus along side or | 14% | 14% | 17% | 16% | 15% |
| **Back waist height**: length from center back (true)waist to floor | 62% | 58% | 62% | 58% | 62% |
| **Top/Apex of head to center back waist**: length from top of head to true waist | 38% | 35% | 36% | 42% | 38% |
| **Gluteus curve**: length from the bottom of back waist, down and over the natural curve | 19% | 18% | 18% | 15% | 16% |
| **Height of back leg**: length of leg from the bottom of gluteus to floor | 48% | 48% | 45% | 43% | 44% |

Fig. 6

Male: Percentages of Total Height

| | BBT | MBBT | IS | CBT | ABT |
|---|---|---|---|---|---|
| **Front waist height:** length from floor to true waist | 55% | 55% | 56% | 60% | 59% |
| **Top/Apex of head to center front waist:** length from top of head to true waist | 45% | 45% | 47% | 41% | 40% |
| **Side Waist Height:** length from floor to true waist | 58% | 58% | 56% | 61% | 60% |
| **Side hip height:** length from the floor to lower hip along the side or body profile | 50% | 50% | 48% | 51% | 50% |
| **Side waist to side Hip:** length from true waist to hip along side or body profile | 7% | 7% | 8% | 11% | 10% |
| **Side waist to side bottom of gluteus:** length from true waist to gluteus along side or body profile. | 12% | 12% | 11% | 12% | 10% |
| **Back waist height:** length from center back (true)waist to floor | 60% | 60% | 57% | 62% | 61% |
| **Top/Apex of head to center back waist:** length from top of head to true waist | 40% | 40% | 42% | 39% | 40% |
| **Gluteus curve:** length from the bottom of back waist, down and over the natural curve of the gluteus to the beginning of back thigh | 16% | 16% | 13% | 15% | 13% |
| **Height of back leg:** length of leg from the bottom of gluteus to floor | 47% | 47% | 44% | 44% | 44% |

Fig. 7

Women's Finished Garment Measurement Ratios

| Front Rise* | | | | | Back Rise** | | | | |
|---|---|---|---|---|---|---|---|---|---|
| BBT | MBBT | IS | CBT | ABT | BBT | MBBT | IS | CBT | ABT |
| 6.375" | 6.375" | 14.5" | 6.5" | 6.5" | 9.125" | 8.125" | 12.625" | 8.5" | 8.5" |
| 6.625" | 6.625" | 15" | 6.75" | 6.75" | 9.5" | 8.5" | 13" | 8.875" | 8.875" |
| 6.875" | 6.875" | 15.5" | 7" | 7" | 9.875" | 8.875" | 13.375" | 9.25" | 9.25" |
| 7.25" | 7.25" | 15.875" | 7.375" | 7.375" | 10.25" | 9.25" | 13.75" | 9.625" | 9.625" |
| 7.625" | 7.625" | 16.25" | 7.75" | 7.75" | 10.625" | 9.625" | 14.125" | 10" | 10" |
| 8" | 8" | 16.625" | 8.125" | 8.125" | 11" | 10" | 14.5" | 10.375" | 10.375" |
| 8.375" | 8.375" | 17" | 8.5" | 8.5" | 11.375" | 10.375" | 14.875" | 10.75" | 10.75" |

*Rise* is defined as the length from the center front waist line, down between and or through the legs, following the body's natural curve, to the waist line at the center back.

**Front Rise* refers to the length from the center front waist line, down to the end of the front crotch (where front pant meets back pant).

*** Back Rise* refers to the length from the center back waist line, down through the legs, around the natural curve above the gluteus, to the point of where the back pant meets the front pant.

Fig. 8

Men's Finished Garment Measurement Ratios

| Front Rise* | | | | | Back Rise** | | | | |
|---|---|---|---|---|---|---|---|---|---|
| BBT | MBBT | IS | CBT | ABT | BBT | MBBT | IS | CBT | ABT |
| 10.25 | 10.5 | 14.75 | 9 | 10.25 | 16.5 | 15.5 | 12.125 | 13 | 12.75 |
| 10.5 | 10.75 | 15.125 | 9.25 | 10.5 | 16.75 | 15.75 | 12.5 | 13.25 | 13 |
| 10.75 | 11 | 15.5 | 9.5 | 10.75 | 17 | 16 | 12.875 | 13.5 | 13.25 |
| 11 | 11.25 | 15.875 | 9.75 | 11 | 17.25 | 16.25 | 13.25 | 13.75 | 13.5 |
| 11.25 | 11.5 | 16.25 | 10 | 11.25 | 17.5 | 16.5 | 13.625 | 14 | 13.75 |
| 11.5 | 11.75 | 16.625 | 10.25 | 11.5 | 17.75 | 16.75 | 14 | 14.25 | 14 |
| 11.75 | 12 | 17 | 10.5 | 11.75 | 18 | 17 | 14.375 | 14.5 | 14.25 |
| 12 | 12.25 | 17.375 | 10.75 | 12 | 18.25 | 17.25 | 14.75 | 14.75 | 14.5 |

*Rise* is defined as the length from the center front waist line, down between and or through the legs, following the body's natural curve, to the waist line at the center back.

**Front Rise* refers to the length from the center front waist line, down to the end of the front crotch (where front pant meets back pant).
* *Back Rise*** refers to the length from the center back waist line, down through the legs, around the natural curve above the gluteus, to the point of where the back pant meets the front pant.

Note: Unit of measurements are in inches. Each measurement has a margin of error of plus or minus +/- .5 inches.

Fig. 11a1
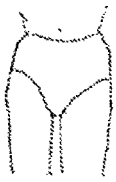
Fig.11a2
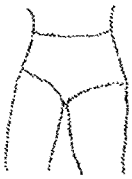
Fig. 11b1
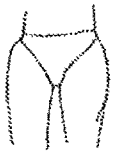
Fig. 11b2
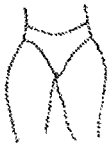
Fig. 12a1
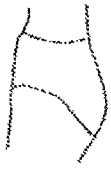
Fig.12a2
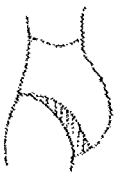
Fig. 12 b1
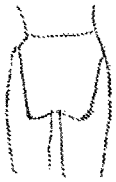
Fig. 12 b2
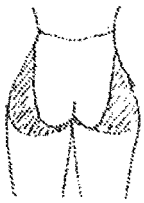
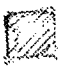
Shaded area represents area not covered by industry standard sized undergarment and or swimwear.

Fig. 13a1
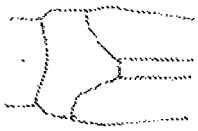
Fig. 13a2
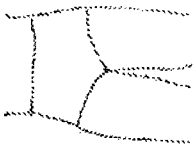
Fig. 13a3
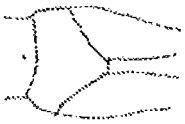
Fig. 13b1
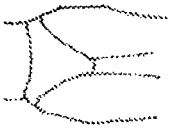
Fig. 13b2
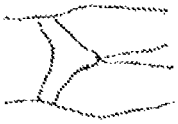
Fig.13b3
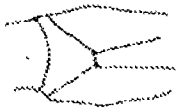
Fig. 14a1
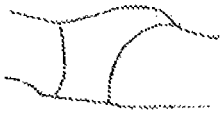
Fig.14a2
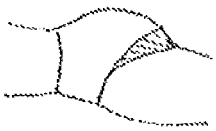
Fig.14a3
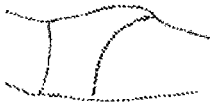
Fig. 14b1
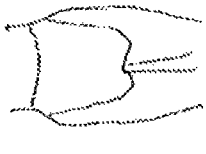
Fig.14b2
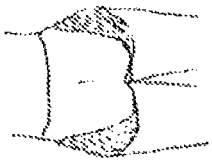
Fig.14b3
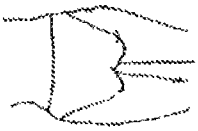
Shaded area represents area not covered by industry standard sized undergarment and or swimwear.

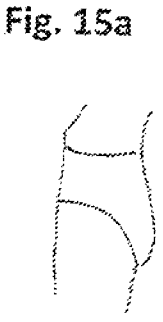
Fig. 15a
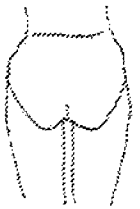
Fig. 15b
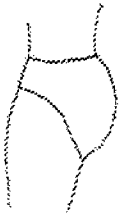
Fig.16a
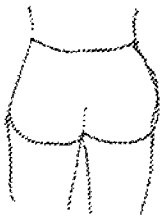
Fig. 16b
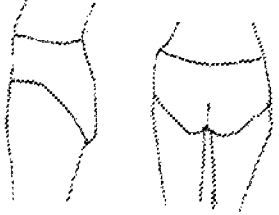
Fig. 17a
Fig. 17b
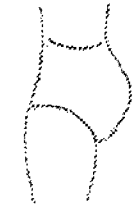
Fig. 18a
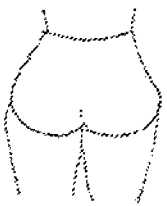
Fig.18b Shaded area represents area not covered by industry standard sized undergarment and or swimwear.

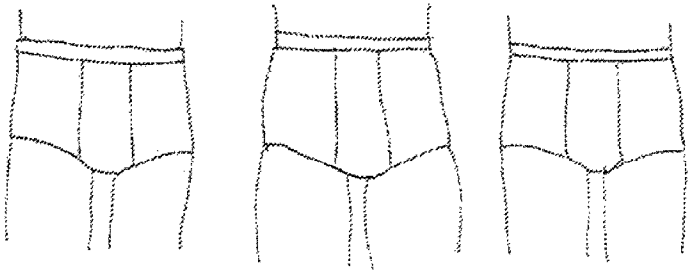
Fig. 20a
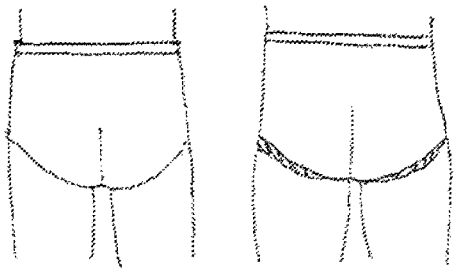
Fig. 20c
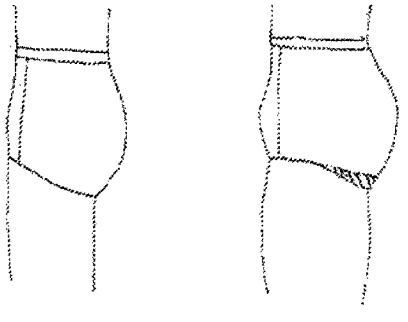
Fig. 20b
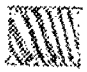
Shaded area represents area not covered by industry standard sized undergarment and or swimwear.

FIGURE 45q
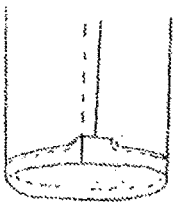
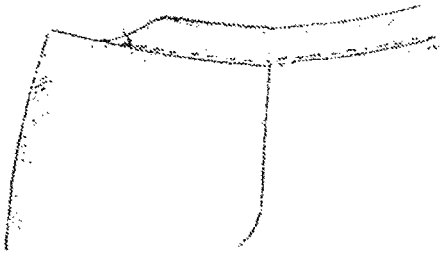
FIGURE 45u
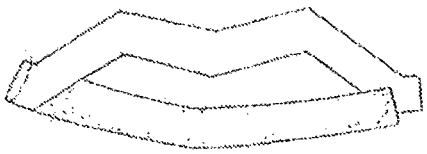
FIGURE 45r
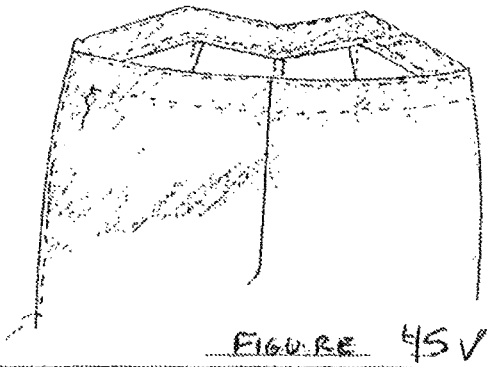
FIGURE 45v
FIGURE 45s
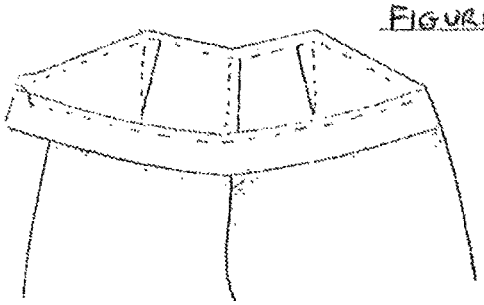
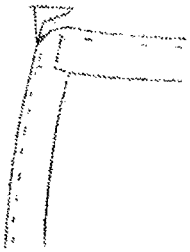
FIGURE 45t
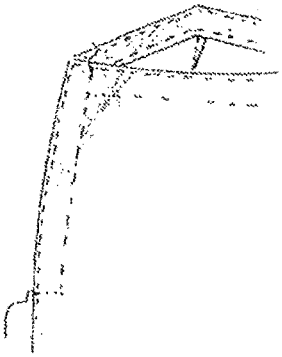
FIGURE 45w

PATTERNING SYSTEM FOR SELECTED BODY TYPES AND ARTICLES OF MANUFACTURE PRODUCED THEREFROM

CROSS REFERENCE TO RELATED APPLICATIONS

This application is a completion application of co-pending U.S. Provisional Patent Application Ser. No. 61/534,136, filed Sep. 13, 2011, for "Patterning System for Selected Body Types and Articles of Manufacture Produced Therefrom", the entire disclosure of which, including the drawings, is hereby incorporated by reference.

BACKGROUND OF THE INVENTION

1. Field of the Invention

The present invention pertains to patterning systems. More particularly, the present invention pertains to patterning systems for distinct body types. Even more particularly, the present invention pertains to patterning systems for specific ethnic body types and articles of manufacture produced therefrom.

2. Description of the Prior Art

In U.S. Pat. No. 6,978,549, the disclosure of which is hereby incorporated by reference, there is disclosed and claimed a patterning system for producing articles of clothing specifically directed to black body types of African descendants or BBT. The patterning system defined the '549 patent provides the requisite deviations from the industry standard body type to accommodate the acknowledged difference between the black body type (BBT) and the industry standard and also, compensates for the specific gender of the person. As a consequence of the invention thereof there is provided a patterning system that can be recorded on a patterning surface to create a standard sizing guide system directly related to the black human body physique. The patterning system enables the creation of garment and clothing accessories specifically directed to a BBT.

The invention defined in the '549 patent being limited only to the black human body tails to address the physique and genders of other ethnic groups. Thus, it is apparent that there would be advantages accruing to patterning systems and the resulting articles of manufacture that could be produced for other ethnic body types.

It is to this to which the present invention is directed.

SUMMARY OF THE INVENTION

In a first aspect hereof there is provided a patterning system for producing articles of manufacture which is predicated on ethnicity and gender for various cultural backgrounds.

The patterning system hereof uses charts to define the appropriate body and body characteristics and therefrom select the requisite parameters to create a patterning system that will enable the manufacture of various articles of apparel specifically directed to the ethnicity and gender of a specific body type. The charts may be either a physical article or stored in a computer. The body characteristics for use in conjunction with a computer may be created with suitable software. The software may be available either through a website or a suitable downloadable application for a PDA or downloadable from a website, The patterning system hereof has been found to be particularly efficacious for the manufacture of denim garments, e.g., denim jeans as well as other articles of clothing from other fabrics, such as dresses, blouses, etc.

In another aspect hereof, there is provided a method of manufacturing such articles of clothing using the patterning system hereof.

In a further aspect hereof there is provided articles of manufacture, such as furniture, seating and other various articles which are designed and produced to conform to these various body types using the charts or by using an avatar constructed from the charts.

For a more complete understanding of the present invention references made to the following detailed description and accompanying drawing. In the drawing like reference characters refer to like parts throughout the several views in which:

BRIEF DESCRIPTION OF THE DRAWINGS

FIGS. 3*a*-8 are charts which set forth the circumference measurements in inches for the various body types used herein;

FIG. 10*c* demonstrates the position of the male chest, waist, lower hip and measurement direction of torso length of the Asian Body Type;

FIG. 11*a*1 is a front elevation view of an industry-standard sized female, wearing a full panty made from an industry-standard sizing system:

FIG. 11*a*2 is a front elevation view of a Black Body Type sized female, wearing a full panty made from an industry-standard sizing system;

FIG. 11*b*1 is a front elevation view of an industry-standard sized female, wearing a bikini panty made from an industry-standard sizing system;

FIG. 11*b*2 is a front elevation view of a Black Body Type sized female, wearing a bikini panty made from an industry-standard sizing system;

FIG. 12*a*1 is a side elevation view of an industry-standard sized female, wearing a full parity made from an industry-standard sizing system;

FIG. 12*a*2 is a side elevation view of a Black Body Type sized female, wearing a full panty made from an industry-standard sizing system, where the shade areas are not covered;

FIG. 12*b*1 is a back elevation view of an industry-standard sized female, wearing a bikini panty made from an industry-standard sizing system;

FIG. 12*b*2 is a back elevation view of a Black Body Type sized female, wearing a bikini panty made from an industry-standard sizing system, where the shade areas are not covered;

FIG. 13*a*1 is a front elevation view of a European Body Type sized female, wearing a full, panty made from an industry-standard sizing system;

FIG. 13*a*2 is a front elevation view of a Bi-racial Body Type sized female, wearing a full panty made from an industry-standard sizing system;

FIG. 13*a*3 is a front elevation view of an Asian Body Type sized female, wearing a full panty made from an industry-standard sizing system;

FIG. 13*b*1 is a front elevation view of a European Body Type sized female, wearing a bikini panty made from an industry-standard, sizing system;

FIG. 13*b*2 is a front elevation view of a Bi-racial Body Type sized female, wearing a bikini panty made from an industry-standard sizing system;

FIG. 13*b*3 is a front elevation view of an Asian Body Type sized female, wearing a bikini panty made from an industry-standard sizing system;

FIG. 14*a*1 is a side elevation view of a European Body Type sized female, wearing a full panty made from an industry-standard sizing system;

FIG. 14*a*2 is a side elevation view of a Bi-racial Body Type sized female (consisting of the European and the Black Body Type, the Black Body Type as the dominant), wearing a full panty made from an industry-standard sizing system, where the shade areas are not covered;

FIG. 14*a*3 is a side elevation view of an Asian Body Type sized female, wearing a full panty made from an industry-standard sizing system;

FIG. 14*b*1 is a back elevation view of a European Body Type sized female, wearing a bikini panty made from an industry-standard sizing system;

FIG. 14*b*2 is a back elevation view of a Bi-racial Body Type sized female (consisting of the European and the Black Body Type, the Black Body Type as the dominant), wearing a bikini panty made from an industry-standard sizing system, where the shade areas are not covered;

FIG. 14*b*3 is a back elevation view of an Asian Body Type sized female, wearing a bikini panty made from an industry-standard sizing system;

FIG. 15*a* is a side elevation view of a European. Body Type sized female, wearing a full panty made from a selected European Body Type sizing system;

FIG. 15*b* is a back elevation view of a European Body Type sized female, wearing a full panty made from a selected European Body Type sizing system;

FIG. 16*a* is a side elevation view of a Bi-racial Body Type sized female (consisting of the European and the Black Body Type, the Black Body Type as the dominant), wearing a full panty made from a Bi-racial Body Type sizing system (consisting of the European and the Black Body Type, the Black Body Type as the dominant), where the entire buttocks is covered;

FIG. 16*b* is a back elevation view of a Bi-racial Body Type sized female (consisting of the European and the Black Body Type, the Black Body Type as the dominant), wearing a full panty made from a Bi-racial Body Type sizing system (consisting of the European and the Black Body Type, the Black Body Type as the dominant), where the entire buttocks is covered;

FIG. 17*a* is a side elevation view of an Asian Body Type sized female, wearing a full panty made from a selected Asian Body Type sizing system;

FIG. 17*b* is a back elevation view of an Asian Body Type sized female, wearing a full panty made from a selected Asian Body Type sizing system;

FIG. 18*a* is a side elevation view of a Black Body Type sized female, wearing a full panty made from a Black Body Type sizing system;

FIG. 18*b* is a back elevation view of a Black Body Type sized female, wearing a full panty made from a Black Body Type sizing system;

FIG. 20*a* is a frontal view of an Industry Standard sized male brief on a male European Body Type (left), a male of Black Body Type (middle), and an Asian Body Type (right);

FIG. 20*b* is a back view of an Industry Standard sized male brief on a male European Body Type (left), a male of Black Body Type (middle), and an Asian Body Type (right);

FIG. 20*c* is a side view of an Industry Standard sized male brief on a male European Body Type (left), a male of Black Body Type (middle), and an Asian Body Type (right);

Figure 1A:
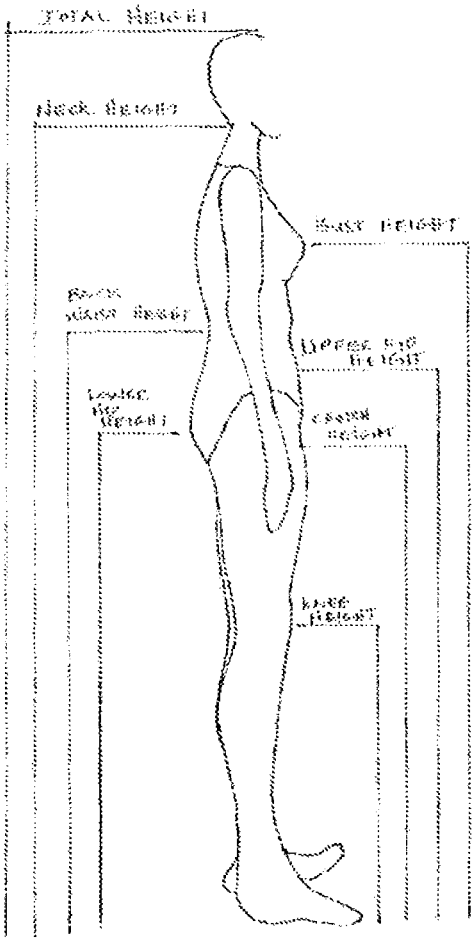
FIG. 1*a* is a side elevation view of a female industry-standard body.
Figure 1B:
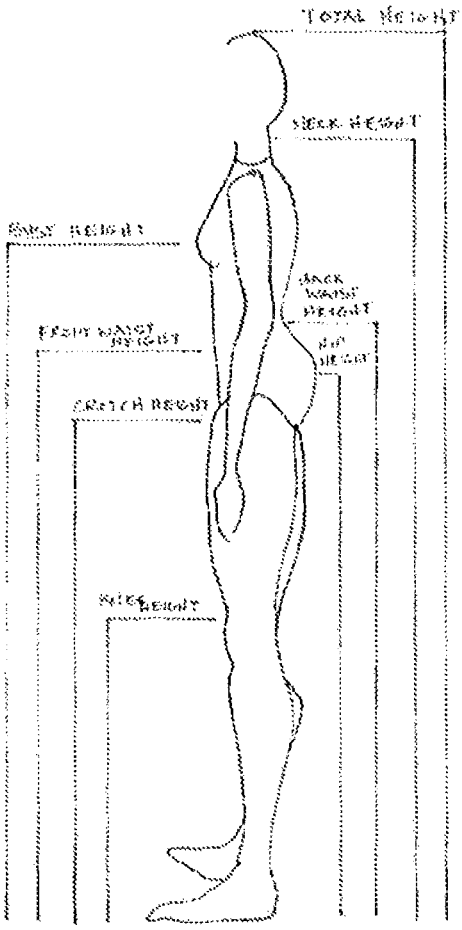
FIG. 1*b* is a side elevation view of a female Black Body Type.
Figure 1C:
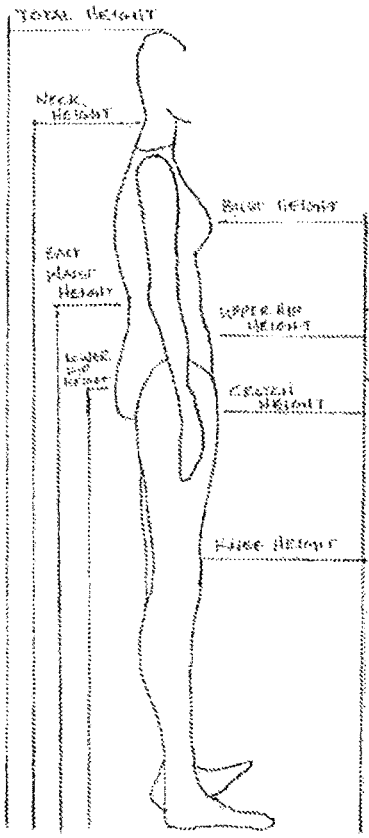
FIG. 1*c* is a side elevation view of a selected female European Body Type.
Figure 1D:
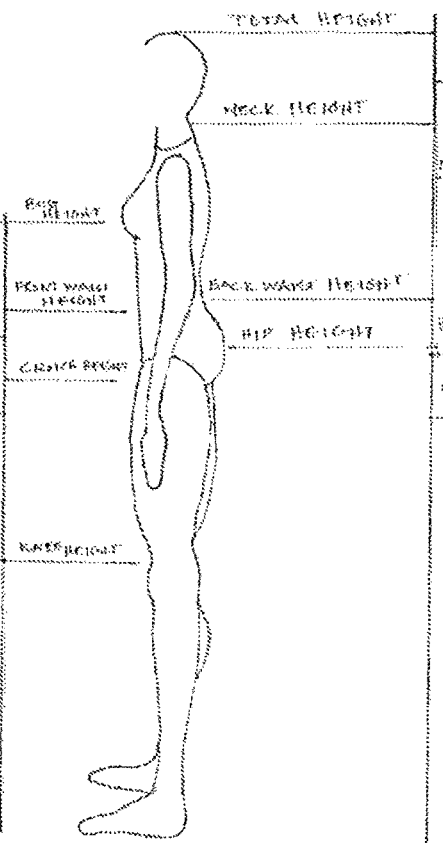
FIG. 1*d* is a side elevation view of a female bi-racial body type consisting of the European and Black Body Types, where the Black Body Type is dominant.
Figure 1E:
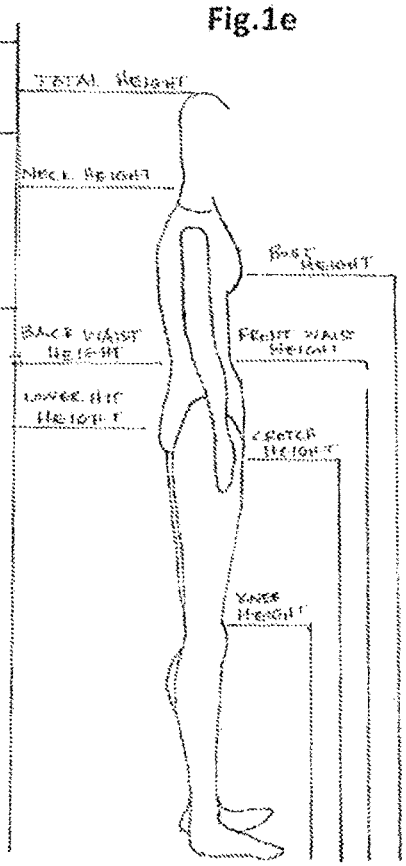
FIG. 1*e* is a side elevation view of a selected female Asian Body Type.
Figure 2A:
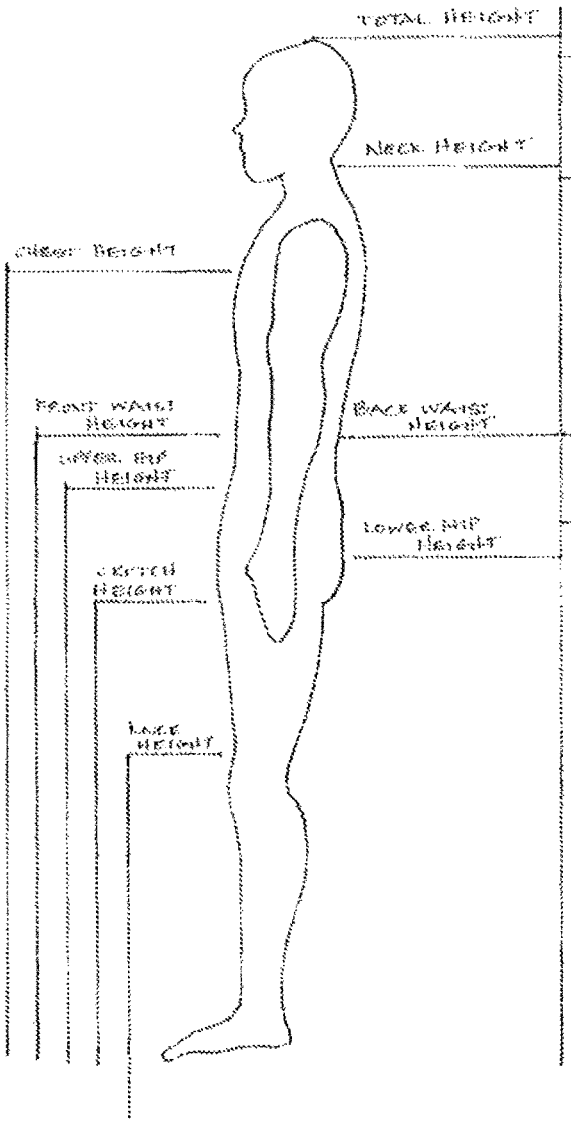
FIG. 2*a* is a side elevation view of a male industry-standard body.
Figure 2B:
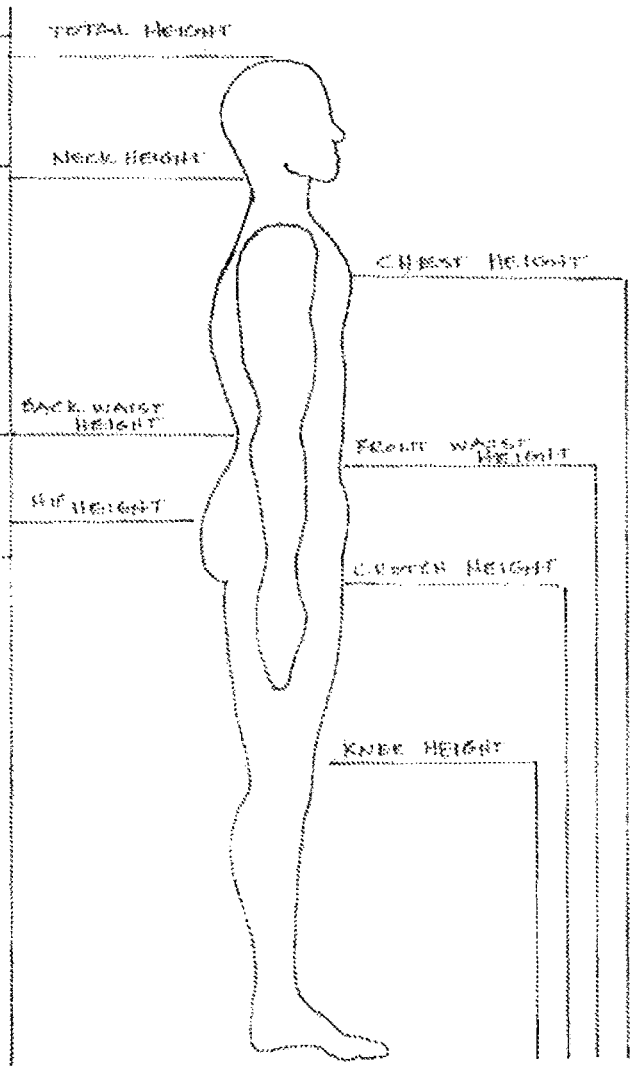
FIG. 2*b* is a side elevation view of a male Black Body Type.
Figure 2C:
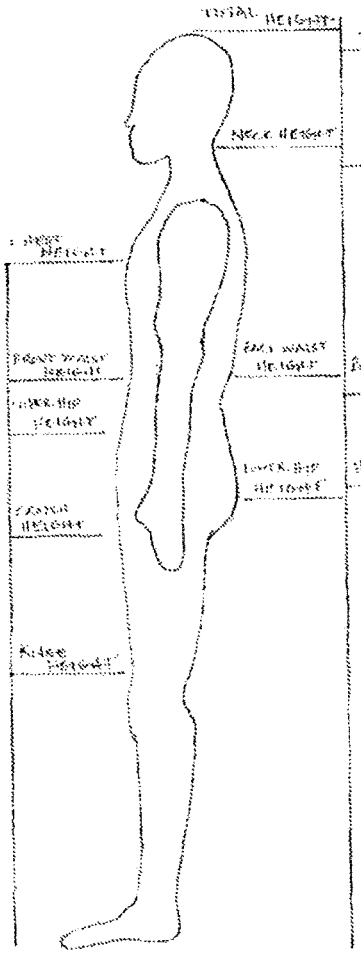
FIG. 2*c* is a side elevation view of a selected male European Body Type.
Figure 2D:
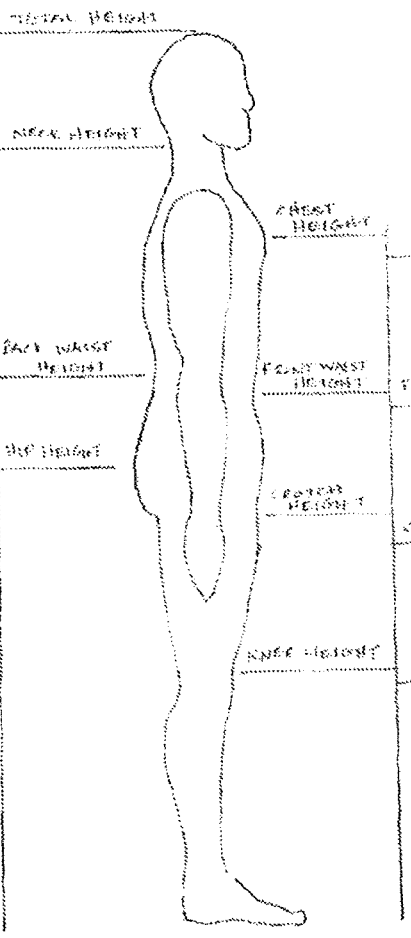
FIG. 2*d* is a side elevation view of a selected male bi-racial. body type consisting of the European and Black Body Types, where the Black Body Type is dominant.
Figure 2E:
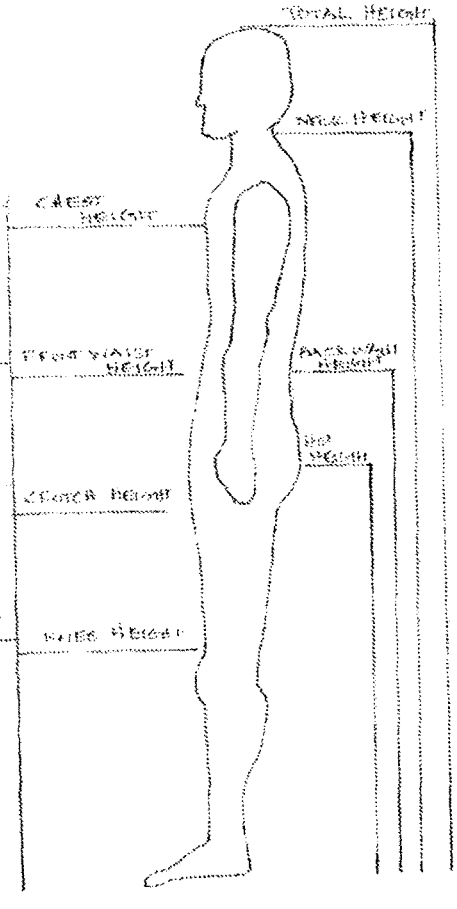
FIG. 2*e* is a side elevation view of a selected male Asian Body Type.
Figure 9B:
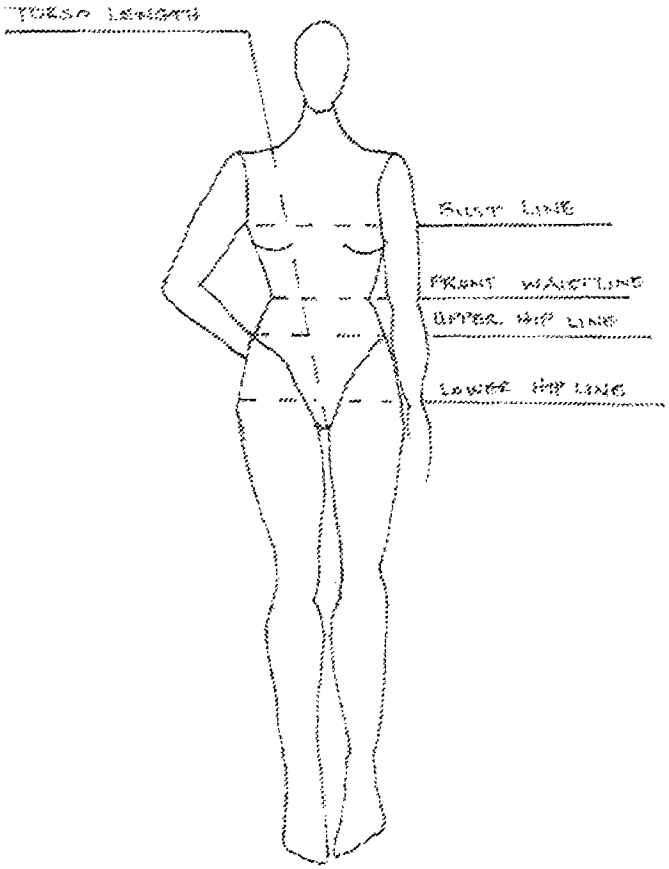
FIG. 9*b* demonstrates the position of the female bust, waist, upper hip, lower hip and measurement direction of torso length of the industry-standard body type.
Figure 9A:
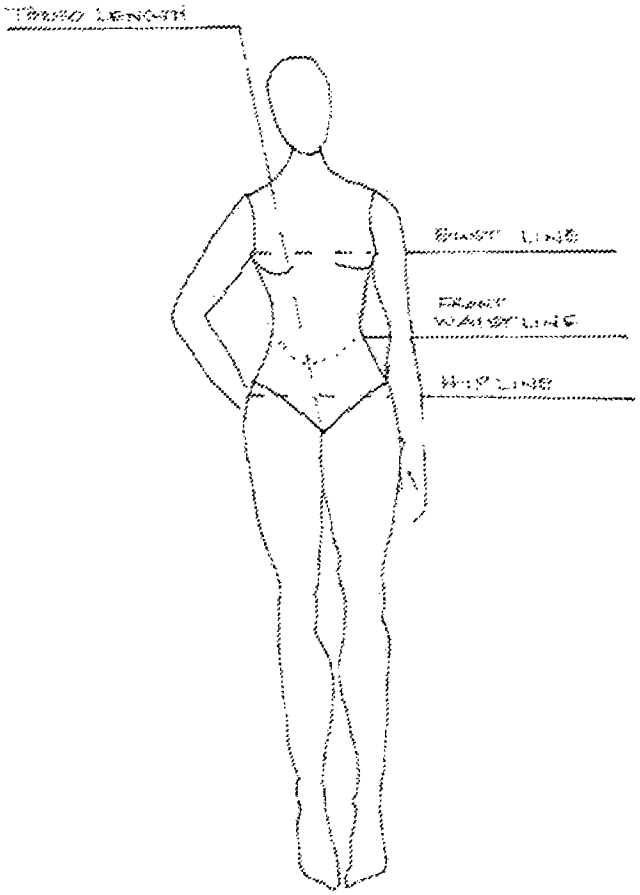
FIG. 9*a* demonstrates the position of the female bust, waist, hip and measurement direction of torso length of the Black Body Type.
Figure 9E:
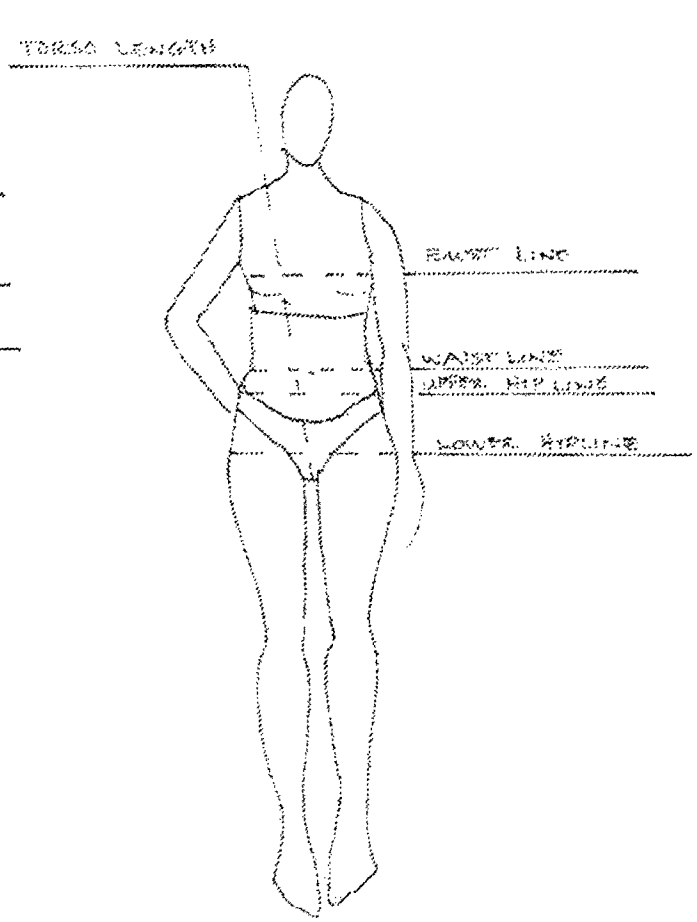
FIG. 9*e* demonstrates the position of the female bust, waist, upper hip, lower hip and measurement direction of torso length of the Asian Body Type.
Figure 9D:
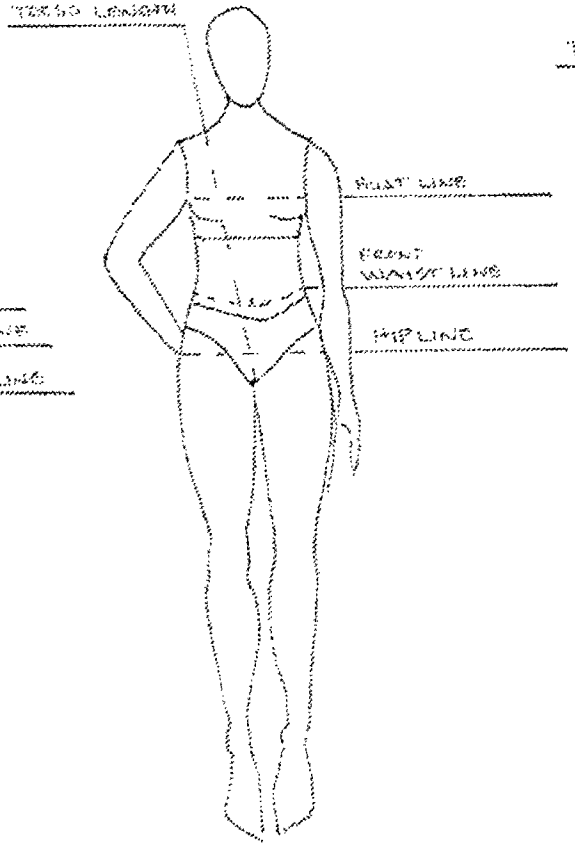
FIG. 9*d* demonstrates the position of the female bust, waist, hip and measurement direction of torso length of the bi-racial body type-consisting of a European and Black Body Type, where the Black Body Type is dominant.
Figure 9C:
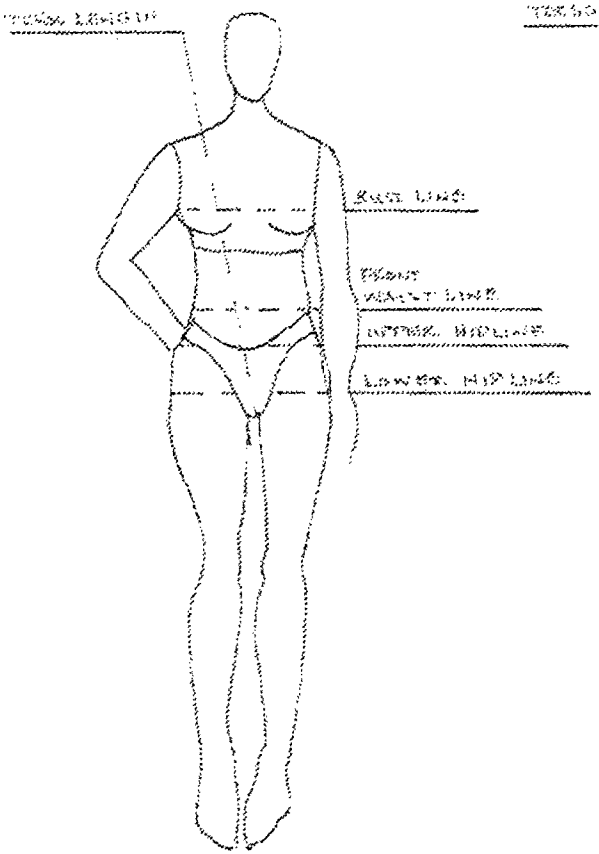
FIG. 9*c* demonstrates the position of the female bust, waist, upper hip, lower hip and measurement direction of torso length of the European Body Type.
Figure 10A:
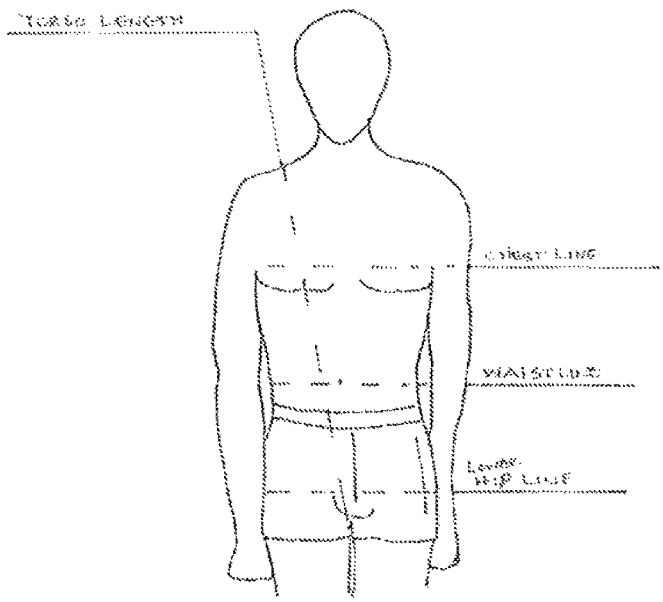
FIG. 10*a* demonstrates the position of the male chest, waist, lower hip and measurement direction of torso length of the industry-standard body type.
Figure 10B:
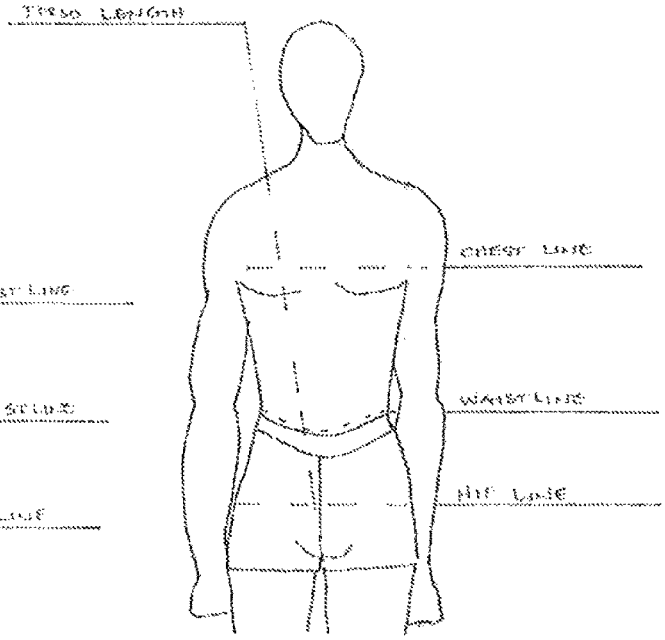
FIG. 10*b* demonstrates the position of the male chest, waist, hip and measurement direction of torso length of the Black Body Type.
Figures 10C, 10D, 10E:
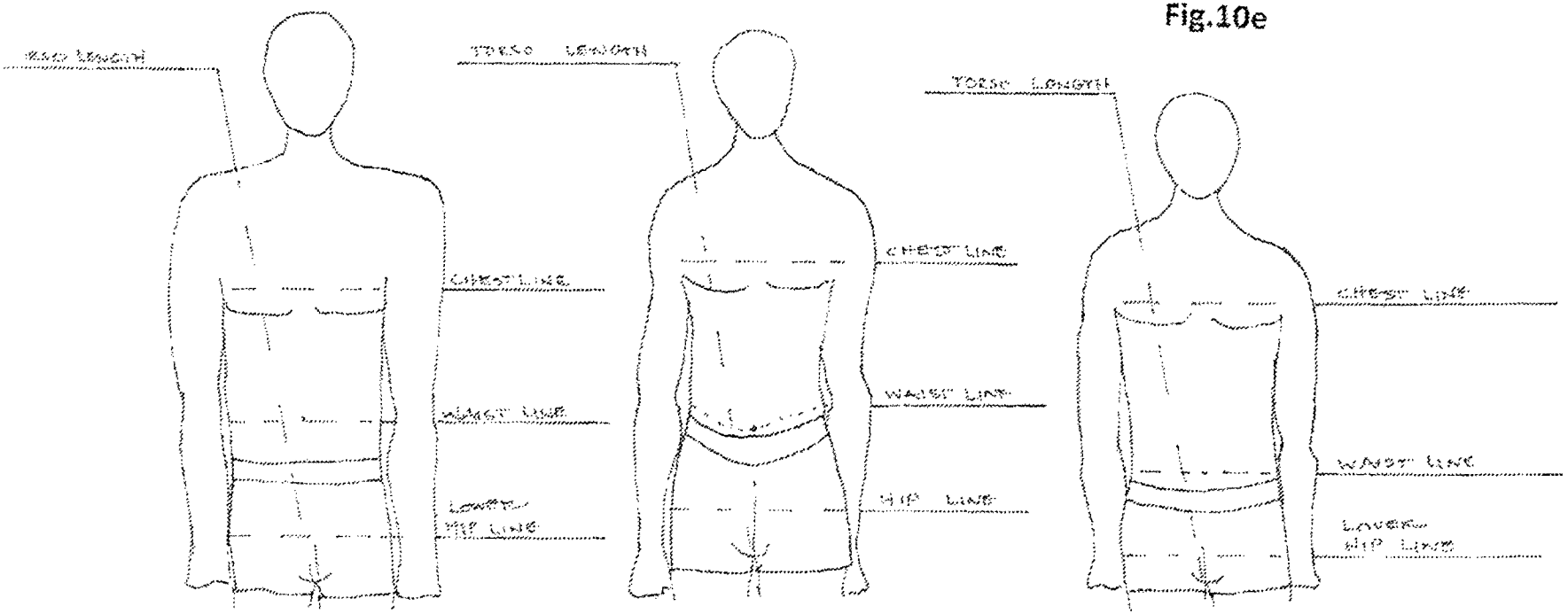
FIG. 10*c* demonstrates the position of the male chest, waist, lower hip and measurement direction of torso length of the European Body Type.
FIG. 10*d* demonstrates the position of the male chest, waist, hip and measurement direction of torso length of the bi-racial body type consisting of a European and Black Body Type, where the Black Body Type is dominant.
Figure 19A:
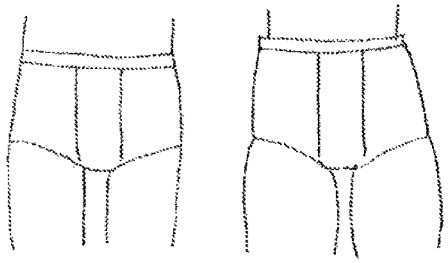
FIG. 19*a* is a frontal view of Industry Standard sized men's brief on an Industry Standard male body type (left) and an Industry Standard sized men's brief on a male of Black Body Type (right)
Figure 19B:
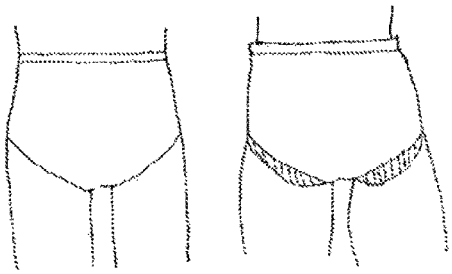
FIG. 19*b* is a back view of Industry Standard sized men's brief on an Industry Standard male body type (left) and an Industry Standard sized men's brief on a male of Black Body Type (right)
Figure 19C:
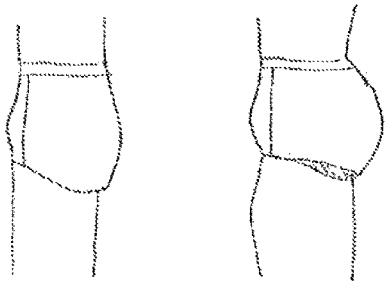
FIG. 19*c* is a side view of Industry Standard sized men's brief on an Industry Standard male body type (left) and an Industry Standard sized men's brief on a male of Black Body Type (right)
Figure 21A:
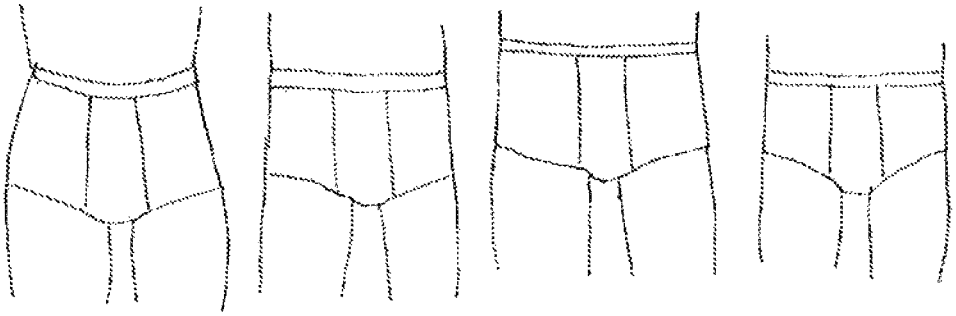
FIG. 21*a* is a frontal view of briefs sized using the ethnic sizing system for the proper fit: 1) Black Body Type, 2)
Figure 21B:
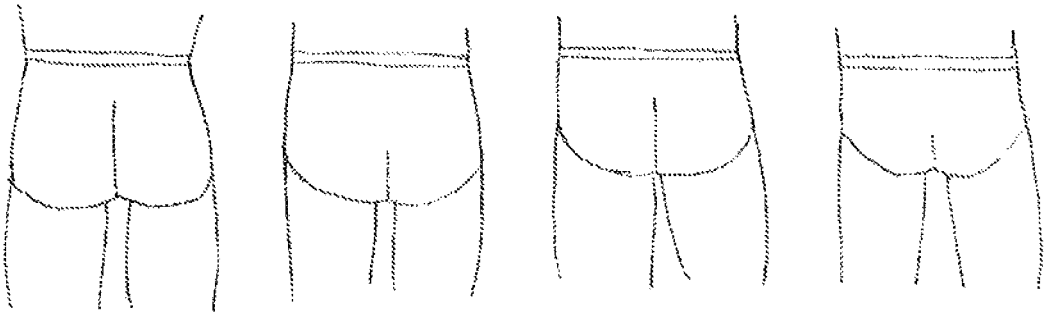
Figure 21C:
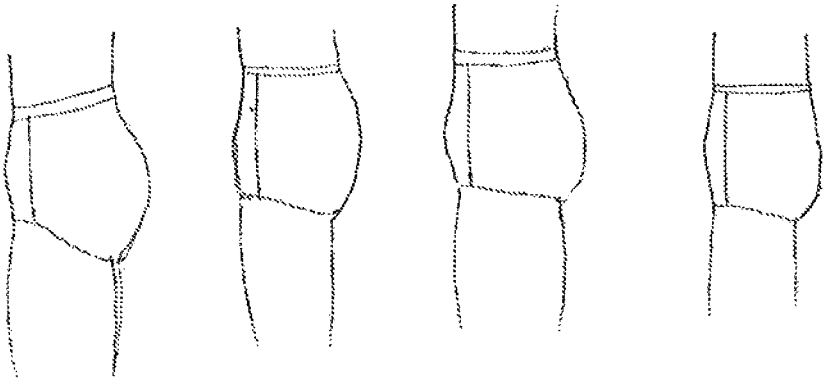
Figure 22A:
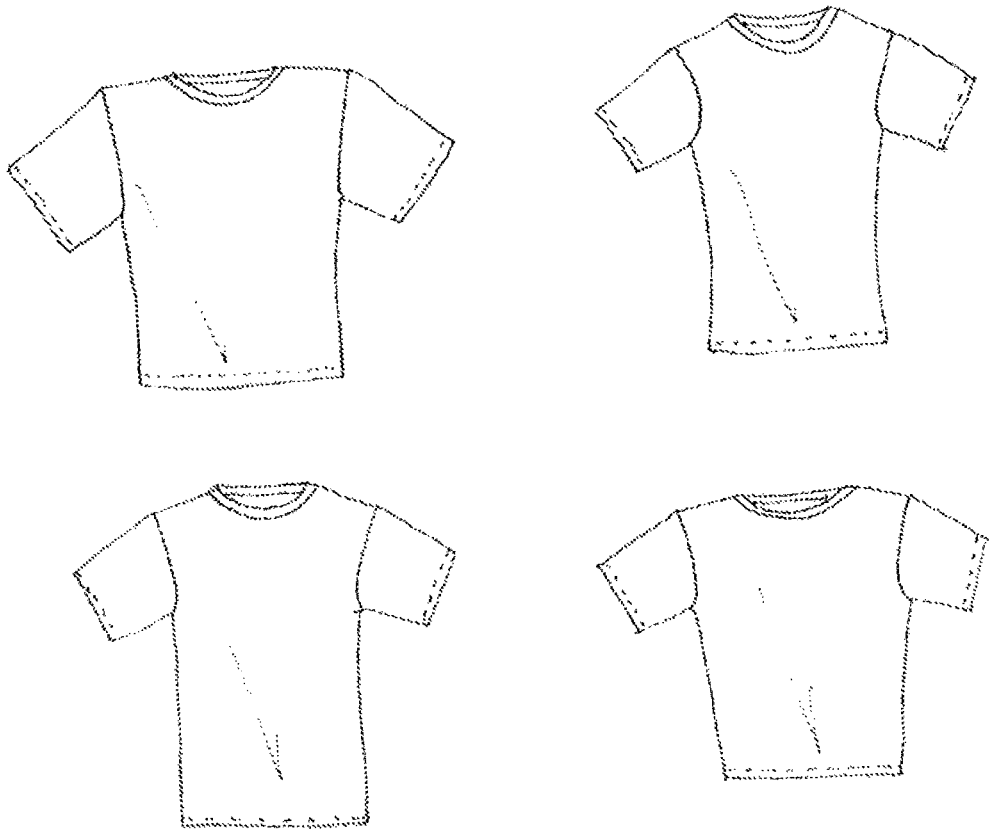
Figure 23A:
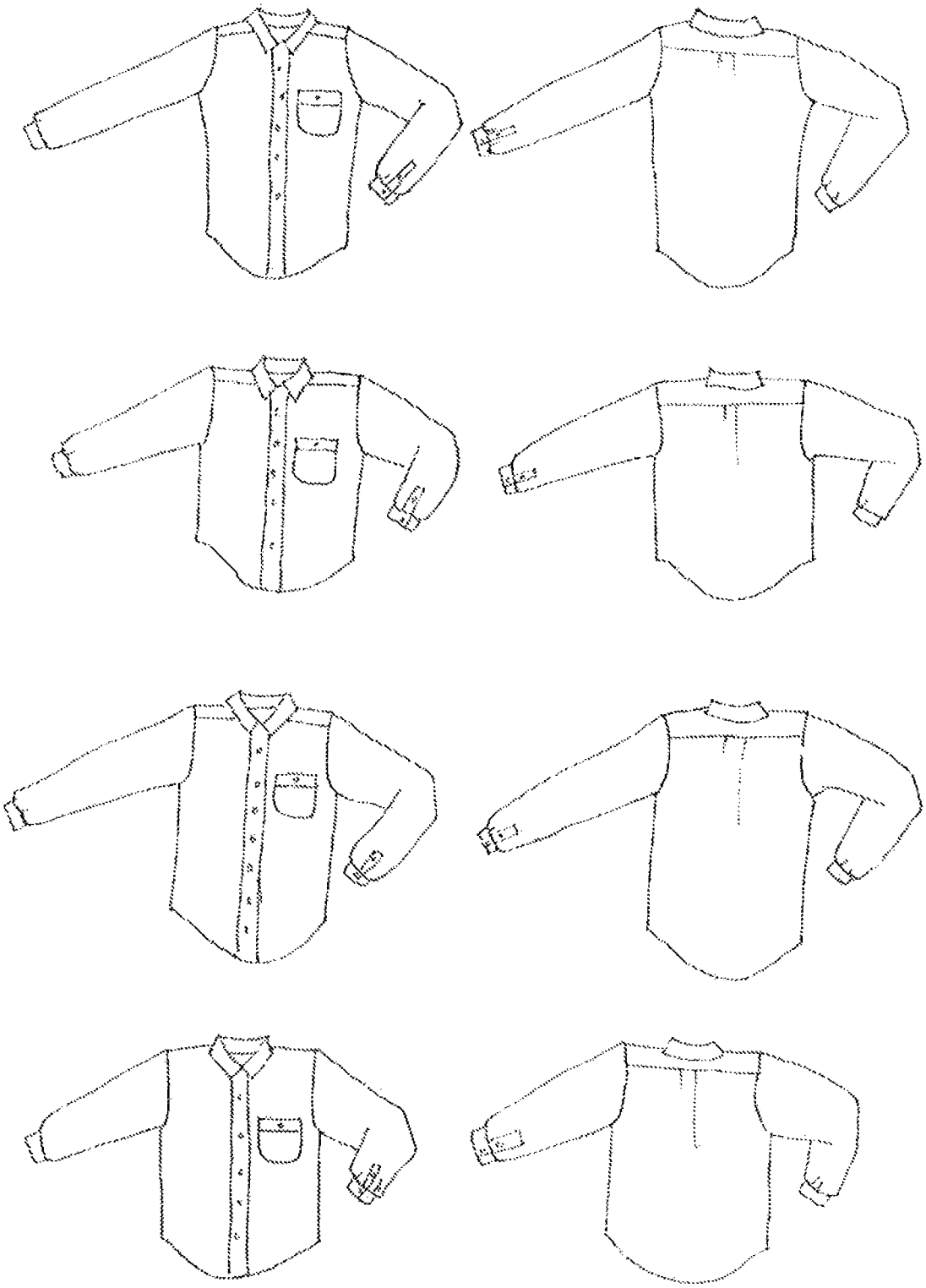
Figure 24A:
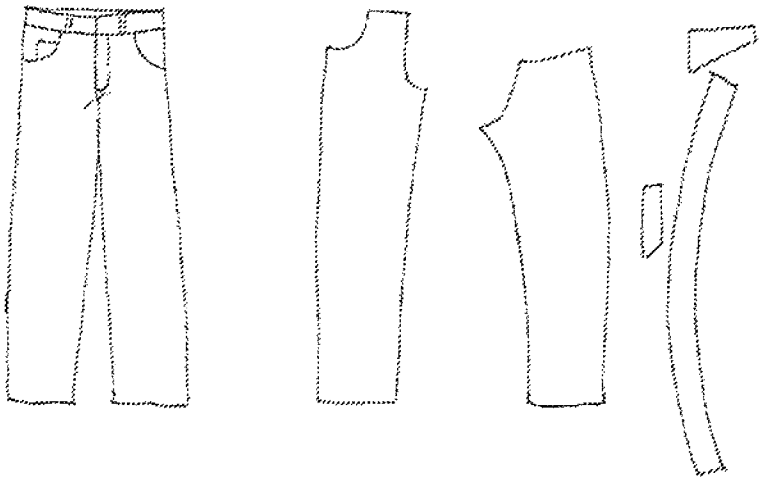
Figure 24B:
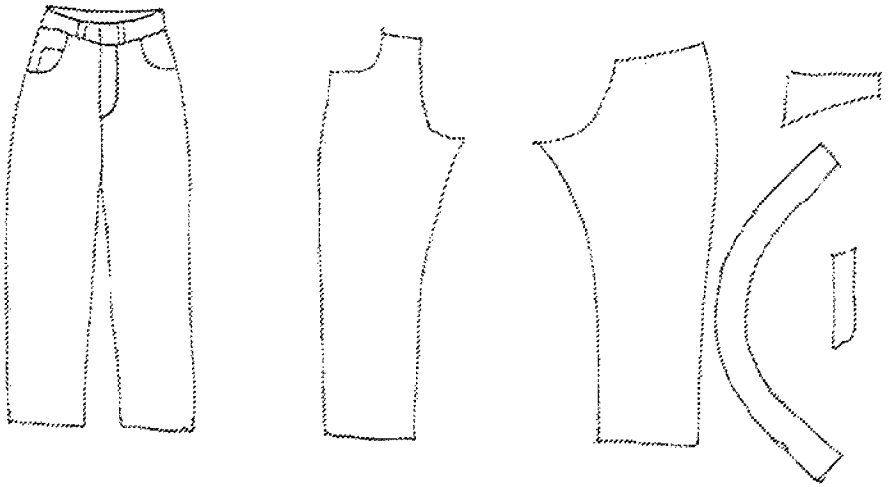
Figure 24C:
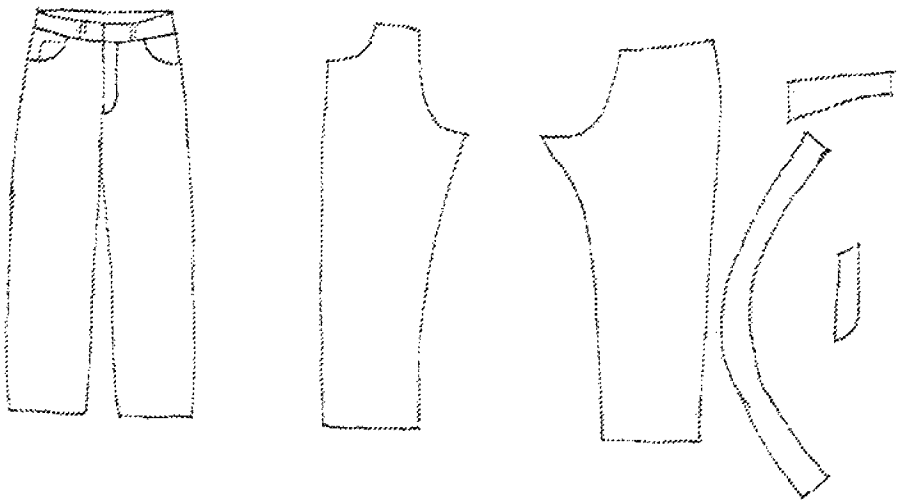
Figure 25:
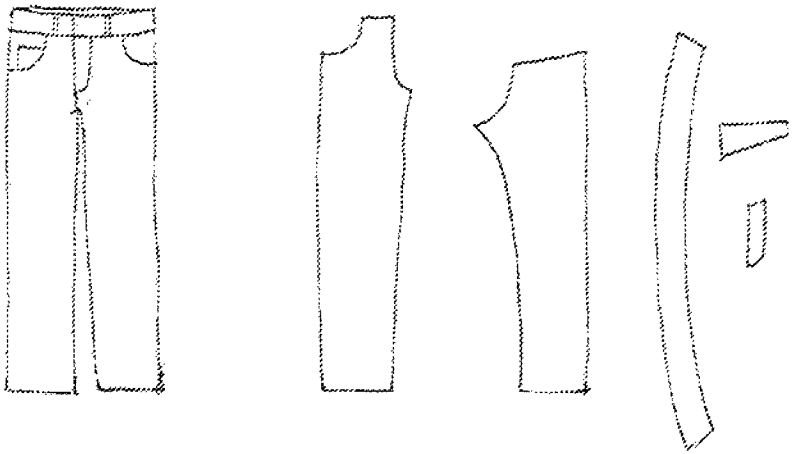
Figure 26:
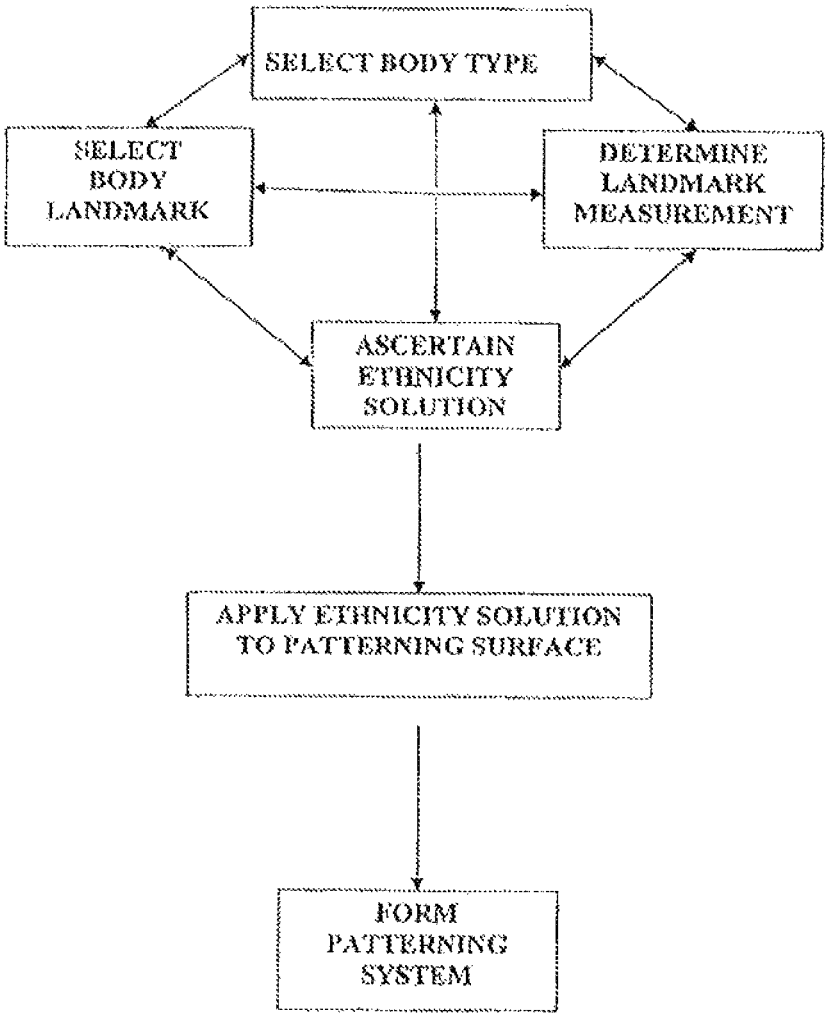
Figure 27:
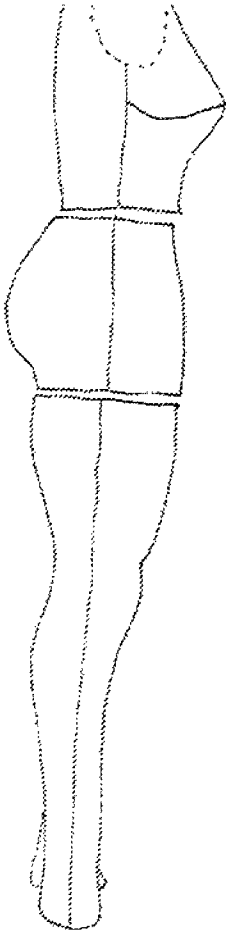
Figure 27A:
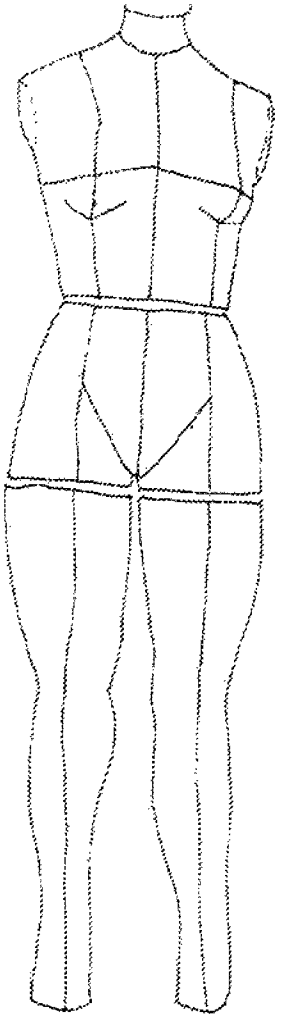
Figure 28B:
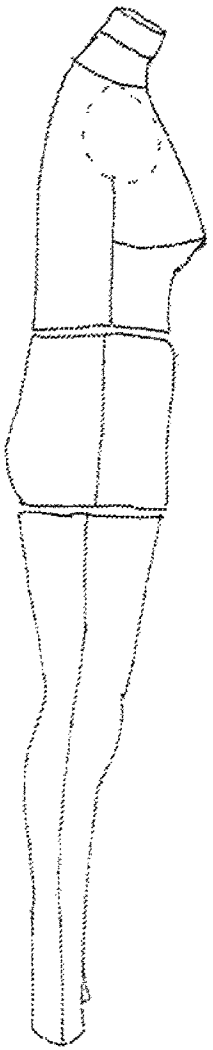
Figure 28A:
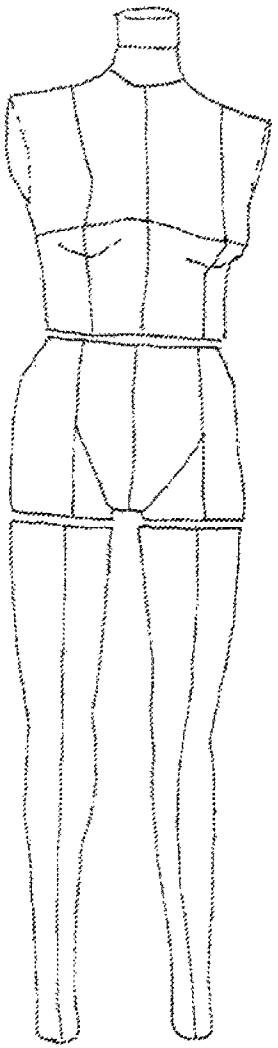
Figure 29B:
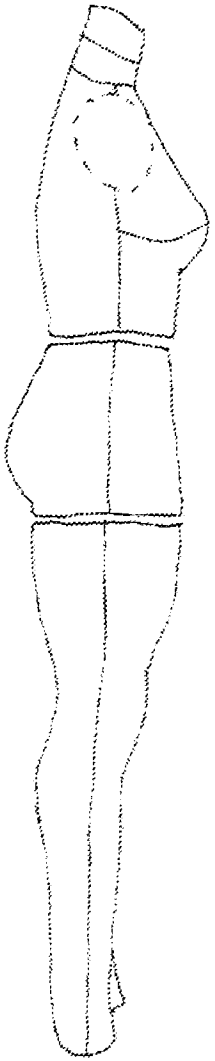
Figure 29A:
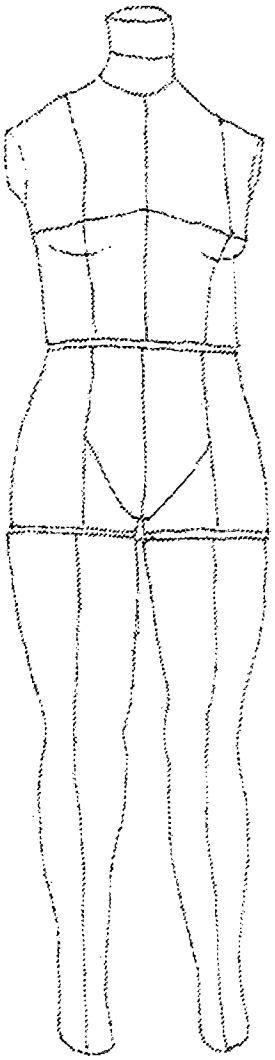
Figure 30B:
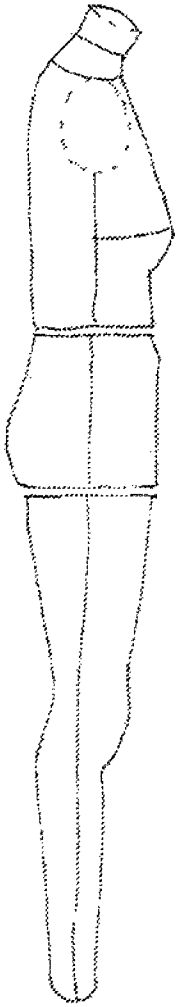
Figure 30A:
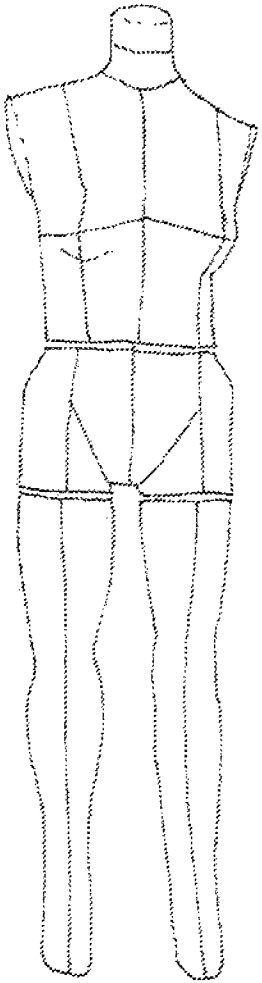
Figure 31B:
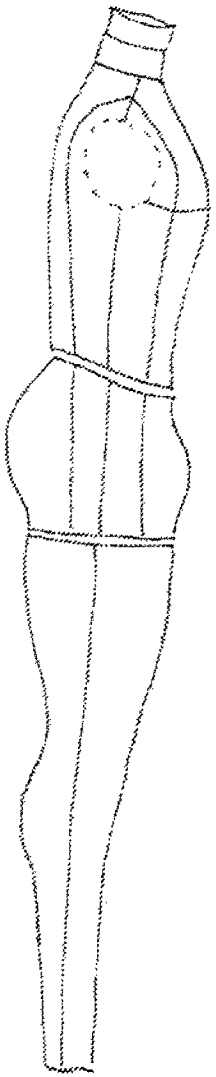
Figure 31A:
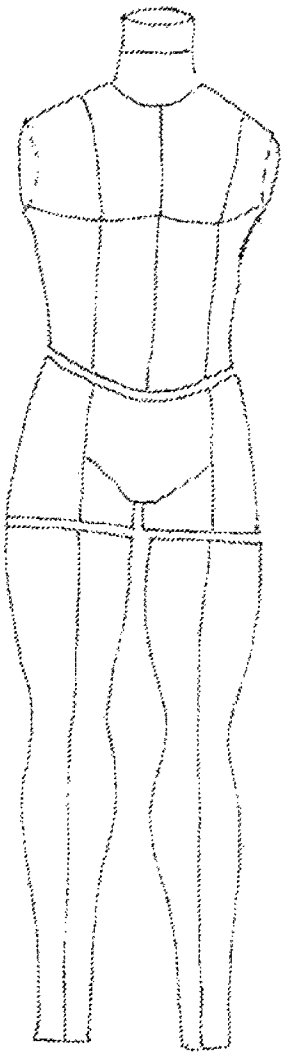
Figure 32B:
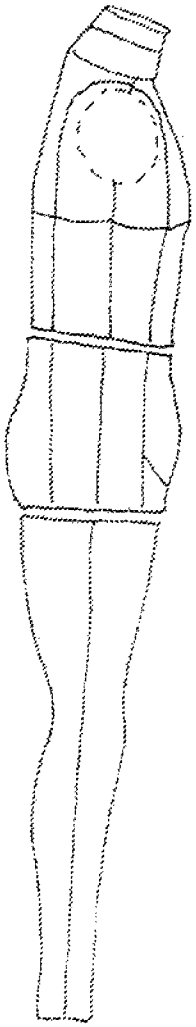
Figure 32A:
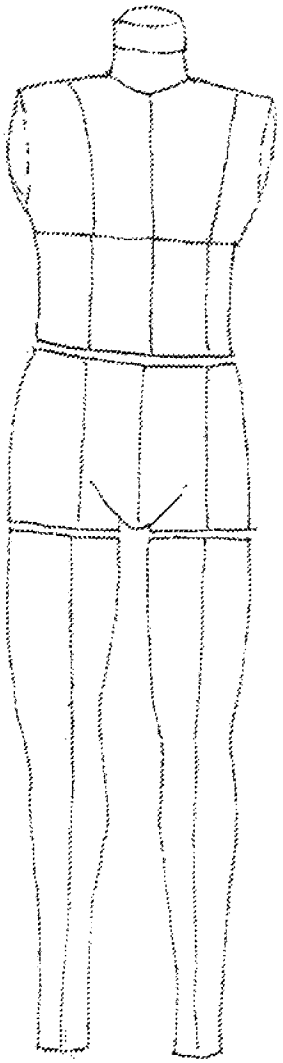
Figure 33A:
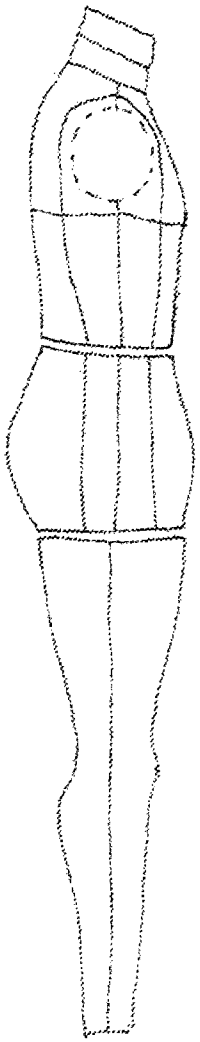
Figure 33B:
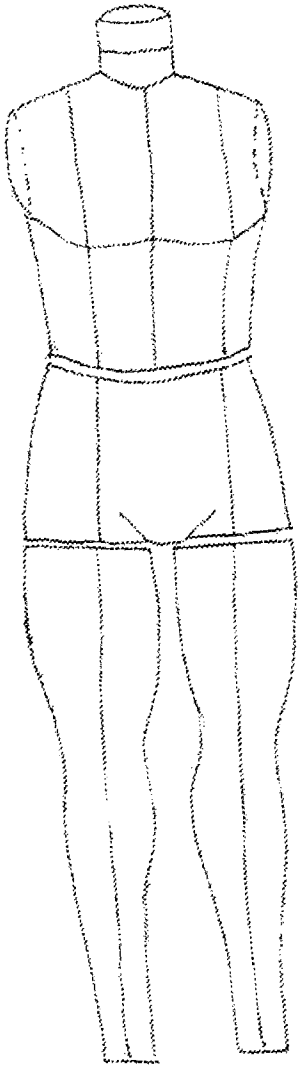
Figure 34B:
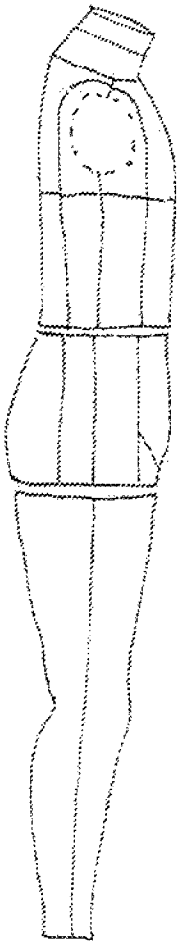
Figure 34A:
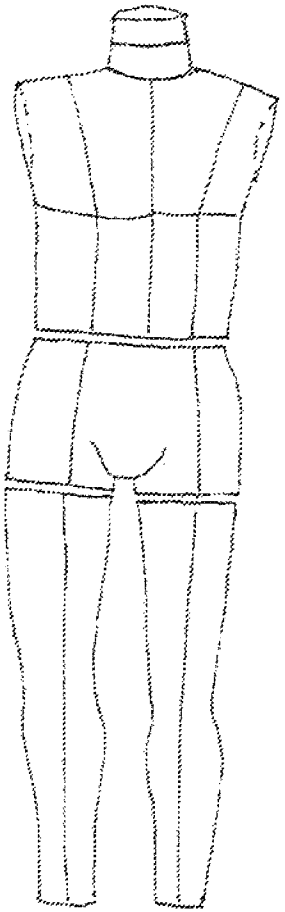
Figure 35A:
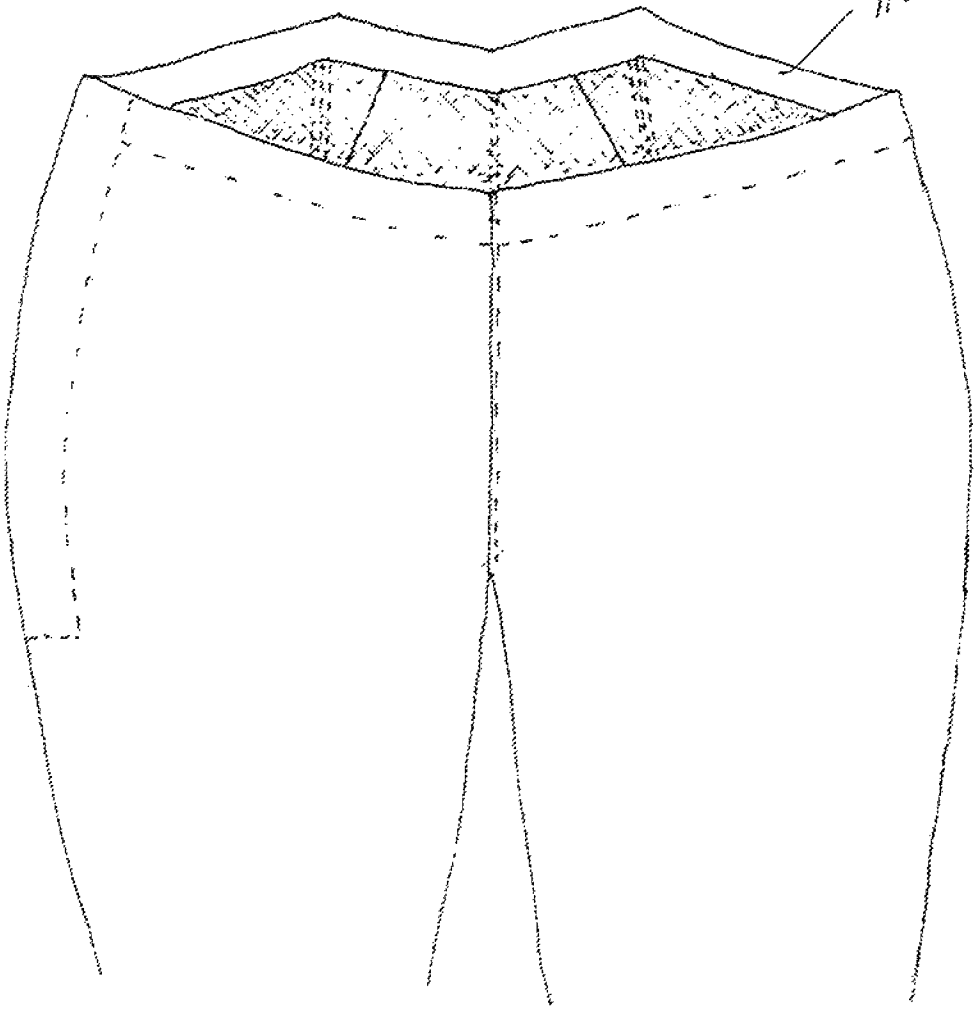
Figure 35B:
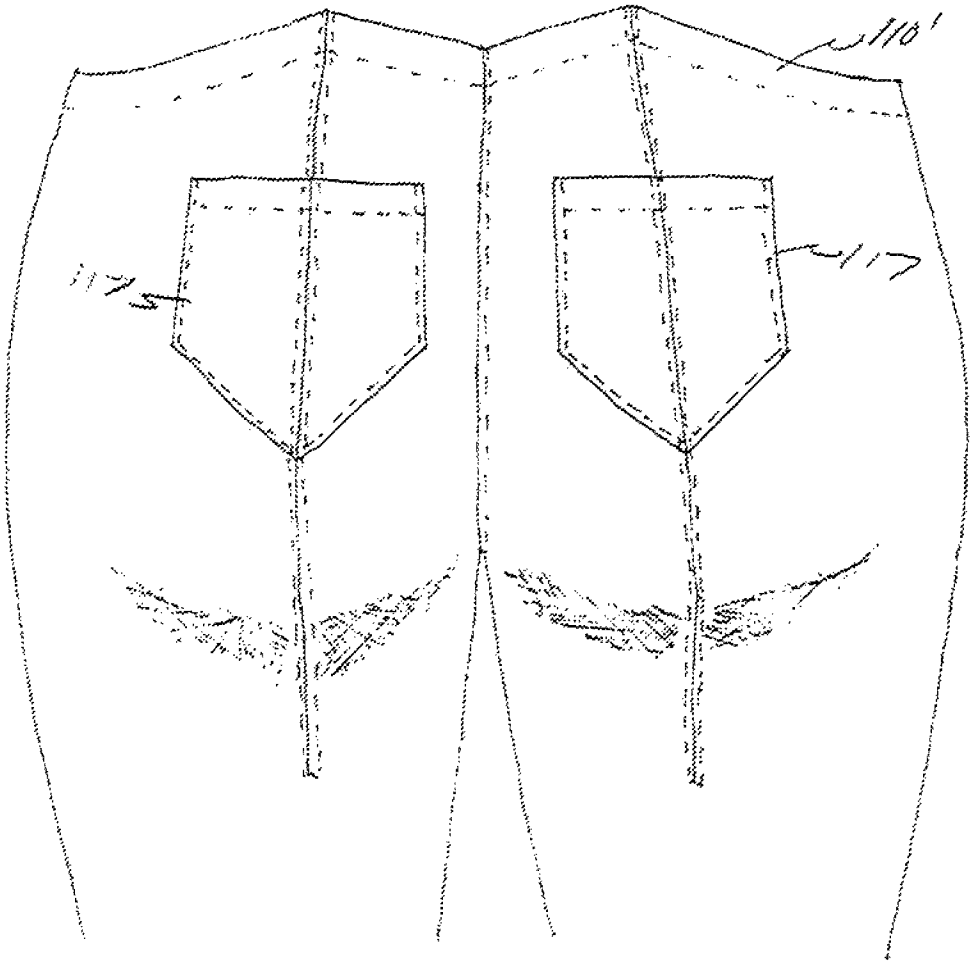
Figure 35C:
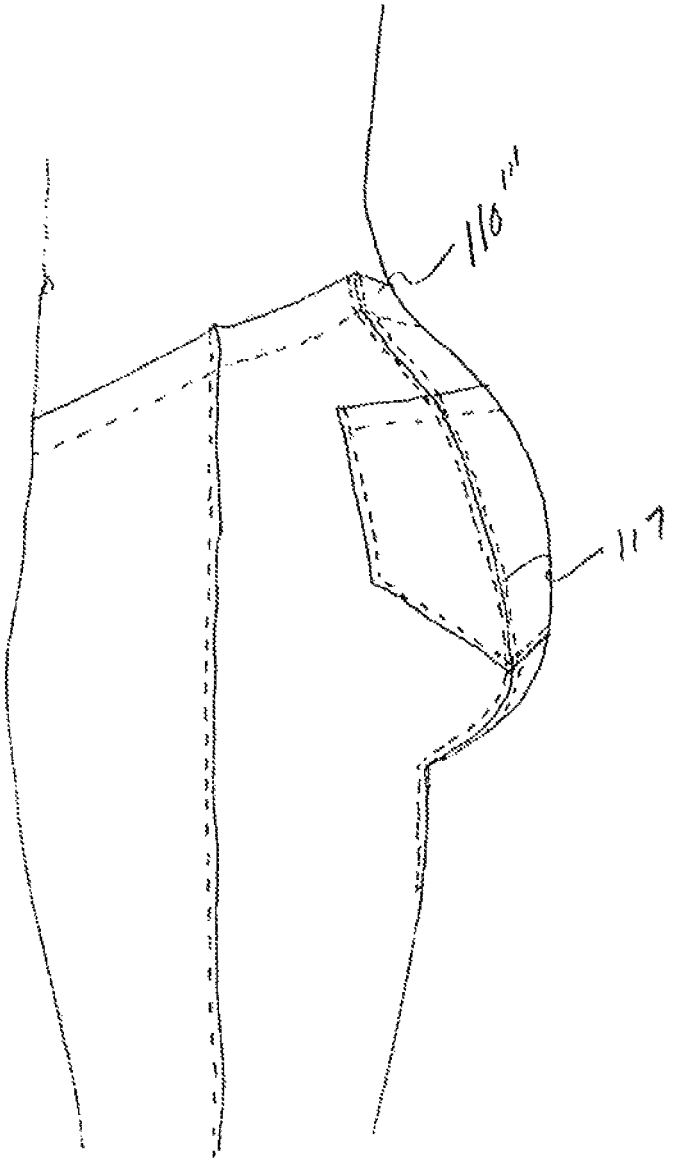
Figure 36A:
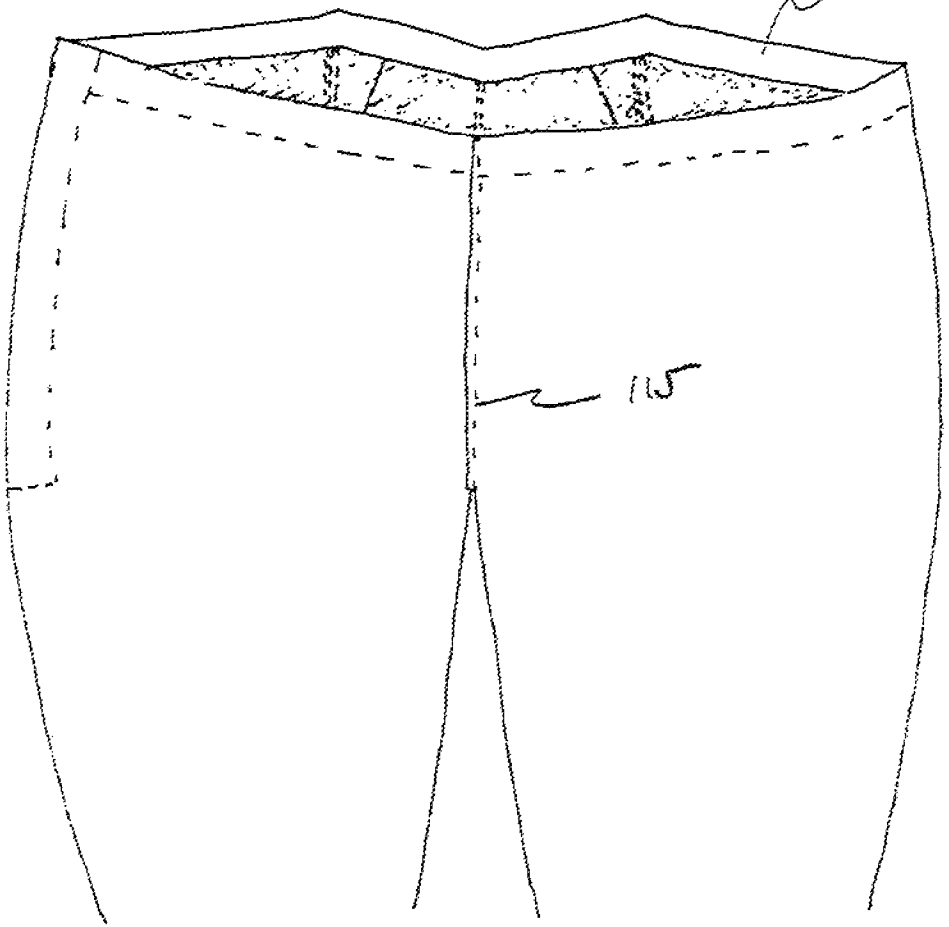

European Body Type, 3) Multi-ethnic male of Black Body Type, 4) and an Asian Body Type;

FIG. 21*b* is a back view of briefs sized using the ethnic sizing system for the proper fit; 1) Black Body Type, 2) European Body Type, 3) Multi-ethnic male of Black Body Type, 4) and an Asian Body Type;

FIG. 21*c* is a side view of briefs sized using the ethnic sizing system for the proper fit: 1) Black Body Type, 2) European Body Type, 3) Multi-ethnic male of Black Body Type, 4) and an Asian Body Type;

FIG. 22*a* is a frontal view of men's t-shirts sized using the ethnic sizing system for the proper fit: 1) European Body type (top left), 2)Black Body Type (top right), 3) Multi-ethnic Body type (bottom left), 4) and an Asian Body Type (bottom right);

FIG. 23*a* is a frontal and back view of men's dress shirts sized using the ethnic sizing system for the proper fit: 1) Black Body Type, 2) European Body Type, 3) Multi-ethnic Body type, 4) and an Asian Body Type, respectively;

FIG. 24*a* is a frontal of men's pant and the main pattern pieces sized using the ethnic sizing system for the European Body Type;

FIG. 24*b* is a frontal of men's pant and the main pattern pieces sized using the ethnic sizing system for the Black Body Type;

FIG. 24*c* is a frontal of men's pant and the main pattern pieces sized using the ethnic sizing system for the Multi-Ethnic Body Type;

FIG. 25 is a frontal of men's pant and the main pattern pieces sized using the ethnic sizing system for the Asian Body Type;

FIG. 26 is a flow chart depicting the manner for forming the requisite patterns;

FIG. 27*a* is a front, perspective view of a female Black Body Type pattern dress form;

FIG. 27*b* is a side, perspective view of a female Black Body Type pattern dress form;

FIG. 28*a* is a front, perspective view of a female European Body Type pattern dress form;

FIG. 28*b* is a side, perspective view of a female European Body Type pattern dress form;

FIG. 29*a* is a front, perspective view of a female Bi-racial Body Type pattern dress form, consisting of the European Body Type and the Black Body Type, where the Black Body Type is dominant;

FIG. 29*b* is a side, perspective view of a female Bi-racial Body Type pattern dress form, consisting of the European Body Type and the Black Body Type, where the Black Body Type is dominant;

FIG. 30*a* is a front, perspective view of a female Asian Body Type pattern dress form;

FIG. 30*b* is a side, perspective view of a female Asian Body Type pattern dress form;

FIG. 31*a* a front, perspective view of a male Black Body Type pattern dress form;

FIG. 31*b* is a side, perspective view of a male Black Body Type pattern dress form;

FIG. 32*a* is a front, perspective view of a male European Body Type pattern dress form;

FIG. 32*b* is a side, perspective view of a male European Body Type pattern dress form;

FIG. 33*a* is a front, perspective view of a male Bi-racial Body Type pattern dress form, consisting of the European Body Type and the Black Body Type, where the Black Body Type is dominant:

FIG. 33*b* is a side, perspective view of a male Bi-racial Body Type pattern dress form, consisting of the European Body Type and the Black Body Type, where the Black Body Type is dominant;

FIG. 34*a* is a front, perspective view of a male Asian Body Type pattern dress form;

FIG. 34*b* is a side, perspective view of a male Asian Body Type pattern dress form;

FIG. 35*a* is a front view of Black body type waistline of pant;

FIG. 35*b* is a back view of Black body type waistline of pant, and contours created by waist-thigh dart combination;

FIG. 35*c* is a side view of Black body type waistline and back contours created by waist-thigh dart combination;

FIG. 36*a* is a front view of mixed Black body type waistline of pant.

Figure 36B:
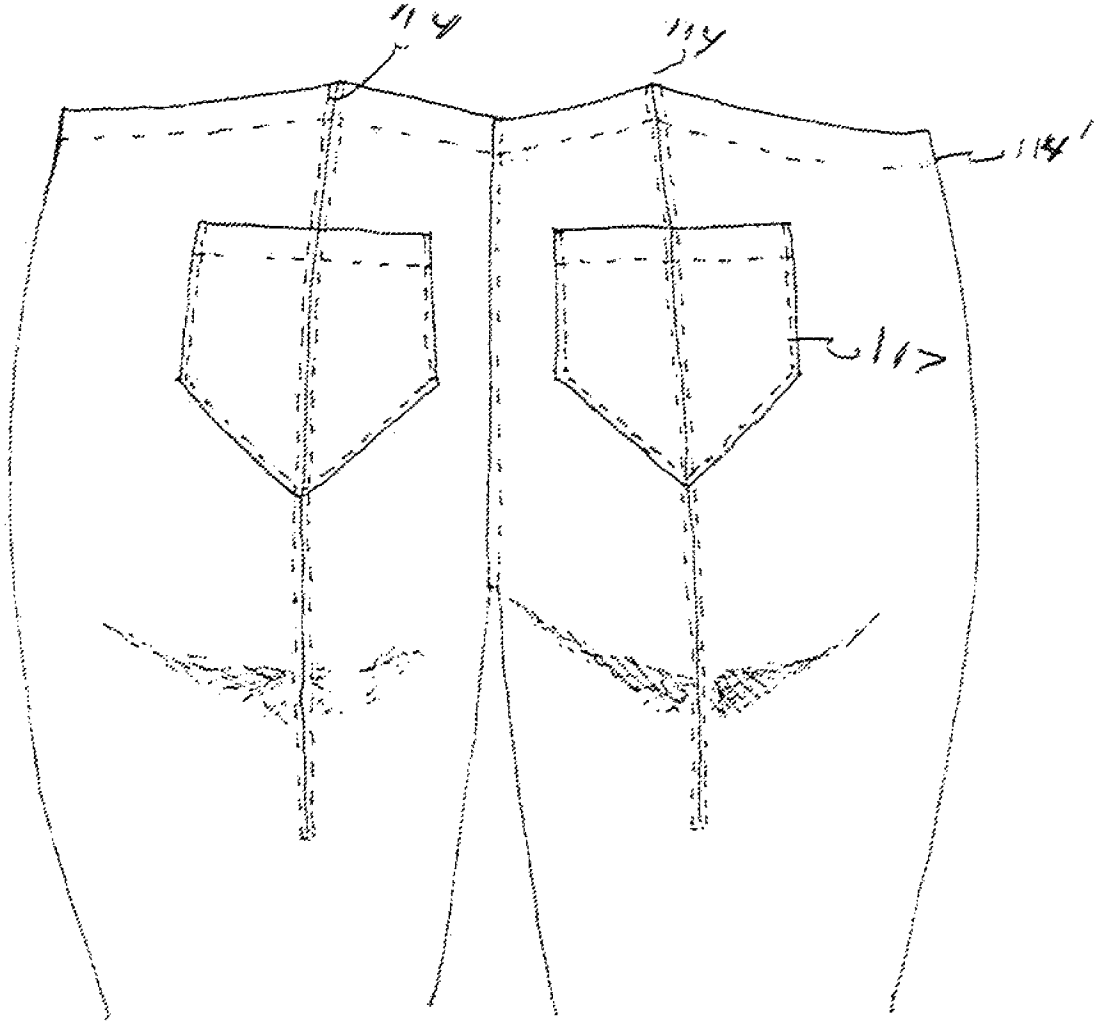
Figure 36C:
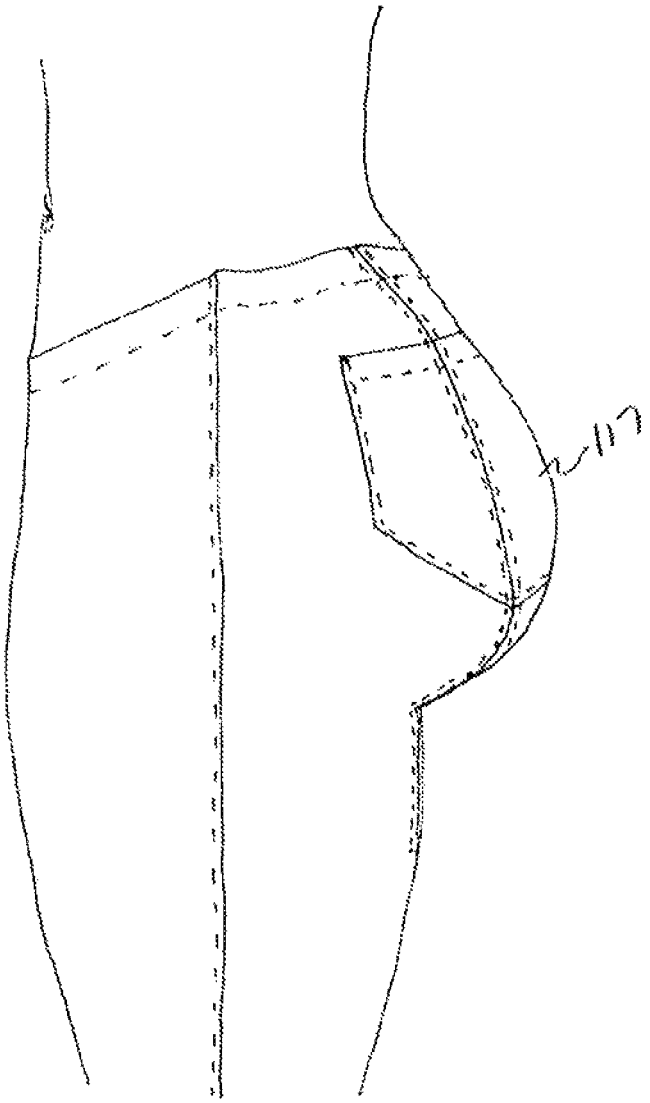
Figure 37A:
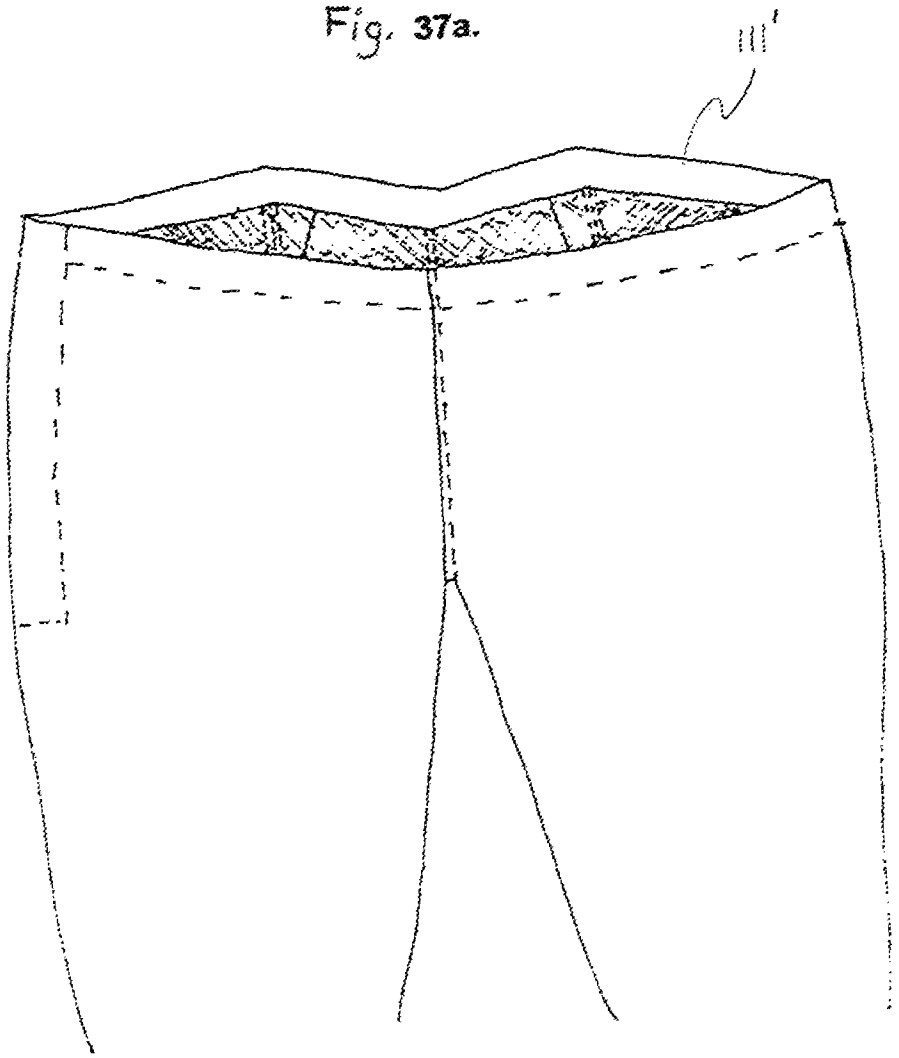
Figure 37B:
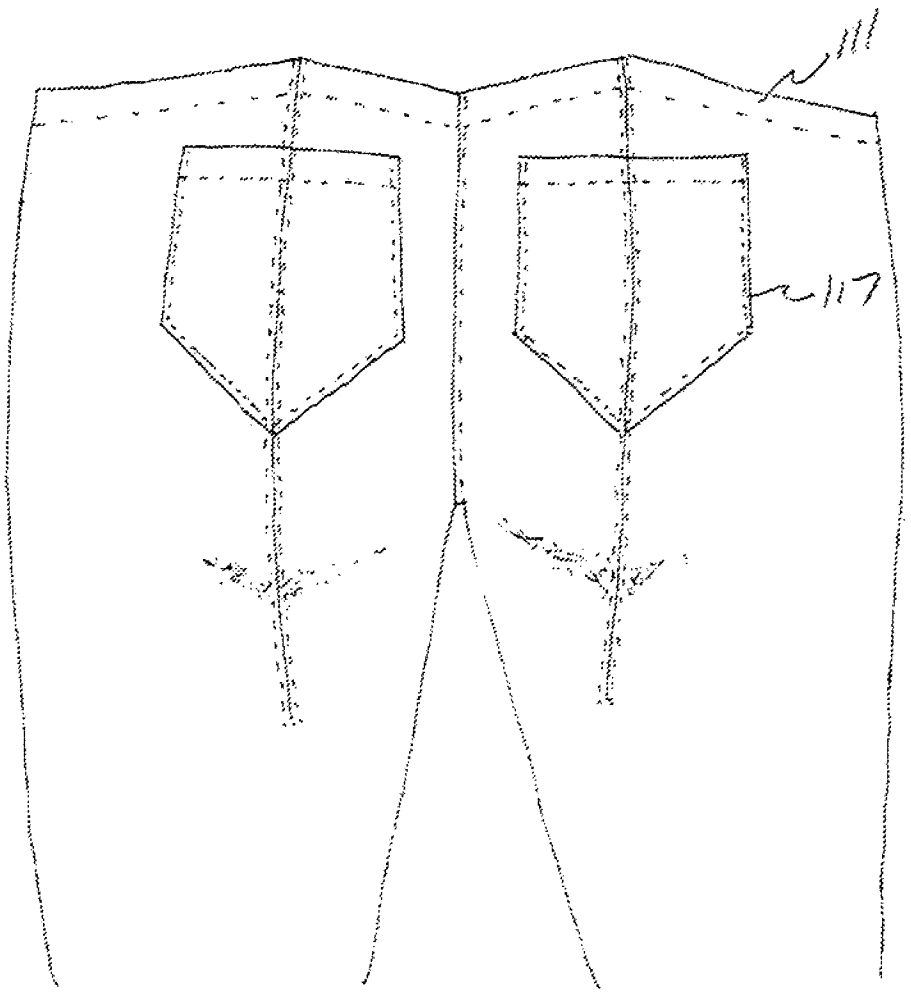
Figure 37C:
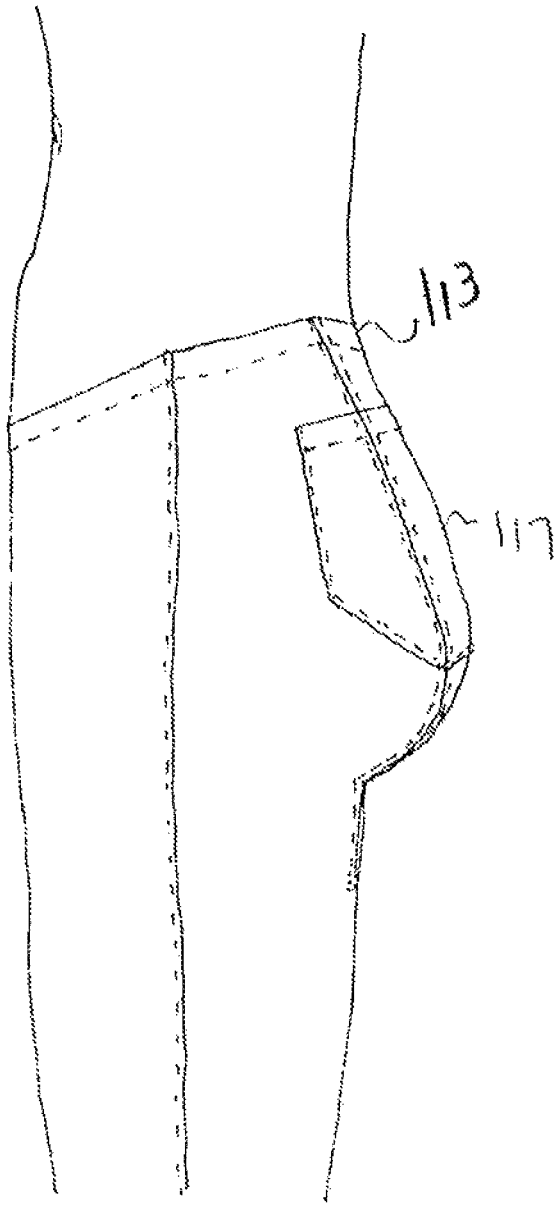
Figure 38A:
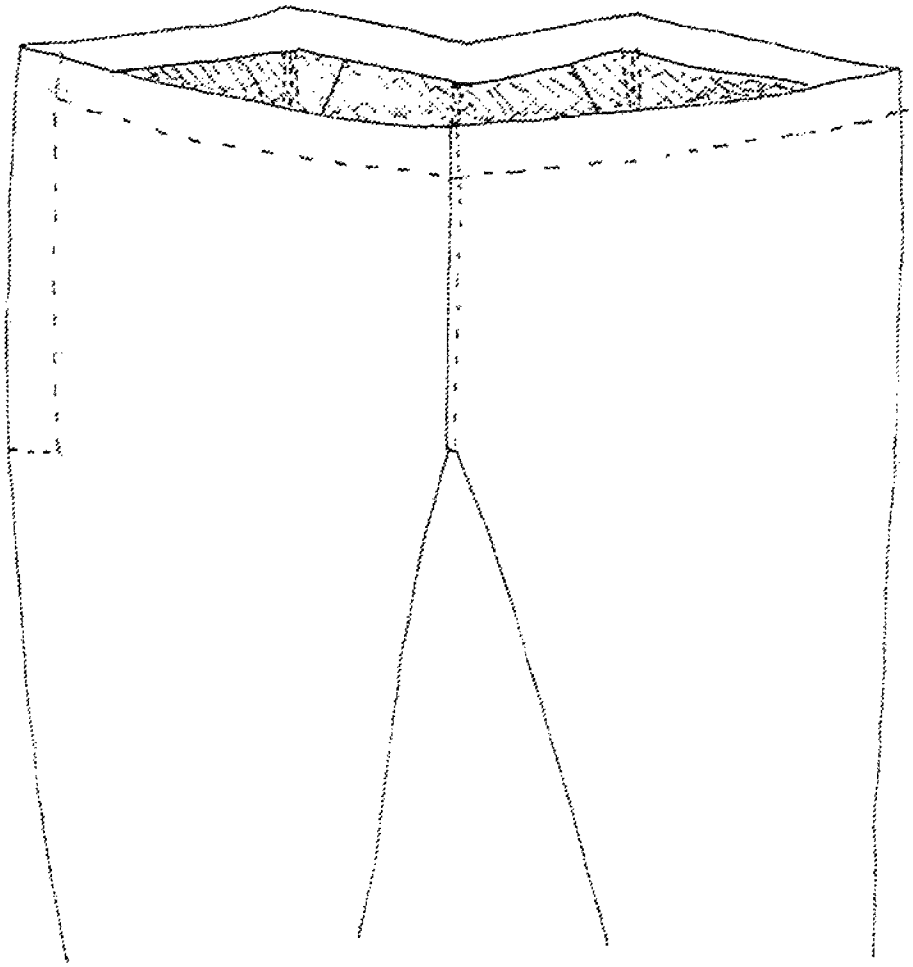
Figure 38B:
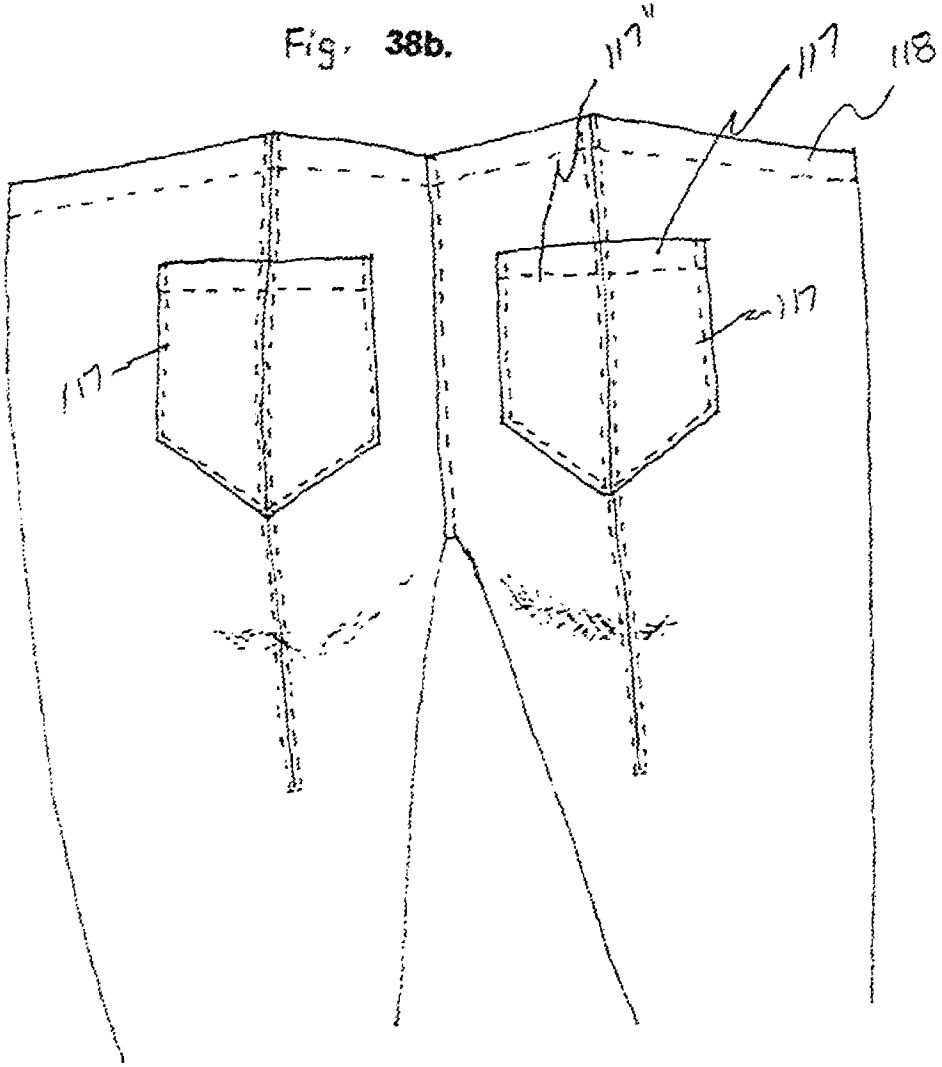
Figure 38C:
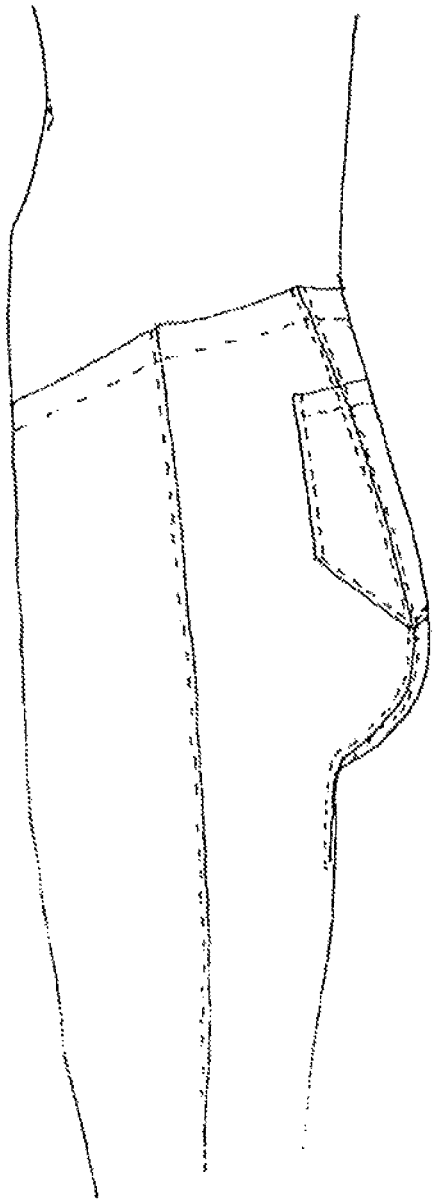
Figure 39D:
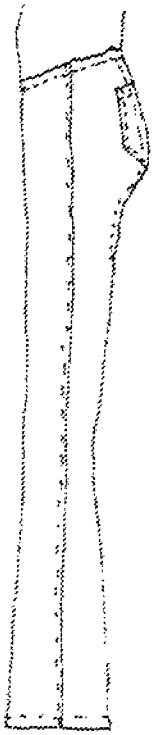
Figure 39C:
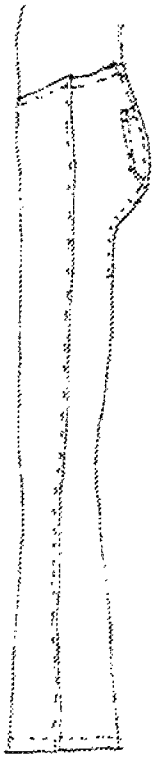
Figure 39B:
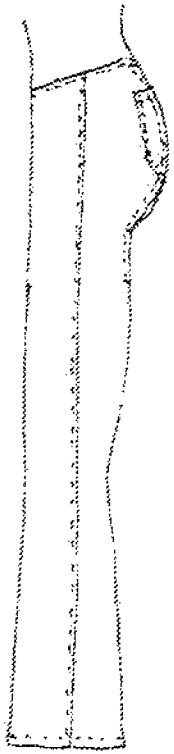
Figure 39A:
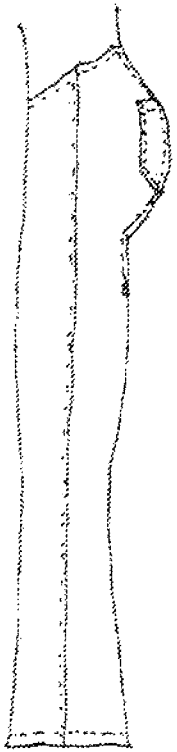

FIG. 36*b* is a back view of mixed Black body type waistline of pant, and contours created by waist-thigh dart combination;

FIG. 36*c* is a side view of mixed Black body type waistline and back contours created by waist-thigh dart combination;

FIG. 37*a* is a front view of Caucasian body type waistline of pant;

FIG. 37*b* is a back view of Caucasian body type waistline of pant, and contours created by waist-thigh dart combination;

FIG. 37*c* is a side view of Caucasian body type waistline and back contours created by waist-thigh dart combination;

FIG. 38*a* is a front view of Asian body type waistline of pant;

FIG. 38*b* is a back view of Asian body type waistline of pant, and contours created by waist-thigh dart combination;

FIG. 38*c* is a side view of Asian body type waistline and back contours created by waist-thigh dart combination;

FIG. 39*a* is a side view of Black body type profile contour of pocket fit and waist-thigh dart fit;

FIG. 39*b* is a side view of mixed Black body type profile contour of pocket fit and waist-thigh dart fit;

FIG. 39*c* is a side view of Caucasian body type profile contour of pocket fit and waist-thigh dart fit.

Figure 41B:
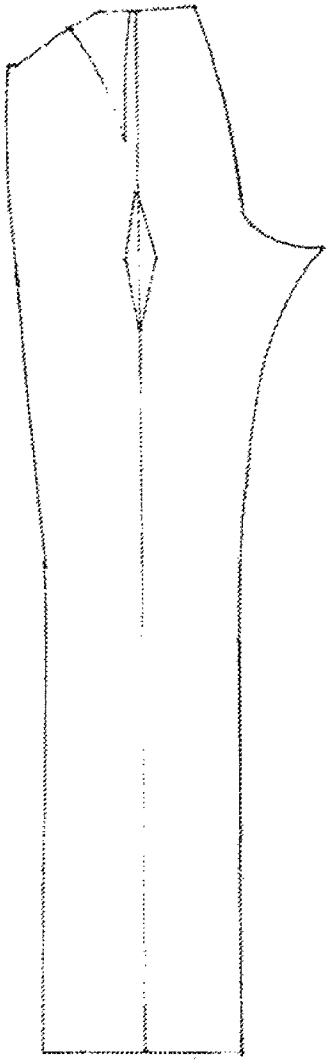
Figure 41A:
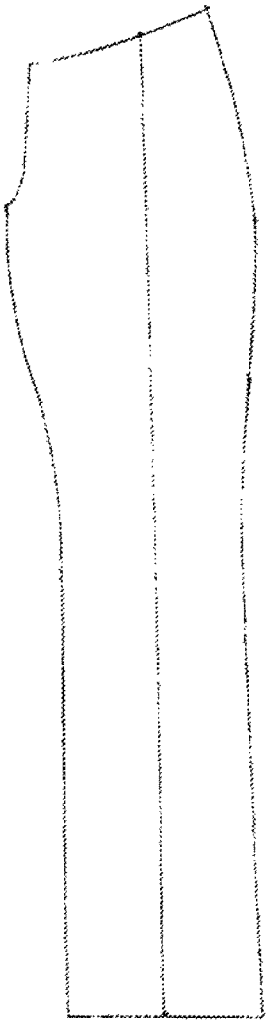
Figure 40B:
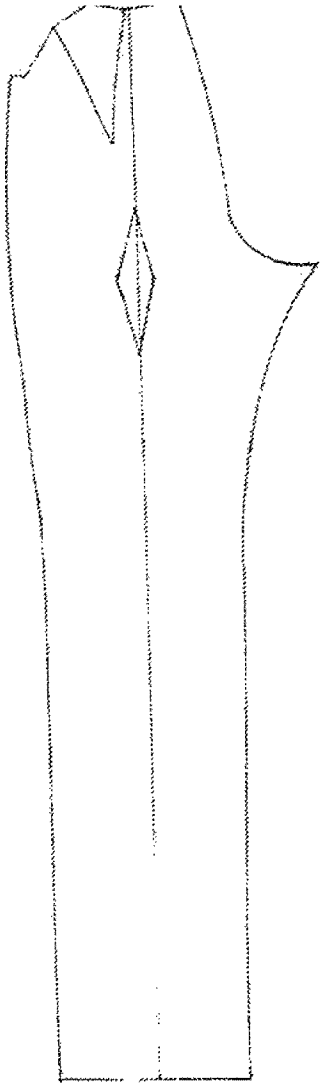
Figure 40A:
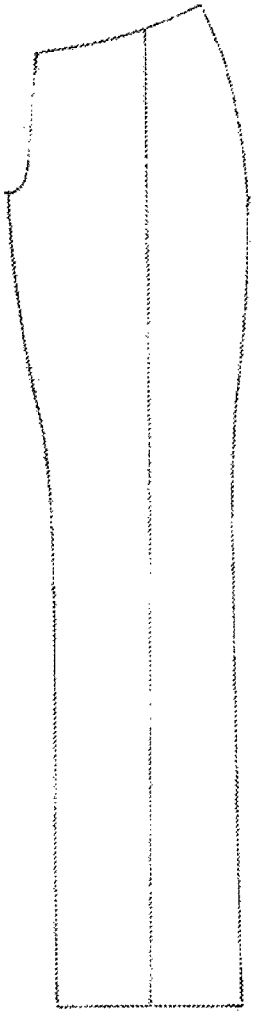
Figure 43B:
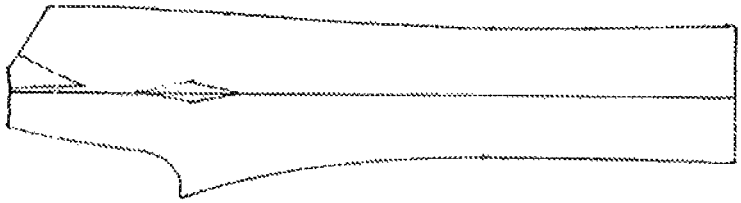
Figure 43A:
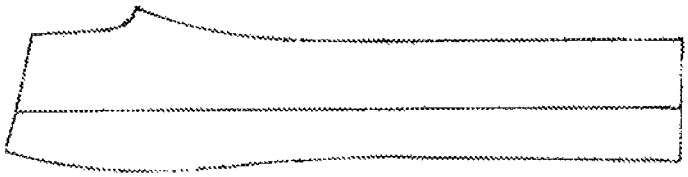
Figure 42B:
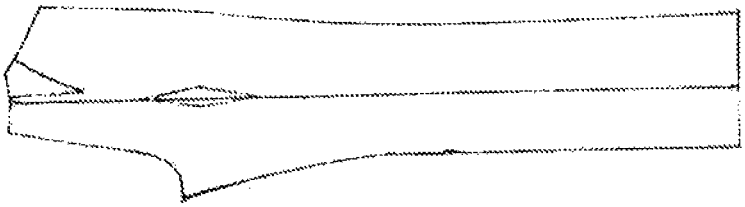
Figure 42A:
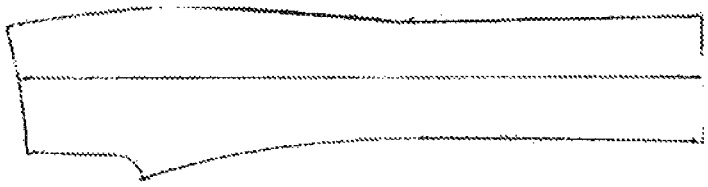
Figure 44C:
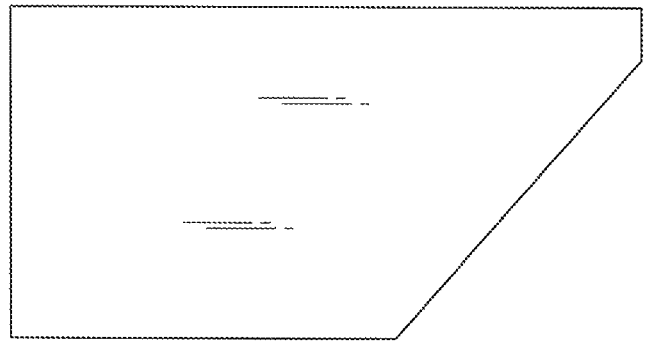
Figure 44B:
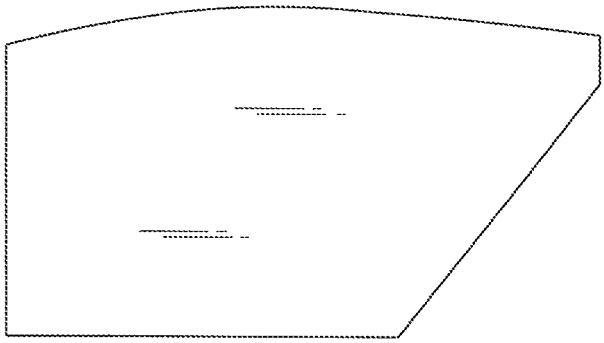
Figure 44A:
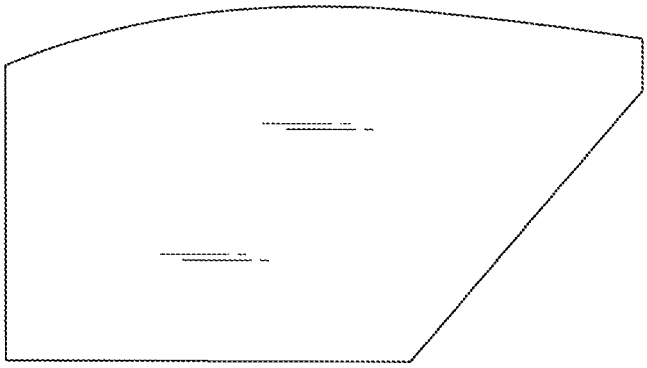
Figure 45A:
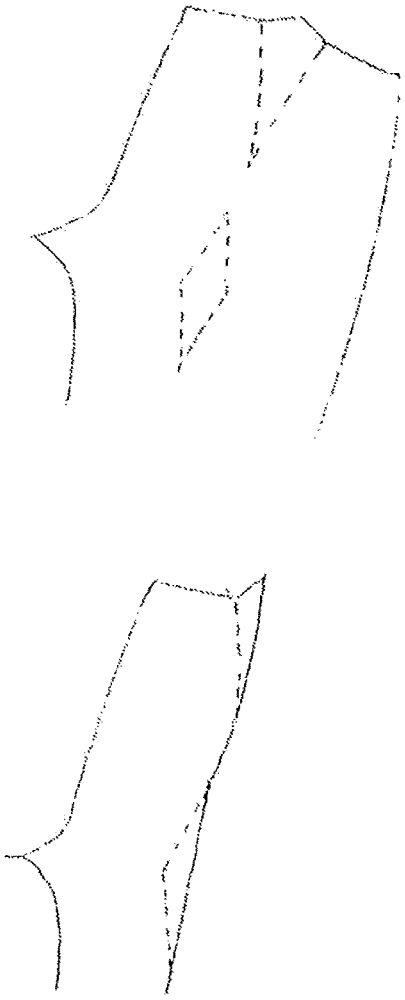
Figure 45B:
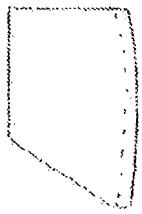
Figure 45C:
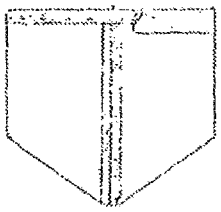
Figure 45D:
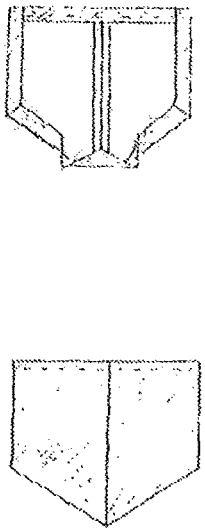
Figure 45E:
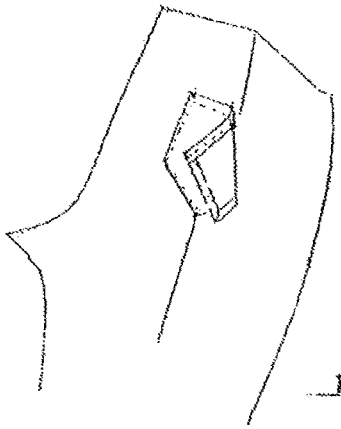
Figure 45F:
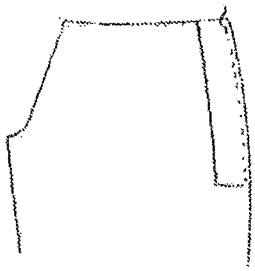
Figure 45G:
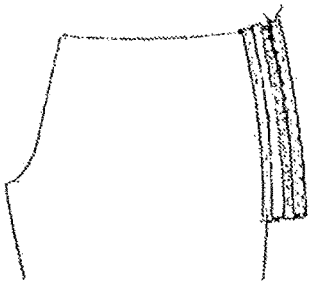
Figure 45H:
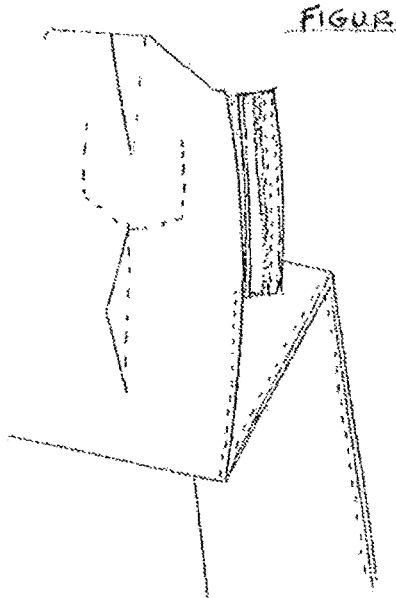
Figure 45I:
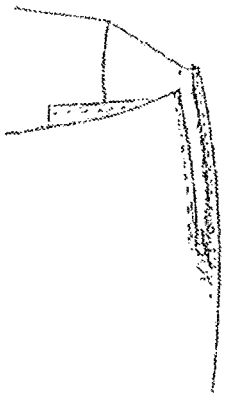
Figure 45J:
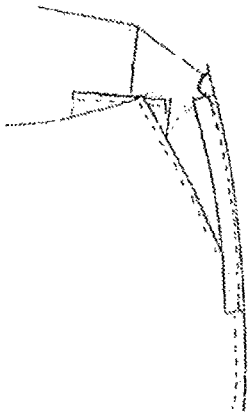
Figure 45K:
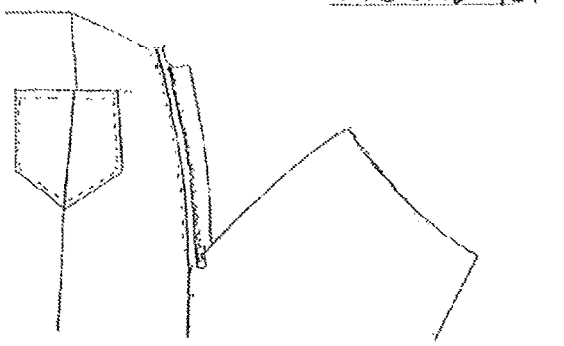
Figure 45N:
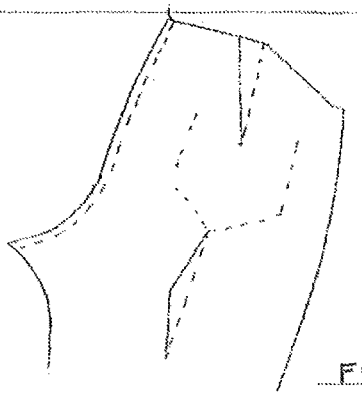
Figure 45L:
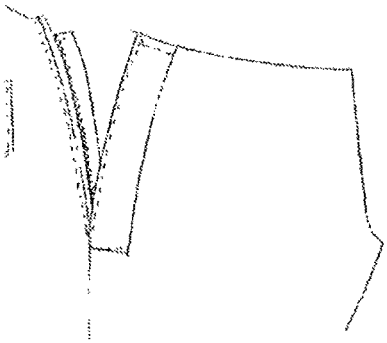
Figure 45O:
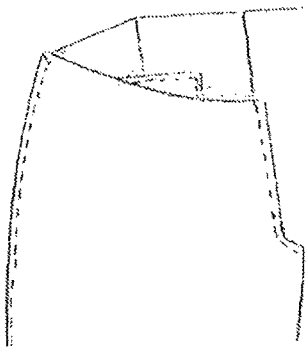
Figure 45M:
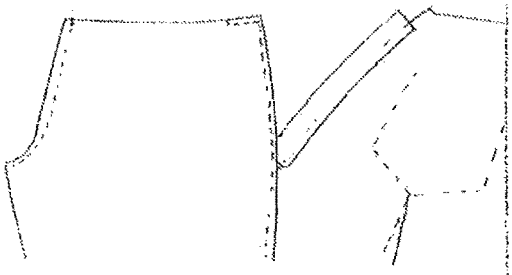
Figure 45P:
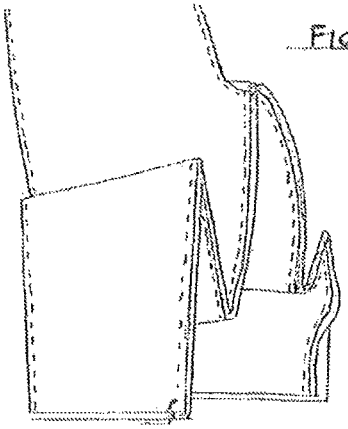
Figure 45X:
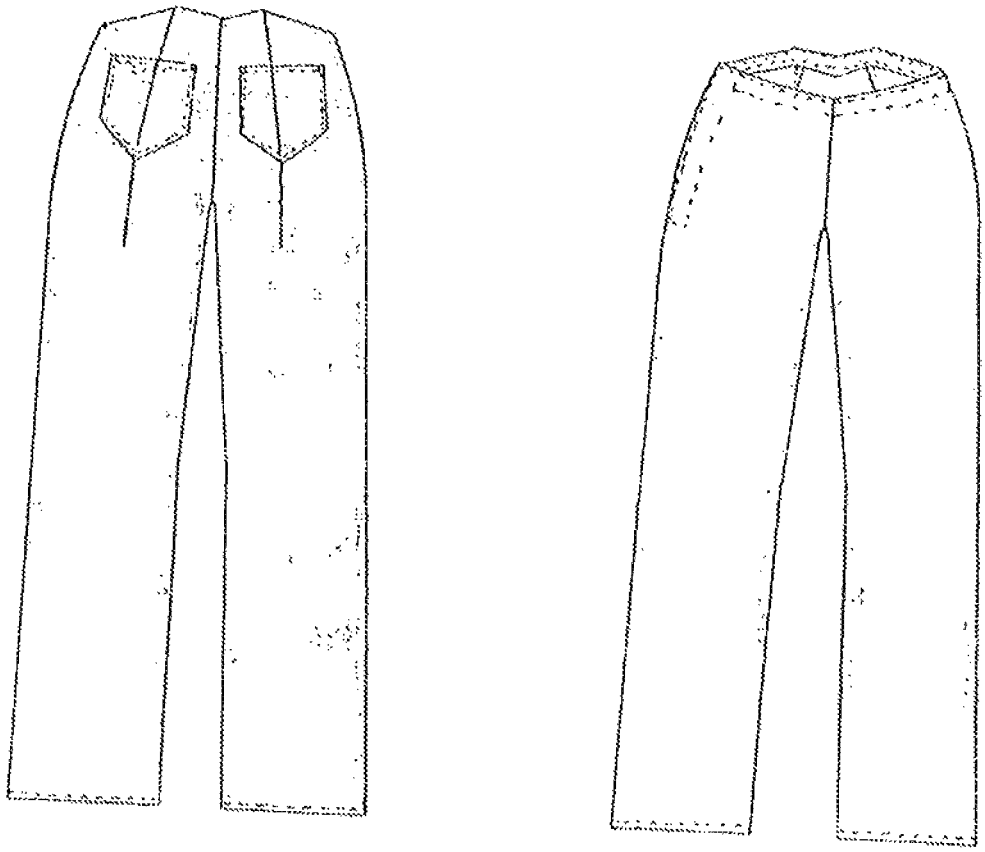
Figure 45Y:
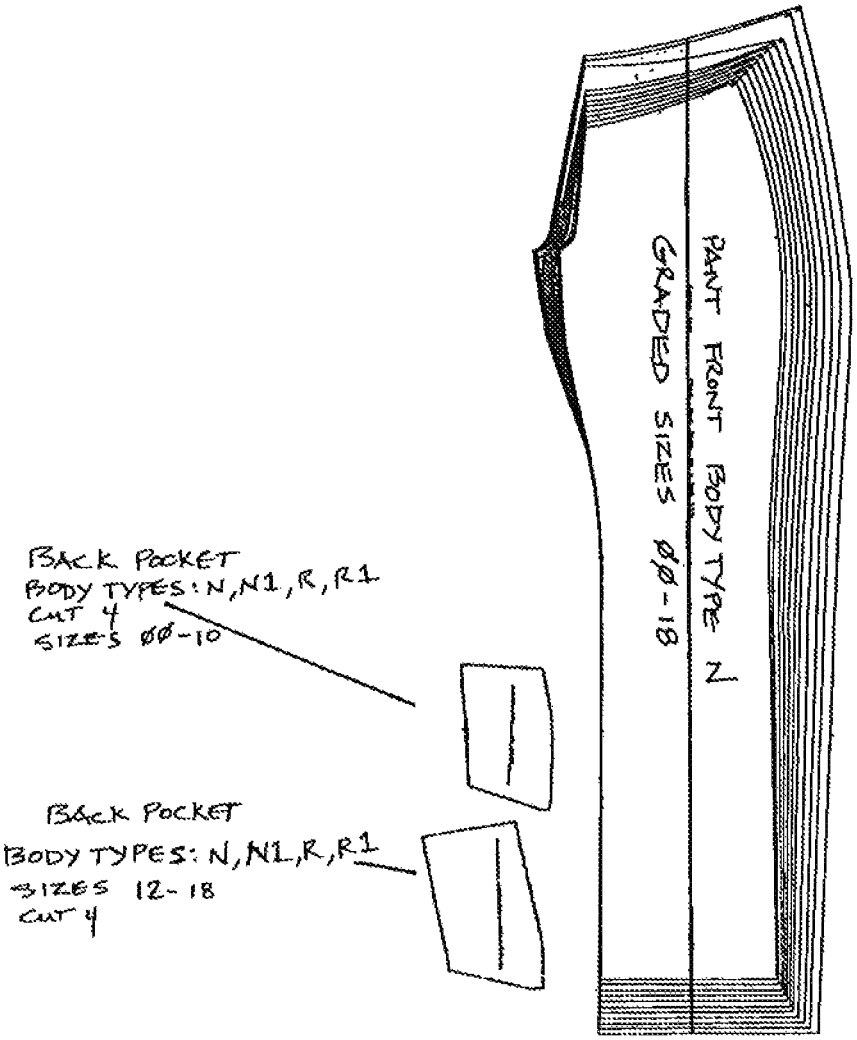
Figure 45Z:
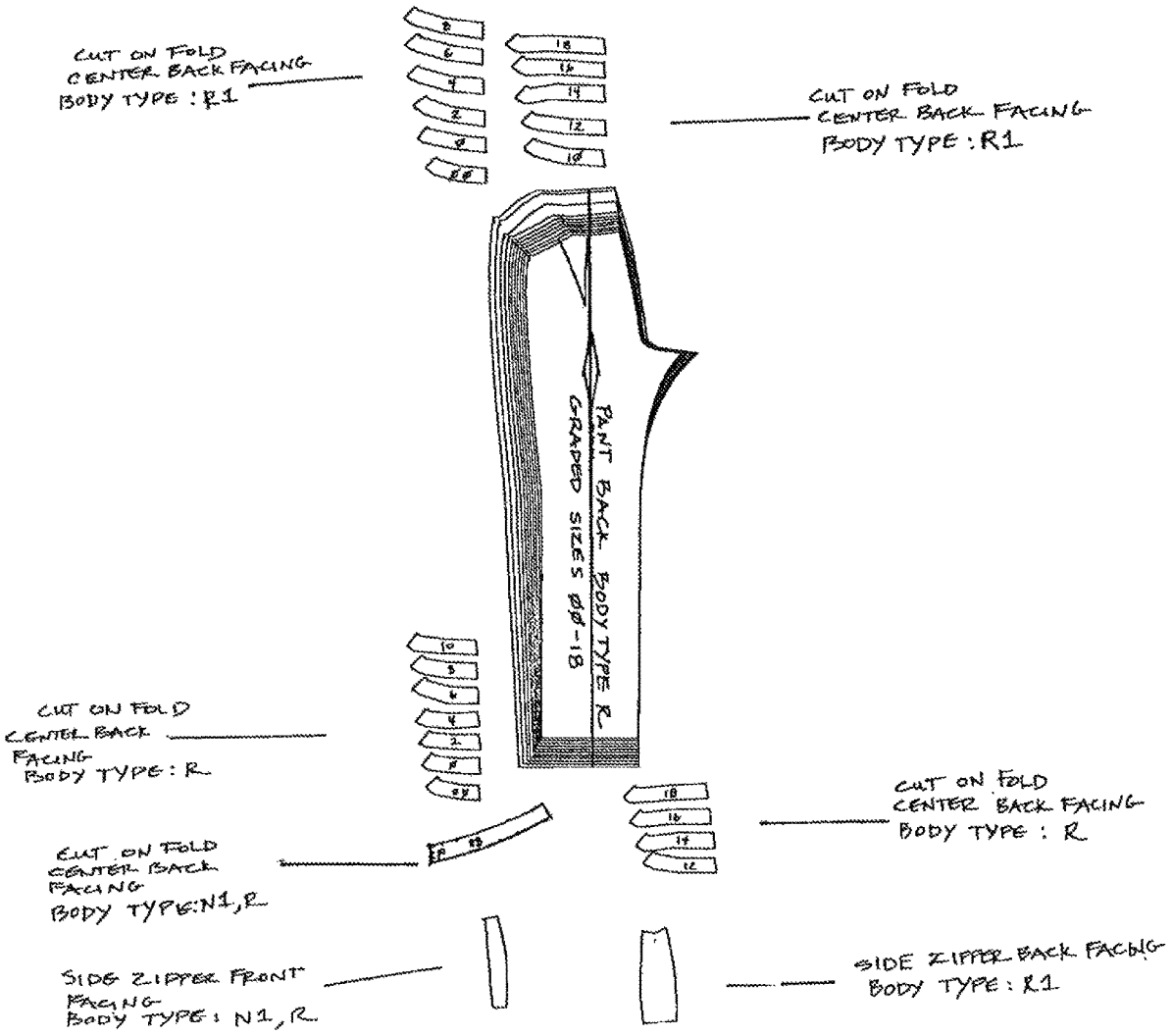
Figure 45A:
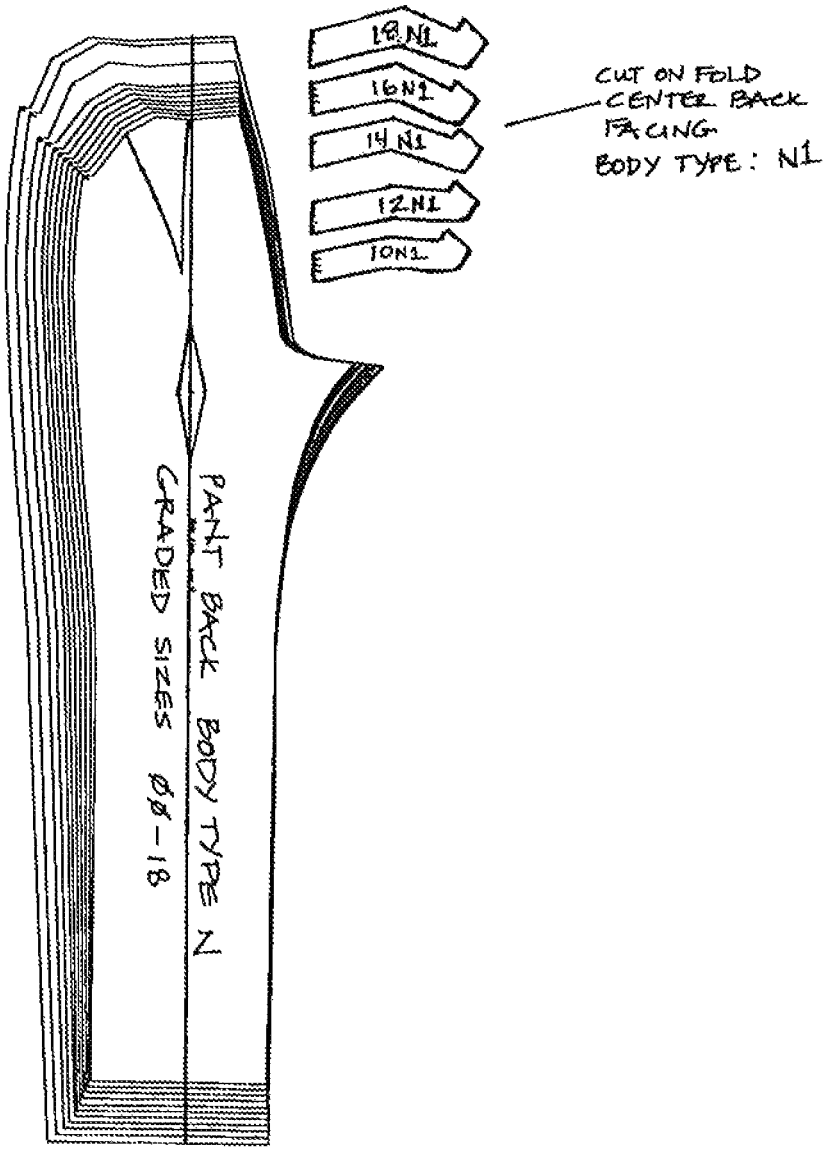
Figure 45B:
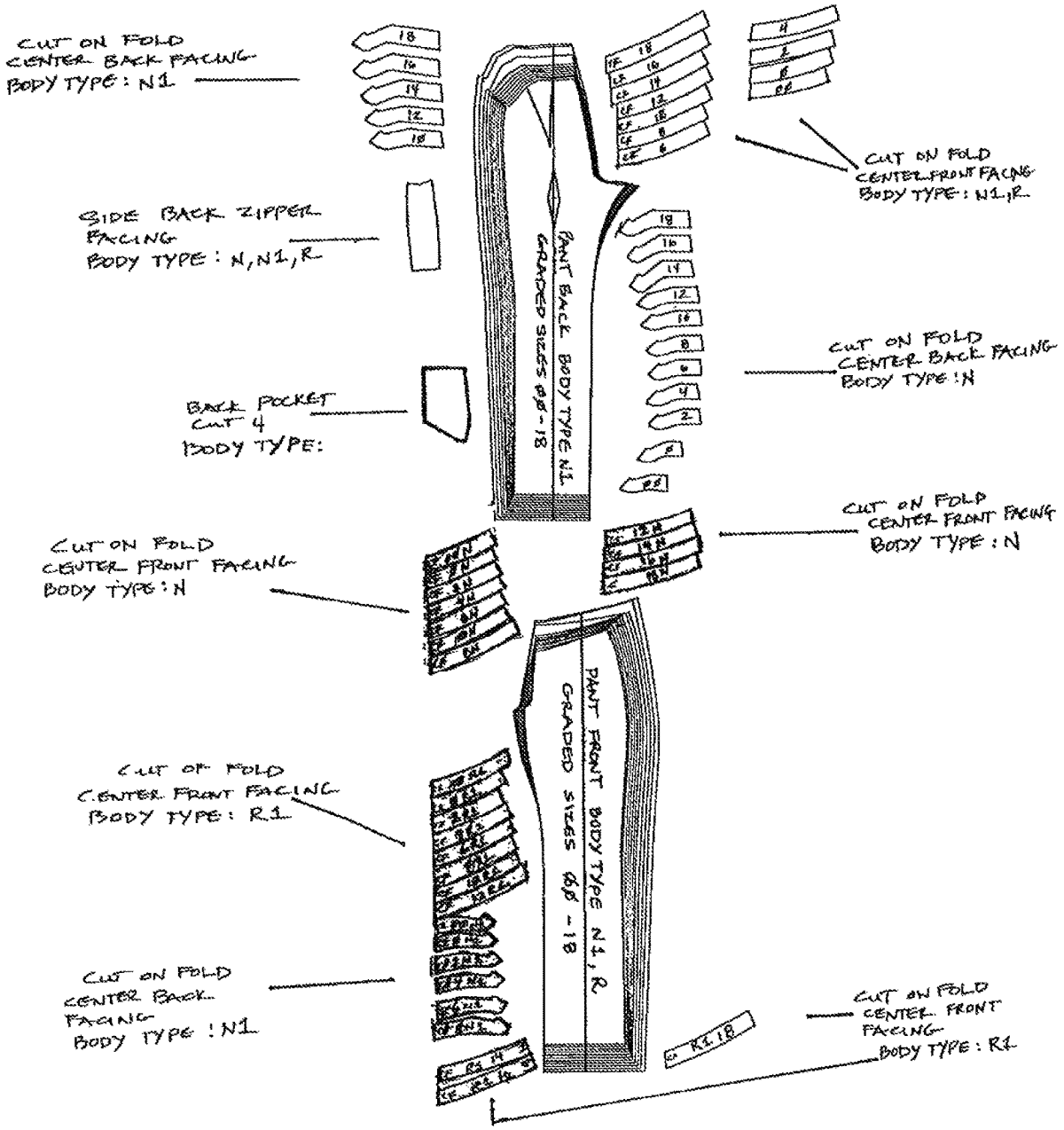
Figure 45:
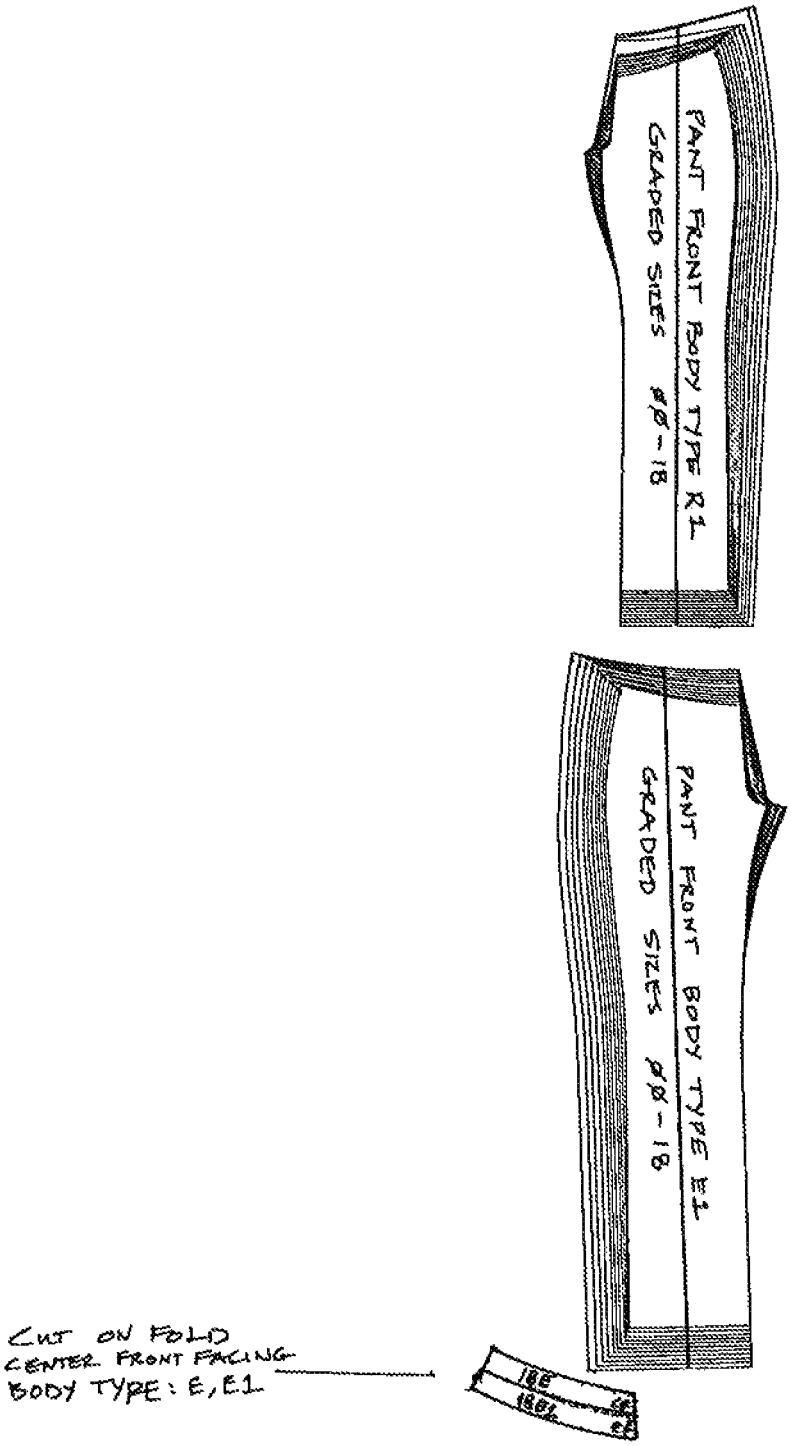
Figure 45D:
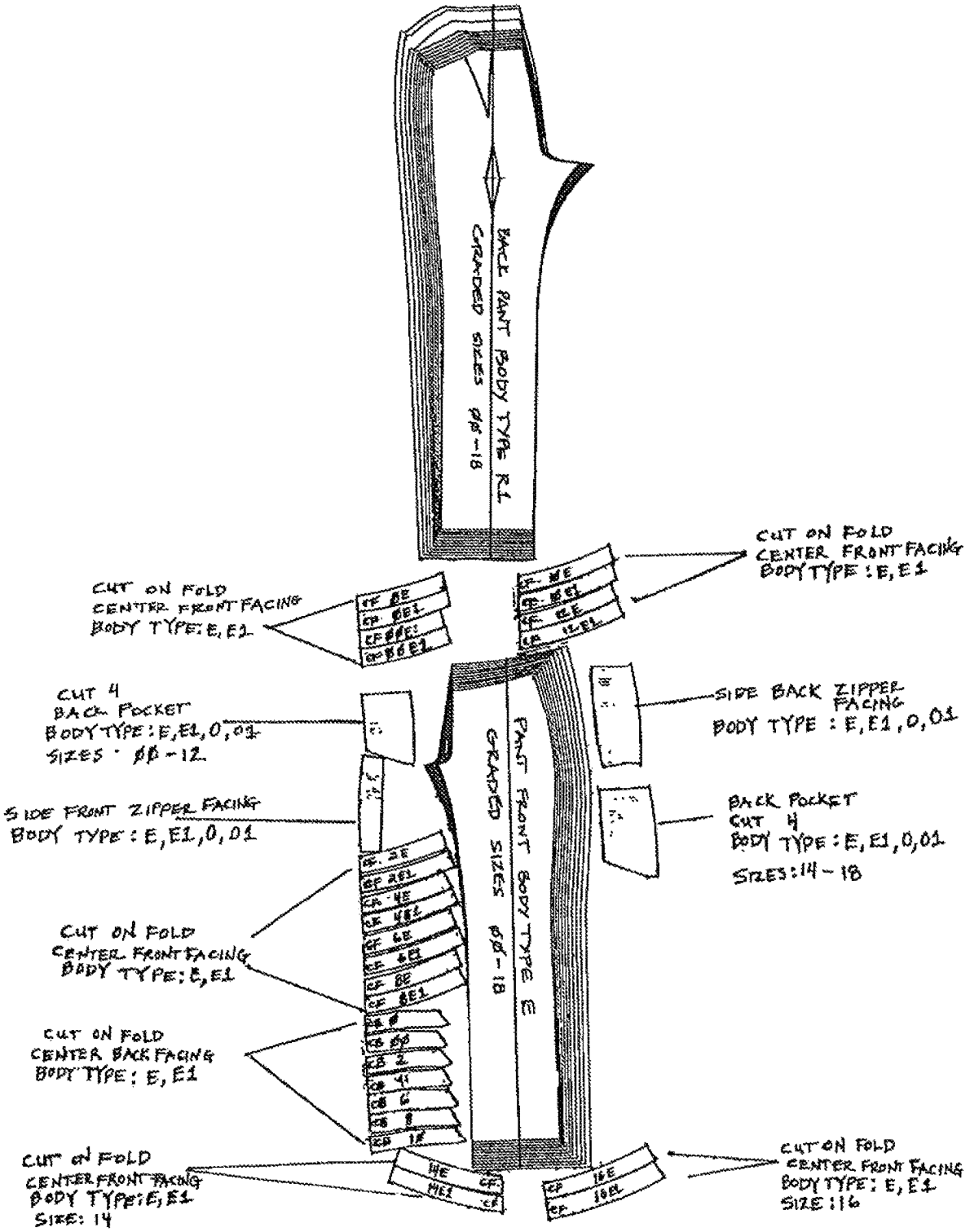
Figure 45:
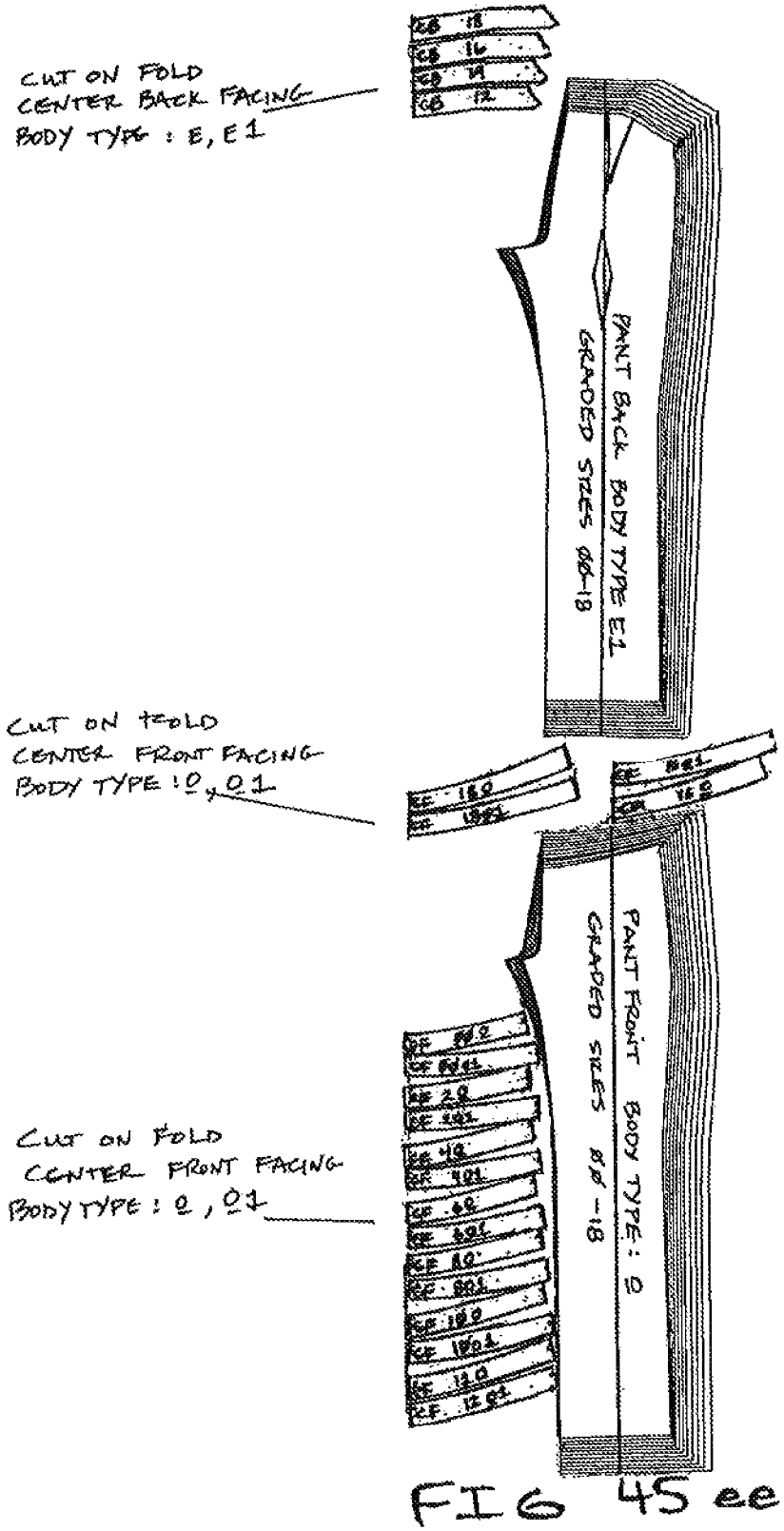
Figure 45F:
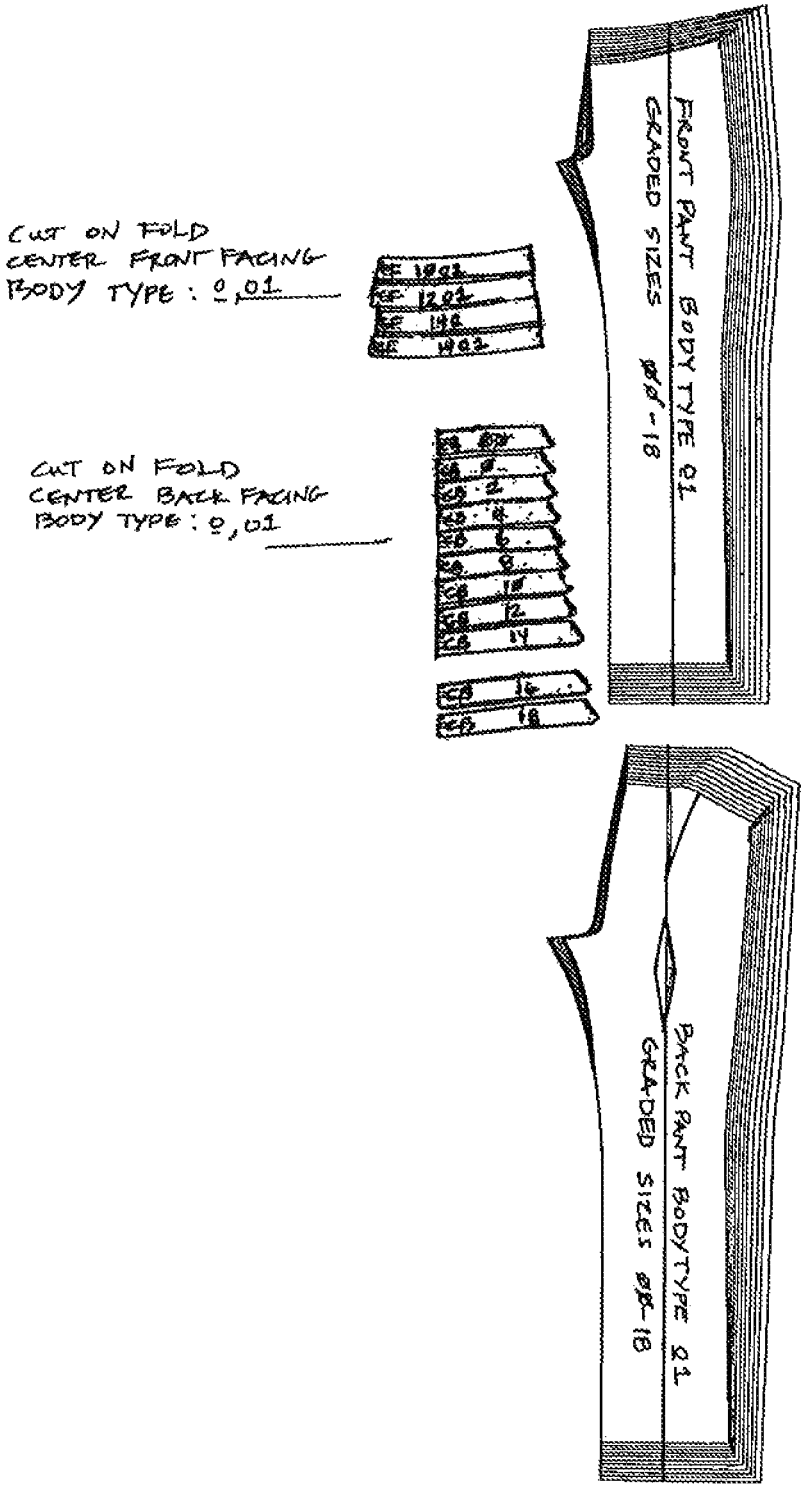
Figure 45G:
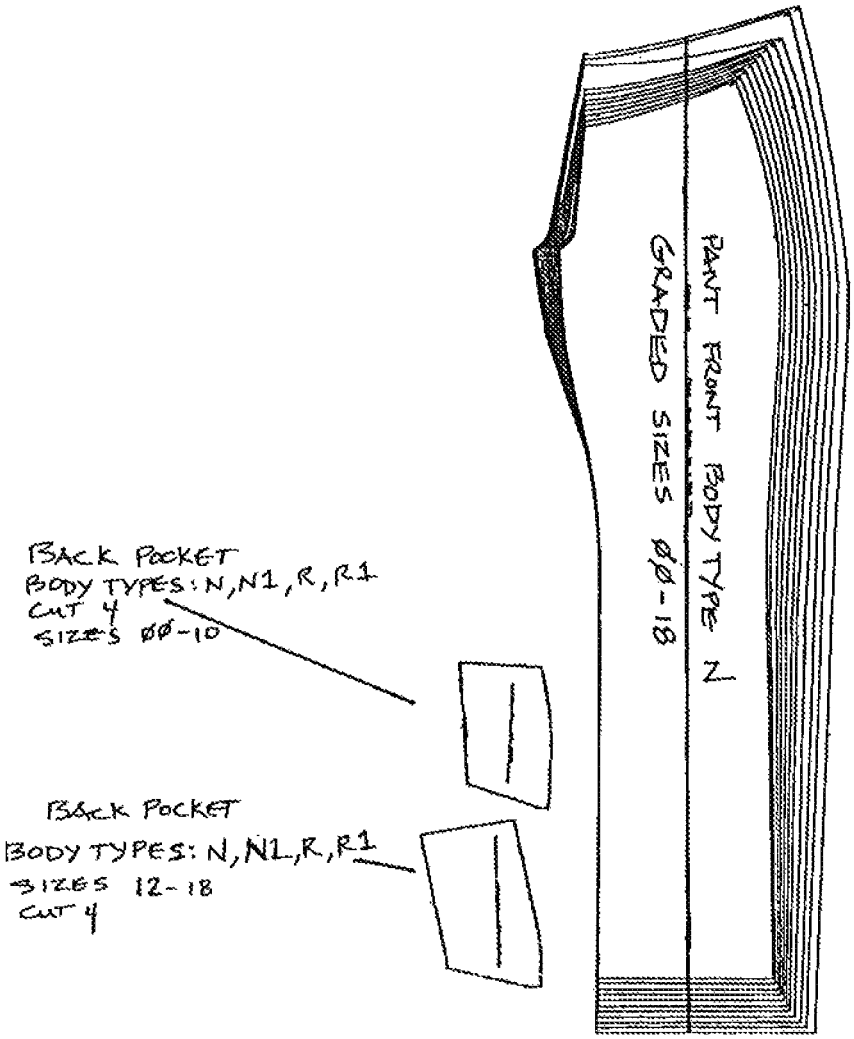
Figure 45H:
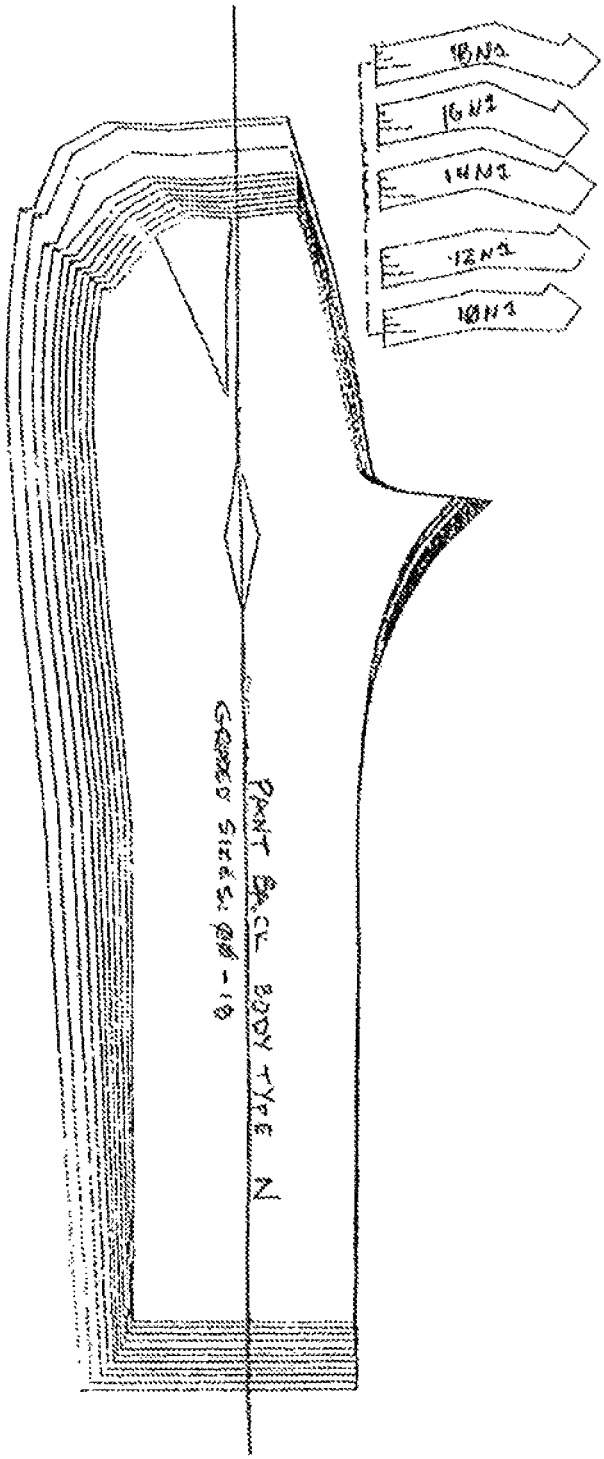
Figure 45I:
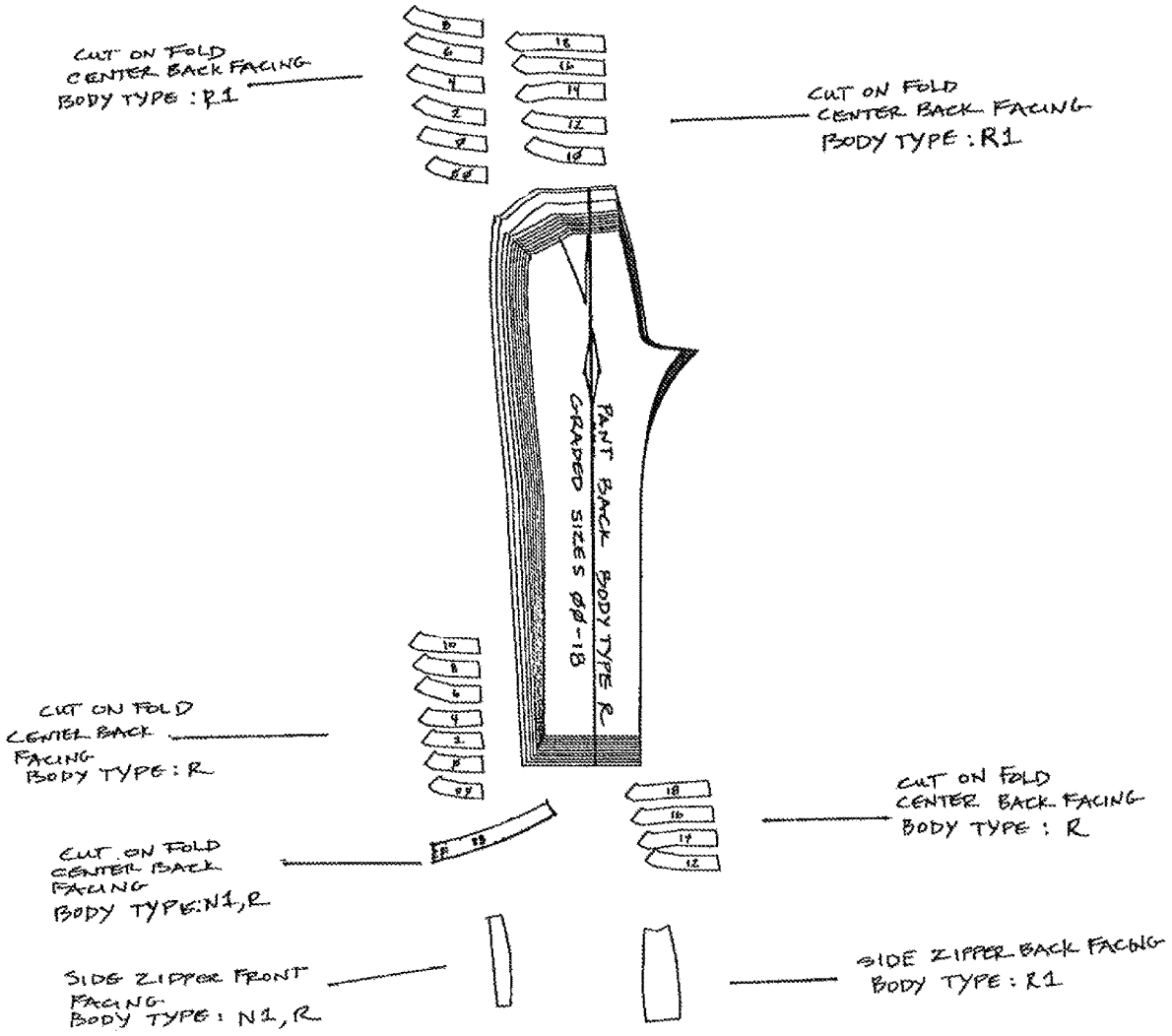
Figure 45J:
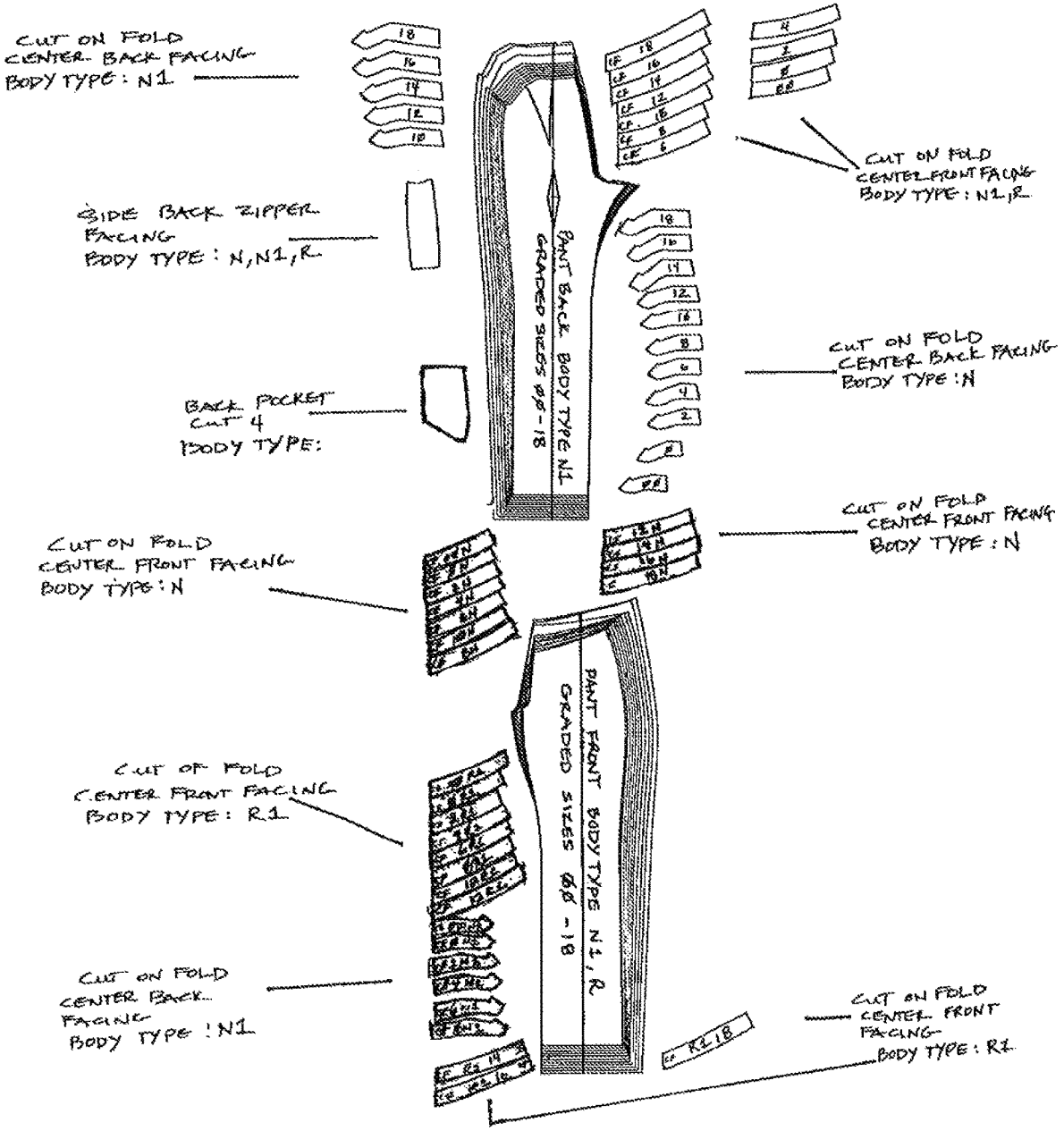
Figure 45:
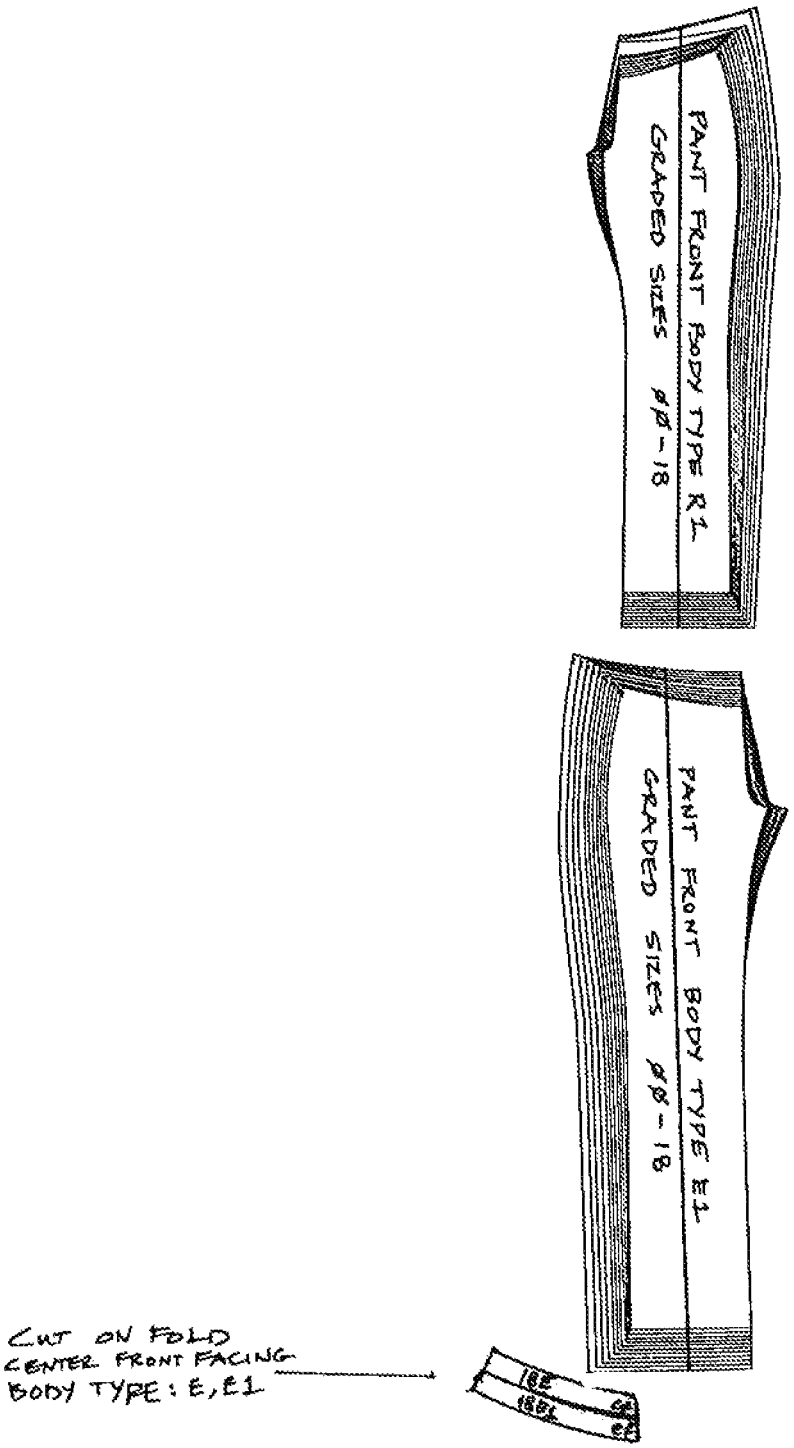
Figure 45:
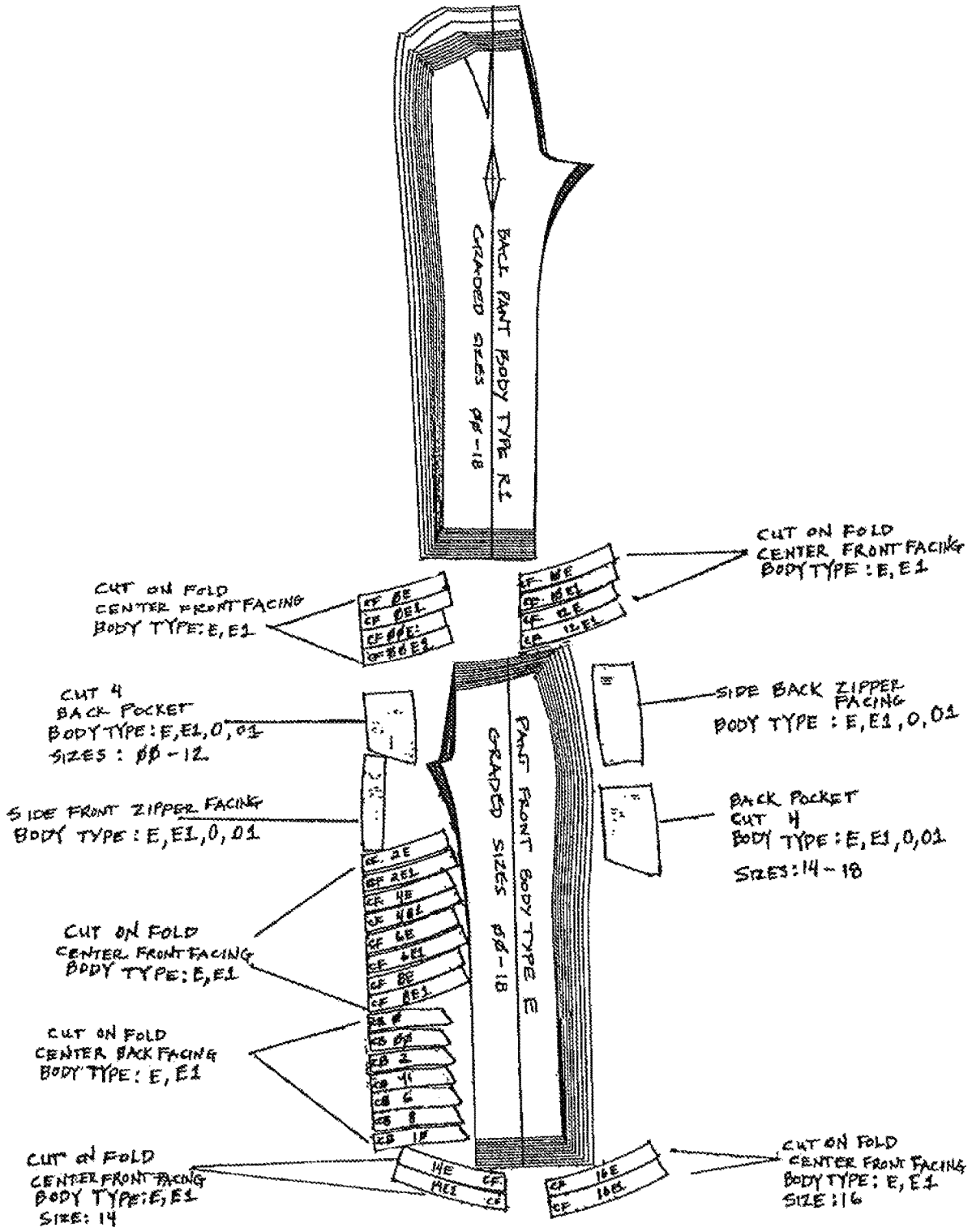
Figure 45:
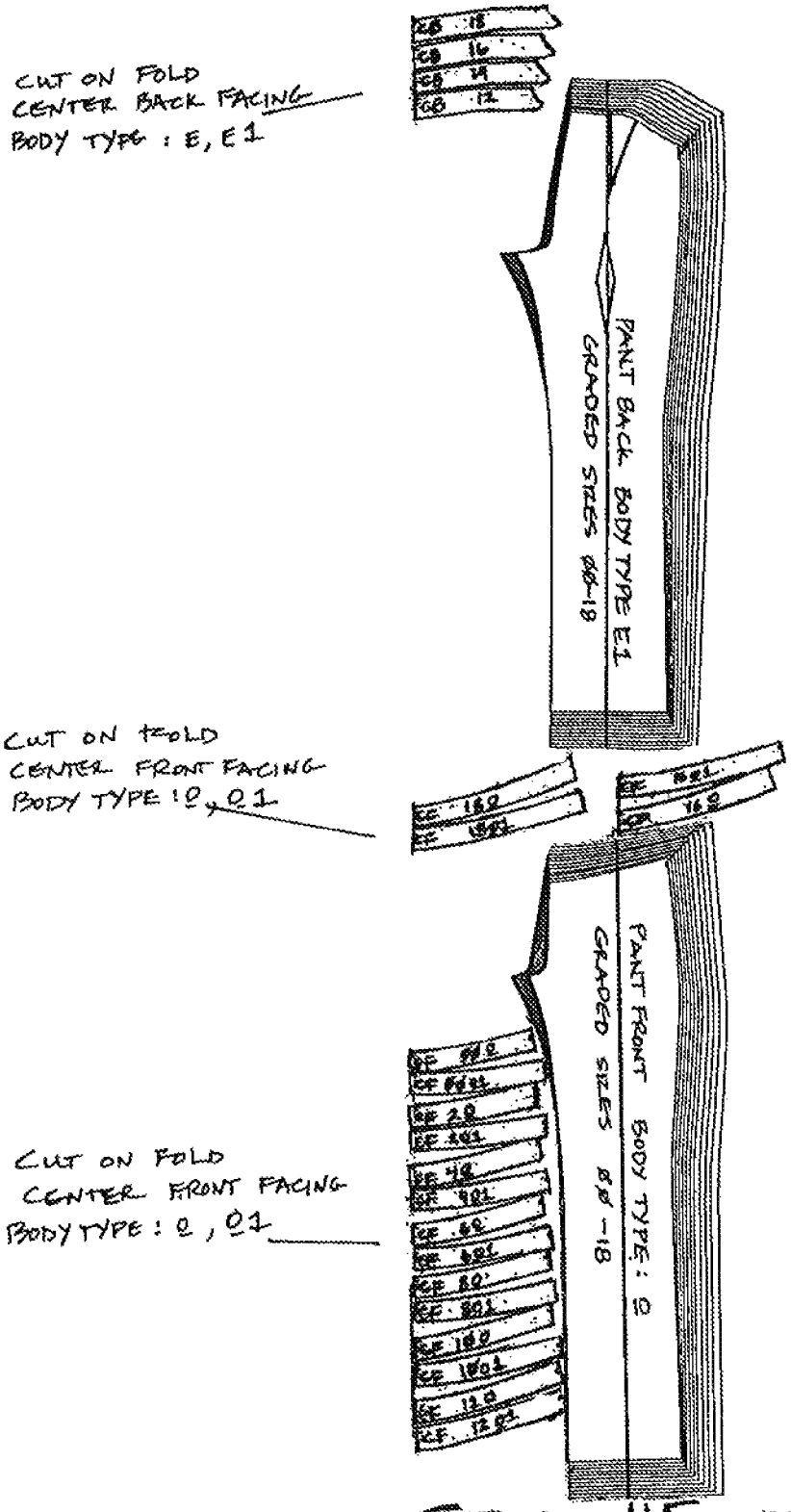
Figure 45N:
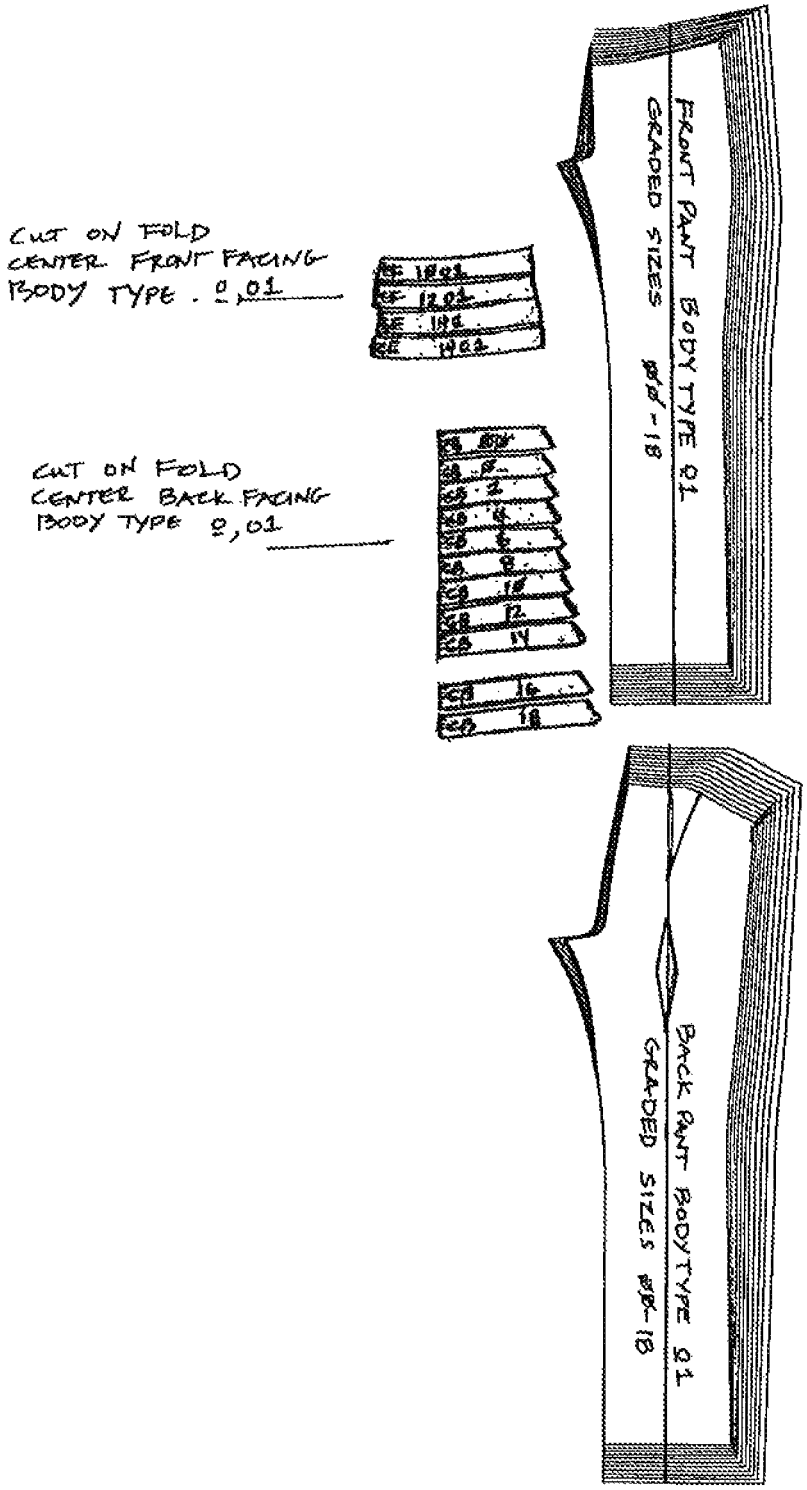
Figure 46:
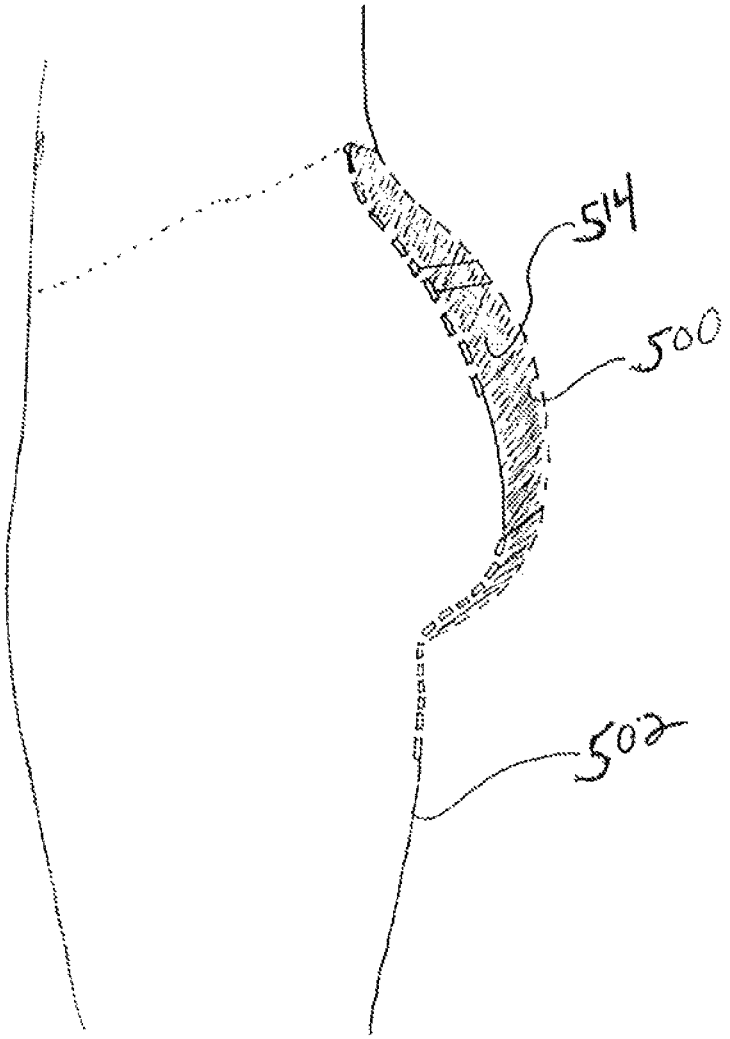
Figure 47:
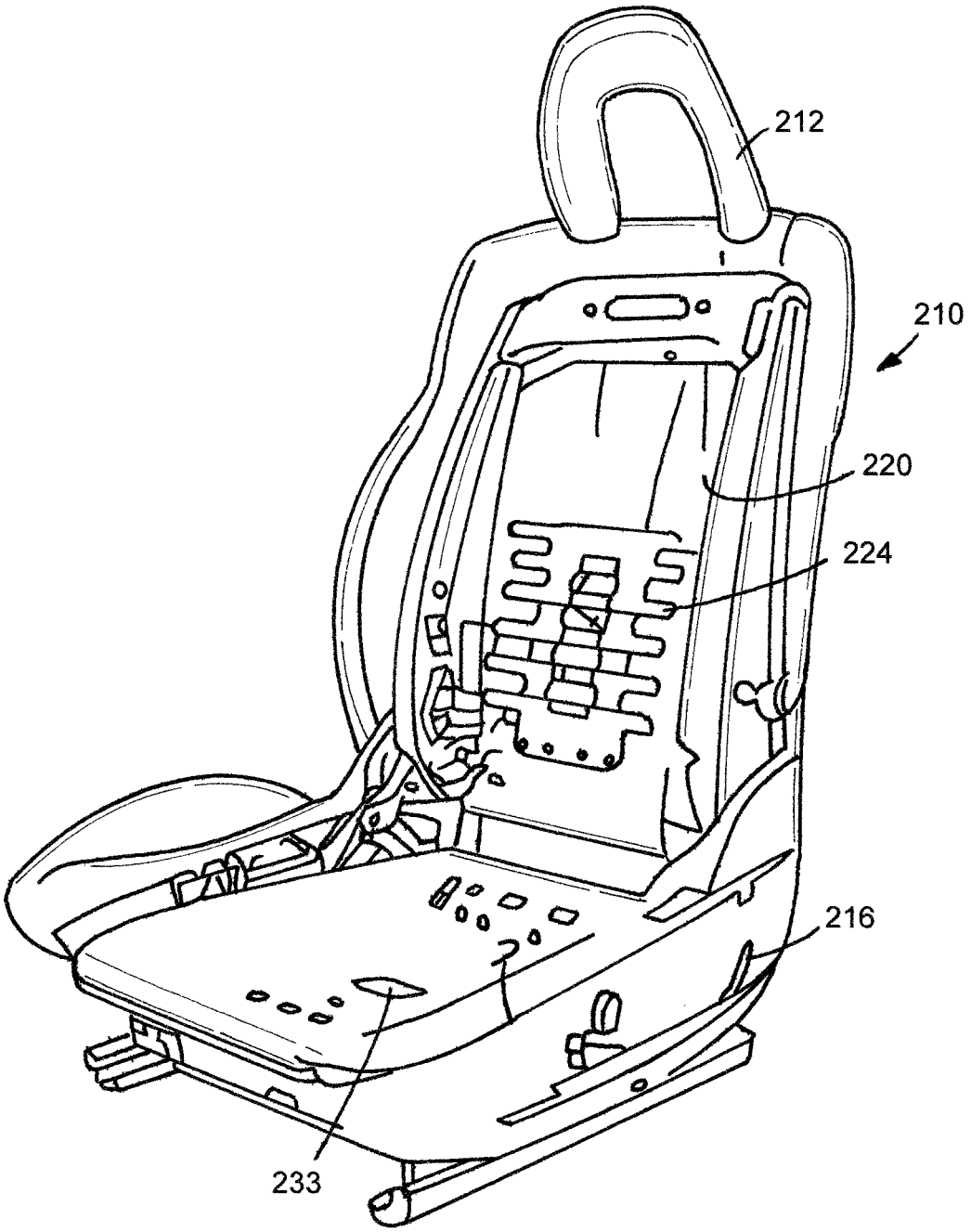
Figure 48:
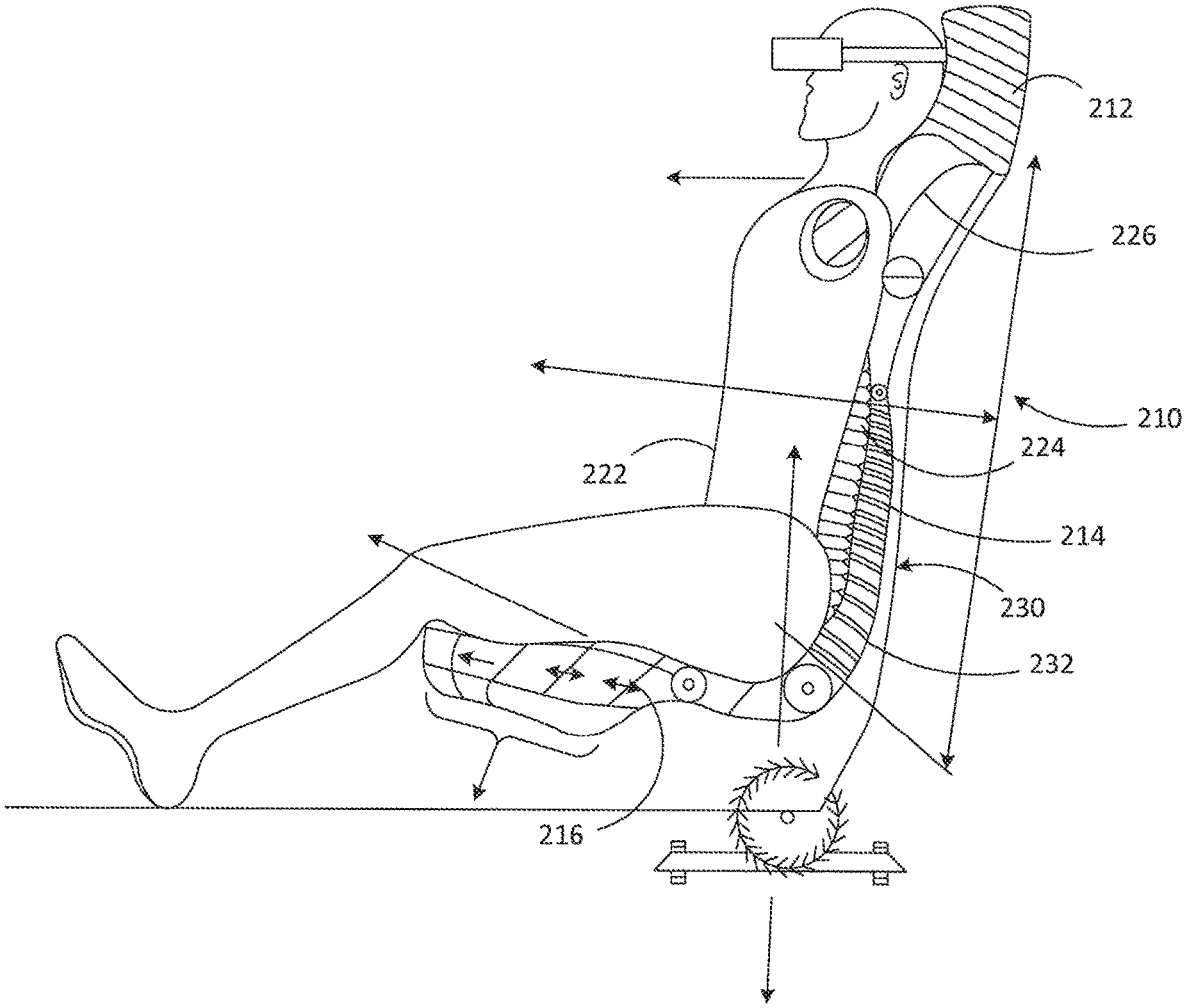

FIG. 39*d* is a side view of Asian body type profile contour of pocket lit and waist-thigh dart fit;

FIG. 40*a* is a side pant pattern for Black body type;

FIG. 40*b* is a Black pant pattern for Black body type with waist and thigh dart;

FIG. 41*a* is a side pant pattern for mixed Black body type;

FIG. 41*b* is a back pant pattern for mixed Black body type with waist and thigh dart;

FIG. 42*a* is a side pant, pattern for Asian body type;

FIG. 42*b* is a side pant pattern for Asian body type with waist, and thigh dart;

FIG. 43*a* is a side pant pattern for Caucasian body type;

FIG. 43*b* is a side pant pattern for Caucasian body type with waist and thigh dart;

FIG. 44*a* is a basic back pocket, pattern (half of a finished pocket) for the Black and mixed Black body types;

FIG. 44*b* is a basic back pocket pattern (half of a finished pocket) for the Caucasian and Asian body types;

FIG. 44*c* is a back pocket pattern (half of a finished pocket) used traditionally for all body types In the garment industry;

FIG. 45*a-nn* is a flow chart showing the sequence for sewing a pant;

FIG. 46 shows the provision of a cup within a pant for all body types;

FIG. 47 illustrates the manufacture of an automotive seat according to the principles of the present invention; and FIG. 48 shows an avatar disposed upon a vehicular seat.

DETAILED DESCRIPTION OF THE PREFERRED EMBODIMENTS

At the outset and to facilitate an understanding of the present invention following are definitions used throughout the specification.

Definitions

The term "apparel" is used to refer to, and interchangeably with, articles of clothing, garments and other items worn on or applied to the human body for protection or ornamentation.

The term "physique" refers to the structure and development, of the human body.

The term "Black human body" is used as an example of a selected human body physique type. "Black human body" is used essentially to demonstrate that there does exist a group of humans of African or combinations of with African decent, who have in common, distinctive physical characteristics that contrast the physique patterned in the industry standard body. The term "Black body" is intended to include, in particular, any suitable human whose body generally incorporated certain body part measurements, dimensions, ratios, proportions, bone placements, curvatures and contours according to the patterning system and method of the present invention. The terms "Black human body", "Black body", and "Black" are used interchangeably.

The term "body landmark(s)" is used to refer to key locations including horizontal points (circumference) on the human body that may be bones or flesh as well as vertical (height and length). Measurements of body landmarks provide quantitative sizing and design information. Bocy landmarks include, while not limited to, head, forehead, face, nose, neck, shoulder, arm, wrist, digits (fingers), bust (of women), chest (of men and children), torso, waist, crotch, hip, thigh, knee, calf, leg, neck, ankle, foot, and food digits (toes). Often a body landmark is used in combination and in conjunction with one or more other body landmark(s) to develop composite information regarding a selected body type. Each body landmark has at least one body landmark measurement and at least one ethnicity solution. The terms "body landmark(s)", "landmark(s)" and "landmark point(s)" are used interchangeably.

The term "White" refers to the race of Caucasian humans.

The terra "body type" is used in a broad sense in this specification and claims to refer to a group of humans, having the same human body physique, who have in common distinctive surface shapes. For example, terms such as "pear-shaped", "hour glass" and "boxy" denote certain body types. However, although the surface shapes are different, within the same human body physique category, the body types have in common certain body landmark measurements, dimensions, ratios and proportions, bone placements, curvatures and contours.

The term "ethnicity" is used in this specification and claims to refer to a classification of a heterogeneous human population as distinguished by same body-structural physical characteristics.

The term "ethnicity solution(s)" is used to refer to specifically to one or more of the dimensions, ratios, proportions, curvatures, positioning, depth and sloping of one or more body landmarks. Body landmark measurements and ethnicity solutions conjunctively provide for a most composite representation of a body physique. Because of the non-uniformity of bone structure and bone size, as well as fat and muscle distribution, on various body types, the body height measurement and weight, even in combination with a body landmark measurement, provide insufficient information to develop an adequately representative patterning system for a selected body. Examples of ethnicity solutions include, while not limited to, head shape, forehead shape, chest length in proportion to body height, leg length in proportion to body height, leg length in proportion to chest length, waist position relative to navel, sloping of waistline, position of buttock relative to waistline, the longitudinal curvilinear side profile across the distance from the rib cage floating bone to the top of the hip bone, the longitudinal curvilinear thigh profile, thigh mass in proportion to body mass, thigh mass in proportion to body height, digit length in proportion to palm length, width of foot in proportion to foot length, foot digit length in proportion to foot length, width of lips, width of nose, height of nose in proportion to width of nose, and degree of slope of shoulder blade. An ethnicity solution inactions to correlatively connect body land marks by appreciating differences in bone structure, body part positioning, propensity and distribution of muscle and fat mass, ail based on body type. An ethnicity solution may be based on a body landmark measurements, such combinations yielding ratios, proportions and scales, and permit the inference of additional ratios, proportions and scales.

Referring to FIGS. 26, 33*a*, 33*b*, 34*c* and 36, it is seen the terms "ethnicity solution(s)", "Black ethnicity solution(s)" and "ethnic solution(s)" may be used interchangeably. See FIGS. 33*a*, 33*b*, 34*c*, 36*c* and 26.

The term "face length" is used to refer to the distance of the vertical dimension of the human face from a center point on the head immediately adjacent and below the hairline to the lower peripheral of the chin.

The term "floating bone" is used in the anatomical sense to refer to the lowest two ribs of the human body rib cage.

The term "industry-standard" is used as a noun and adjective to refer to dimensions, ratios, proportions and placement of body parts of White, volunteer subjects. collected in 1941 and used as standard data for all pattern making, other bodily applications used for protection or ornamentation in North America. The terms "industry-standard" ("I-S"), "industry-standard" ("IS") and "standard" are used interchangeably.

The term "lip width" is used to refer to the vertical length of the widest section of the combined upper lip and lower lip.

The terms "mass", "mass measurement", "body weight" and "weight" are used interchangeably and refers to the quantity of matter forming a body.

The term "palm width" is used to refer to the horizontal distance from the palm at bottom of thumb, across to palm at the bottom of pinky (last) finger.

The term "palm length" is used to refer to the vertical distance from the intersection of the digits and the palm to the wrist at the top of the carpal. As used herein the terms "palm length" and "palm size", "hand length" and "hand size" are interchangeable.

The term "proportion" is used to refer to the division of a total area into spacial relationships.

The term "scale" is used to refer to size relationships that separate areas of the body have to each other.

The terms "shoulder(s)" and "shoulder blade(s)" may be used interchangeably.

The term "underpant(s)" is used throughout the specification as reference to apparel items of short pants and may include panties, diapers, briefs, long johns, bathing suits, athletic pant wear extending a length generally from the waist or hip area, to above the knee area or lower and any other undergarments.

The terms "waist" and "waistline" are used interchangeably.

The term "waist height" is used to refer to the vertical length from the waist or waistline to the floor.

The term "ABT" refers to Asian body type using the definitions described hereinabove.

The term "MBBT" refers to mixed black body type.

The term "CBT" refers to Caucasian body type

The term "BBT" refers to Black body type.

An article of manufacture for an appropriate body type and measurement for various deviations from industry standards, may be created from the series of charts set forth hereinafter. Theses charts may be digitized and stored electronically in a computer, PDA or other electronic device.

These charts are used to create the patterning system hereof as detailed hereinafter.

The measurement and data used to create the charts are determined by taking actual physical measurements from humans of the various ethnic body type and, then, extrapolating the data to create the charts. These charts and the data therein contained form the basis for the patterning system used in the practice of the present invention.

Clothing Manufacture

Turning to a first aspect hereof the present invention has particular utility in the manufacture of clothing such as denim jeans and like articles of clothing made from denim and other fabrics.

As is known to those skilled in the art to which the present invention pertains standardized or industry standard jeans and other apparel ordinarily do not fit correctly on any ethnic body type. Usually the rear pockets do not conform to the contour of the body type unless the body type conforms to industry standard. This is ordinarily attributable to the fact that in manufacturing such jeans the waistband or waist portion of the jean is, again, industry standard and does not address the actual body type. It has been found that if the waistband is configured and designed to address the actual body type, then. It is possible to manufacture a jean according to and adapted to fit appropriately to the type of body.

In addition to using an appropriate waistband, the present mode of manufacture, employs the darts associated with the rear pocket of the jeans to define guides and, also, to enable the darts, themselves, to properly align. It is also possible to provide a "cup" in the buttock area to allow the natural fullness of the buttock to next there within. This is more particularly described hereinbelow.

In manufacturing a jean so that it fits the body contour around the buttocks properly, the pocket or pockets need to be puckered or, alternatively, have the "cup" formed there within so that once the jeans are put on by the user, the pockets will then conform to the user. If the jeans or other pants do not have pockets, the cups are still formed in the leg body, itself. Thus, it is to be appreciated that the present invention provides a method of manufacturing a properly fitting jean.

With more particularity, and with reference to FIGS. 35-44 there is depicted therein a series of drawings showing the manufacture of jeans for various ethnic body types and, generally denoted at 100.

According to the body type, as determined from the charts, and as shown in FIGS. 35*a*, 36*a* and 37*a*, there is provided a series of waistlines, wherein 110 refers to the Black body type waistline, 115' refers to the mixed Black body type waistline, and 111' refers to the Caucasian body type waistline, respectively.

Similarly, for the Caucasian body type, the waistline of the pant and the contour is created by a waist-thigh combination shown in FIG. 37*b* as denoted at 111; and for the Asian body type, the contour is created by a waist-thigh dart combination as denoted at 118, as shown in FIG. 38*b*.

The purpose of a contoured waistline or waistband is to create, not only for jeans, but for other apparel, (a) flexible line(s) that allow the pant, shorts, skirts, undergarments, and all wearing apparel and protective clothing to lay flat on the waist of the individual without the aid of a cinching device such as a belt or draw string. The line(s) is (are) not straight lines, because the natural contours of the body are not 180°. If a straight line is used to create the waistline, as is traditionally done, the waistband or waistline of the garment will gap open in one or more places on the waist. This causes the garment to fall down off the body without the aid of a belt. Each human body type has its own specific contoured waistline for garments. The special contours in the back waistline prevent undesired gapping of garments along the lower center back.

According to the present invention, the waistline contour for the front of the garment is disposed in an area cm the body where there is less of a chance of body fat accumulating. In the front of the body, the position is several inches below the navel. Traditionally, the waist is labeled at the navel. The purpose of this placement is because persons of the same body type and size, with the same height and thigh measurements can have different waist circumferences. The lowered front waist allows persons to lit into the garment despite slight fluctuations in body fat accumulation on the traditional waist, provided they stay within a range.

As shown in FIGS. 36-44, the darts are just as important as the contoured waistline. At the top of the waist, the dart 114 helps the garment lit properly and lay Hat on the waist, without gapping. The dart 114 at the waist also provides the unique ratio between the waist to the line along the top gluteus curve; such that when sewn, the natural vertical curved, contour of the gluteus is visually apparent from the profile and the rear. There are high peaks in some of the waistline contours because the line of the gluteus curve is longest at that point.

The vertical dart 115, on the thigh (FIG. 36*a*), is strategically placed where the fullest part of the thigh is located and graduates to ending points on the gluteus and on the thigh. This dart keeps the pant leg from smashing the natural curve of the gluteus In the pant leg. It creates a clear demarcation of where the thigh begins and where the gluteus ends. With this dart 115 in place, the natural contours of the gluteus are apparent from the profile and rear view. For the female body type, this is most desired in pants, shorts, undergarments, etc. It is a most necessary component when trying to capture a more perfect fitting garment for the lower body.

As shown in FIGS. 35*b*, 36*b*, 36*c*, 37*b*, 37*c*, 38*b* and *e*, each body type garment must have contoured back pockets. Traditionally, back pockets are formed as a flat element, even with embellishment. Because of the waist and thigh dart combination, a pocket 117 is laid over the darts that has the same contour of the mentioned body types. Each back pocket 117 comprises at least two curved pattern pieces 117', 117" (FIG. 38*b*). The advantages to contouring the pocket to mirror the pant darts are: 1) the pockets will have a true fit on the garment so that they lay correctly on the garment when sewn, and 2) less resistance or tension across the width of the pocket because the curved seam adds more width and creates a cupping or an arching of the pocket, and 3) ease of use, especially, when the garment is fitted or has less ease.

It should be noted that the waist dart is mimicked in the pocket according to the pocket's displacement. For example, if the pocket(s) is/are non-centered or placed on an angle, the contours in the pocket must be adjusted to line up with the garment.

In manufacturing blouses, dresses, jackets and the like, there are special changes from that of the industry standard made to the bodices of the body types of the Black Body Type and the Mixed Black Body Type.

Thus, it is readily perceived that the present; invention defines a method for manufacturing a pant regardless of the body type which, generally, comprises; (a) providing a first database or chart of various ethnic body types, the database including variances within the selected body types; (b) selecting an appropriate body type from the database; (c) providing a second database of waistbands for selected pants, the waistbands being correlated to a body type; (d) determining from the second database the appropriate waistband, and (e) creating a waistband corresponding to the selected waistband; (f) attaching a jean leg to the waistband of the jean leg correlated to the waistband and body type; (g) securing the leg to the waistband; (h) placing the rear pockets on the pant leg(s) in spatial relationship, the pockets having a pucker therein to enable the pocket to lie flat against the body when the jeans are worn; and (i) emplacing a first vertical darting along the thigh, (j) creating a second dart extending from the waistband down through the pocket, the darting providing a guideline to assure proper positioning of the pocket against the body.

Sewing of a Pant

A flowchart showing the sequence of steps is illustrated in FIG. 25.

First, in sewing the darts they are emplaced on the fabric by sewing the back pant waist darts along a curved line. Thereafter, the back leg diamond dart is sewn.

Then, the pockets are created by placing the right sides of the pocket parts of fabric together. Then center seam of the pocket is stitched. This is repeated for the second pocket.

Next, the pocket, hem is double folded and stitched along the top of pocket's edge. The right sides of fabric are then folded about ½" over onto the wrong side for the remaining four sides and, then, pressed.

Each pocket corner is then placed on the pocket markings. Thereafter the pocket is top stitched along outside edges.

Next, the side zipper fly facing is emplaced by gathering the right sides of fabric together and, then, sewing the front zipper fly to right pant front about ½" from bottom of fly and, then, pressing open the fly on right side.

Next, the closed zipper is placed, face down, about ¼" from the seam, and stitched along the zipper teeth, on the zipper tape that is closest to the edge of the fly.

With the right sides together, and starting from the hem, the right back pant panel is sewn to the right front pant panel, stopping just below the front zipper fly.

The zipper is opened and unsewn, inner zipper tape is placed at the top of the right back pant and lined up with the pant seam edge and sewn along the zipper teeth.

The zipper facing is folded back and sewn along the edges.

The back zipper facing is placed at the top of the zipper stop, along the zipper tape. The zipper back facing is sewn to the zipper tape and back pant panel about ⅜" from seam edge.

The back zipper facing is folded over so that the teeth are right side up. The edge is stitched along the right back panel seam where the zipper tape meets.

Starting at the zipper stop the edge right of the front zipper fly is stitched.

Next, the right sides of the right front zipper fly and the right front pant panel are placed together and stitched along top (waist) of the right front zipper fly.

The next step in the process occurs with the side seams, inseam and hem being sewn together.

First, the right sides of the front pant panels are gathered together and the Center Front (CF) seam is sewn.

Next, the right sides of the fabric of the back pant panels are placed together and the Center Back (CB) seam is sewn.

The right sides of fabric together of front left pant panel and back left pant panel are placed together. The left side seam is, then, sewn.

The right side of fabric of the right front pant panel inseam is placed on the right side of fabric of the right back pant panel inseam and sewn. When sewing across the Center Front and Center Back seams, some patterns require stopping at the place and pivoting the fabric to continue sewing down the left leg inseam.

The hem is double folded and sewn.

Next, the waist facing of the pant is created, as follows:

The right side of the fabric of the front waist facings and back waist facing are placed together and the left side seam of waist facings are sewn together.

Then, with right sides of fabric together, the waist facing on the front pant is placed and stitched about ¾" from the front zipper fly seam edge, around the waist, pivoting where necessary, Any excess waist feeing is folded behind the zipper tape.

The facing and pant at CF, left side seam, CB, and right back side seam are clipped. Also, the unsewn right front waist facing length and excess dart fabric are clipped.

The waist is positioned facing up and edge stitched along the waist seam, are flipped.

The top corner of the front zipper fly is clipped. The front zipper fly is turned inside out to the right side of the fabric.

The waist facing is folded inward, placing the back sides of fabric together of the waist facing and the pant fabric together.

Starting at the seam of the right side, pivoting to the waist edge, and around to the back right zipper facing the edge is top stitched.

Then, a top stitch is provided about ¾" from the edge of waist.

Next, the zipper is opened and a top stitch is done from the top of the waist to the bottom of the zipper.

The zipper is closed. Then, stitching is done from the end of the zipper to the zipper top stitch and pivoted up a couple of stitches for reinforcement.

This completes the creation of the pant.

The front of the jean and the front pocket can be prefabricated once the body type and waistband are selected, since the leg size will have been determined. It is the rear pocket and its positioning on the pocket that ensures the proper fit.

Using the same technique other types of pants may be produced, but eliminating the rear pocket darting, if desired.

Referring now to FIG. 46 and in accordance with the present invention a cup 200 is built into the pants, regardless of the body type or gender.

The cup is provided on each side of the buttocks of the wearer. Depending on the body type for whom the pants are manufactured the buttock cup will differ in depth. The cup allows the natural curve of the buttock to be as full as if actually is.

As is known to those skilled in the art to which the present invention pertains, most pants squash or smash the buttocks at the upper thigh and flattens and squares off the hips thus resulting in a re-shaping of natural curves and the loss of buttocks fullness that occurs naturally in all body types. By providing the cup, this does not interfere with the natural shape of the curve of the buttocks and gives support to the buttocks allowing the natural depth and width of the buttock's curve to be relaxed.

The formation of the cup, per se can be achieved by any suitable method, for example, by darting, seaming, and/or gathering of material. For example, as shown in FIG. 46 the cup 500 is provided in the buttock area of the pant 502. The cup provides an excess volume 514 which permits the fullness of the buttock to be disposed therewithin.

It should be noted that the cup is used in conjunction with any garment having a portion which covers the buttock area of the wearer. Thus, the cup is incorporated into pants, underwear, skirts, dresses and the like.

Sewing of a Dress

In sewing a BBT and MBBT dress forms changes would include: (a) the shoulder slopes/angles are steeper; (b) the neckline is completely reconfigured into different curves for the front and back of the neck. The back curve shown at 120, is moved further back and the front is moved down; (e) the armholes are raised and re-contoured; (d) the waist is narrowed in the back, and not as much in the front; (e) the sleeves are longer and the caps are adjusted to fit into the new armhole shape; and (f) the waistline contour is the mirror image of the pants.

Sewing of the Skirt

A skirt is created by the following sewing method:

First, waist darts are sewn.

Next, the right sides, pocket parts, of the fabric are placed together. The center seam of the pocket pails are stitched together to create the pockets.

A double fold pocket hem is double folded and stitched along the top of each pocket's edge. The right side of each pocket is folded about ½" over onto the wrong side for the remaining four sides. Thereafter, the fabric is pressed.

Each pocket corner is placed on the pocket markings. Top stitching the pocket is done along the outside edges. Thereafter, the side zipper fly and facing are created.

First, with the right sides together, the front zipper fly is sewn to the right skirt front about ½" from the bottom of fly. The fly is then pressed open on the right side.

With the zipper closed, it is placed face down, about ¼" from the seam, and stitched along the zipper teeth, and on the zipper tape that is closest to the edge of the fly.

Then, with the right sides together, starting from the hem, the right back skirt panel is sewn to the front skirt, stopping just below the front zipper fly.

The zipper is opened and the unsewn, inner zipper tape is placed at the top of the right back skirt panel and lined up with the skirt seam edge. Sewing is then done along the zipper teeth.

Next, the zipper feeing is folded back in half and sewn along the edges.

The back zipper facing at the top of the zipper stop is placed along the zipper tape. The zipper back facing is sewn to the zipper tape and the back skirt panel about ⅜" from the seam edge.

Next, the back zipper facing is folded over so that the teeth are right side up. The edge is stitched along the right back skirt panel seam where the zipper tape meets.

Next, the right front zipper fly is edge stitched, starting at the zipper stop.

Then, the right sides of right front zipper fly and right front skirt are placed together and stitched along the top of the right front zipper fly.

The side seams and hem are created next. This is done by placing the right sides of the fabric of the back skirt panels together and sewing the center back seam. Then, the right sides of the fabric of the front left skirt and the back left skirt panel are placed together and the left side seam is sewn. The hem is then folded and sewn to create the side seams and hem. Finally, the waist facing is created.

To create the waist facing, the right sides of the fabric of the front waist facing and back waist feeing are placed together. Then, the left seam of the waist facings are sewn together.

With the right sides of fabric together, the waist facing is placed on the skirt, front and stitched about ¾" from the front zipper fly seam edge, around the waist, pivoting where necessary. Any excess waist facing is folded behind the zipper tape.

The facing and the pant are notched at the CF, the left side seam, the CB, and the right back side seam. The unsewn right front waist facing length is clipped. The darts are clipped. Then, the waist is flipped, waist facing up, and edge stitched along the waist seam.

The top corner of front zipper fly is clipped. The front zipper fly is turned inside out to the right side of the fabric. The waist feeing is folded inward, placing the back sides of the fabric together of the waist facing and the skirt. Top stitching is done along the edge, starting at the seam of the right side, pivoting to the waist edge, and around to the back right zipper facing.

Next, top stitching is done about ¾" from the edge to the waist. The zipper is opened and top stitched from top of waist to bottom of zipper, The zipper is closed. Stitching is done from end of the zipper to the zipper top stitch and pivoted up to provide stitches for reinforcement.

Sewing a Bodice

In sewing a bodice, the following procedure is employed:

First, the darts of front and back bodice are sewn. Then the bodice panels and sleeves are prepared.

The right sides of the fabric are placed together for a front bodice shoulder and a back bodice shoulder and the shoulder seam is sewn and the seams toward front bodice are pressed.

The right sleeve is marked with the right armhole, right sides of fabric together, at the sleeve cap notch. The sleeve is sewn to the bodice armhole, while easily feeding the sleeve into the armhole. The seam is pressed toward the bodice. This is repeated for the left side.

Placing the right sides of fabric of bodice front and bodice back together at the waist side seam followed by stitching. The side seam and the inside arm seam together create the right side. This is repeated for the other side.

The sleeves and the hem are then double folded.

With the right sides of fabric together, sewing is done along the bodice facing and bodice at center back seam and along the neck line.

Corners at the neck of the bodice are cut and the neck line is notched,

The neckline corners are turned inside out.

The facing and press are opened the wrong sides of facing and bodice are pressed together.

Folding and hemming creates the bodice.

For a bodice specifically made for a Black body type or a mixed Black body type. The fop of the upper body has shoulders with much steeper than any other body type. In addition, the top includes a neckline which is contoured into a different curve for the front and back of the neck such that the back curve is moved farther hack and the front has been moved down as determined according to the charts. Similarly, the armhole is raised and re-contoured and the waist is narrowed from the back and is less than the narrowing in the front. The re-contouring of the armhole necessitates the lengthening of the sleeve and the waistline contour is the mirror image of the pants. By so adjusting the bodice various types of tops can be made including dress tops, blouses, shirts and the like, It should be noted that the skirts, blouses as well as the bodice .may be provided with darts which are created by either contour seams, sewing or gathering.

Sewing a T-Shirt

To create a T-shirt using the present method and patterning system, the bodice and sleeves are first formed.

After placing the right sides of the fabric of the front bodice and back bodice together, the shoulder seams are sewn.

With the right sides of fabric together, the sleeve cap notch is matched to the shoulder seam of the bodice. Sewing begins at the beginning of the armhole, keeping the notches lined up. This is repeated for the other sleeve.

Then, after placing the right sides of the fabric of the front and back bodice together, stitching is done along the side seam and inside arm.

The hem sleeve and waist are folded.

In creating an article of clothing pursuant to the charts a tolerance of ±2" for the waist, the bust and/or the hip is allowed in manufacture of a garment according hereto.

Other Articles of Manufacture

The present patterning system also renders it possible to prepare articles of manufacture, such as furniture seating, automotive seating and the like. In preparing such articles of manufacture the seating can be prepared directly from the charts or by constructing an avatar from the data according to the charts to prepare replicas of the representative body types and then mold or conform seating therearound.

Referring now to FIGS. 47 and 48, there is shown therein a schematic of a seat or chair manufactured in accordance with the present invention and generally denoted at 210.

The seat 210 includes a head portion 212, a lumbar portion 214 and a seating portion or base 216.

The seat 210, per se, is flexible and is, preferably, conformable to the driver or occupant passenger body type.

The seat structure, per se, comprises a substrate of reinforced flexible material such as foam. A plurality of contiguous and abutting vanes 224 of varying durometer are disposed within the substrate. A loam cushioning 226 overlies the substrate layer which, in turn, is enclosed by a conventional seat covering such as cloth, leather or the like (not shown).

The seat further comprises a lumbar backing 230. The lumbar backing 230 includes an assembly of bands 232, preferably, molded from a suitable elastic material such as polyethylene, polypropylene, or the like. The durometer of the material may be variable from one band to another to change the stiffness of the different areas of the seat.

Each of the bands are uniform in shape to allow them to be molded from a single tool. Thus, the only requirement is the ability to modify the material with the requisite durometer within the different bands.

The seat base 216, comprises a simple set of bands 233 attached to a two part seat frame 235 having the foam cushioning on the seat covering disposed thereover.

Generally, in creating a seat in accordance herewith, a plurality of sensors (not shown) are embedded throughout the seat 210 and which detect the weight, and physique of an occupant(s). The sensors are strategically placed and in electrical communication with means for pumping, such as a pneumatic pump (not shown) which is built into or is disposed external to the seat. At least one flexible bladder 220 or similar device is disposed in the seat 210 and in fluid communication with the pump.

In response to a signal sent from the sensor, the pump is activated and sends a signal to the bladder(s) 220 to inflate or deflate the bladder In the well-known manner. Inflating and/or deflating the bladder causes the seat to conform to the physique of the user.

Preferably, the seat 210 is manufactured by initially creating an avatar 222 for each body type/racial anthropometric average male/female. Measurements are taken from the avatar, e.g., distance from knee to floor; height above seat back, etc. The measurements from the charts and the avatars are used to create a database which can then be stored in a computer or other storage device (not shown).

The data can then be used to create the appropriate seating.

In use a driver seated on the seat selects the desired body type via the storage device. The storage device, then, relays the information to the pump(s) which, then, in turn inflate and/or deflate the bladder to have the seat conform to the body type.

Similarly, a passenger(s) can have his or her seating area conformed to his or her body type.

Alternatively, once a person is seated on the seat, the sensors, which are in communication with the storage device, may send requisite signals representative of the person, to the storage device which, then, determines the body type(s) of the persons(s) seated on the seat. The storage device then sends the requisite signal(s) to the pump, which, in turn, inflate the bladder appropriately.

It should be noted that the patterning system can be used similarly to design other seating systems such as couches, chairs, mattresses and the like.

What is claimed is:

1. A method of manufacturing a pant which comprises:

(a) providing a first database of various ethnic body types, the database including variances within the selected body types;

(b) selecting an appropriate body type from the database;

(c) providing a second database of waistbands for selected pants, the waistbands being correlated to a body type;

(d) determining from the second database the appropriate waistband;

(e) creating a waistband corresponding to the selected waistband;

(f) attaching a jean leg to the waistband of the jean leg correlated to the waistband and body type;

(g) securing the leg to the waistband;

(h) providing a cup in the buttock area of each pant leg to permit the natural fullness of the buttocks to reside therewithin;

(i) emplacing a first vertical darting along the thigh, (j) creating a second dart extending from the waistband down through the pocket, the darting providing a guideline to assure proper positioning of the pocket against the body.

2. The method of claim 1 which further comprises:

providing at least one pocket on the rear of the leg of the pant, the cup being disposed internally of the pocket.

3. The method of claim 2 wherein the cup is formed by gathering material and darting same.

4. The method of claim 2 wherein each cup is formed by gathering material and sewing about the seam.

5. A patterning system to accommodate a specific human selected body physique type, comprising:

a specific selected body type for a selected gender;

a height measurement for said specific selected body type;

a weight measurement for said specific selected body type;

a body landmark measurement for said specific human body type;

an ethnicity solution to add a distinctive feature of said specific human selected body type to said patterning system;

a patterning surface upon which said height, weight, body landmarks measurements and ethnicity solution are combined and correlatively assembled for said selected body type to thereby form said patterning system;

wherein the ethnicity solution compensates for chest circumference, waist circumference, and hip circumference by incorporating an ethnicity solution ratio as defined in FIGS. 3*a* through 8, depending on the ethnicity and gender of the selected body physique type respectively, with a tolerance plus or minus 2" range for the waist, bust and/or hip used to calculate particular body landmarks measurements when only one body landmark measurement is known and compensate for bone structure and muscle propensity distribution for said body landmark measurements, not considered by previous industry standards, which are characteristic and distinctive of said specific selected body type and is used in combination with the height and weight measurements to form said patterning system; and wherein when said patterning system is for a garment having a buttock covering portion, said patterning system includes at least one cup for the buttocks area.

6. The patterning system of claim 5 wherein said body landmark is selected from the group of body parts consisting of ankle, arm, bust, buttock, chest, cross torso, crotch, finger length, forehead, hand, head, hip, knee, leg length, neck, thigh and waist.

7. The patterning system of claim 5, wherein the specific ethnicity solution is selected from the group consisting of shape of head, chest length in comparison to body height measurement, arm length, leg length in proportion to body height measurement, leg length in proportion to chest length, waist position relative to navel, location of waistline, position of buttock relative to waistline, side vertical curvature across distance between rib cage floating rib and hip bone outer periphery, curvature of thigh mass, finger length in proportion to hand length, width of foot in proportion to foot length, length of foot digits in proportion to length of foot, width of lips in proportion to face length, width of nose in proportion to two-dimensional face length, nose height and sloping shoulder blades.

8. The patterning system of claim 5, wherein the patterning surface is selected from the group consisting of cloth, felt, plastic, vinyl, opaque paper, generally transparent paper, tissue paper, erasable paper, paper board foam and metal.

9. The patterning system of claim 5 wherein the patterning surface is a generally planar surface.

10. The patterning system of claim 5, wherein the patterning surface is a three-dimensional form.

11. The patterning system of claim 5, wherein the patterning surface is a mannequin with a specific human body physique.

12. The patterning system of claim 5, wherein the specific ethnicity solution being distance between waistline and buttock.

13. The patterning system of claim 5, wherein the specific ethnicity solution on the patterning surface is respective and comparable for at least two selected human body physiques types.

14. A pant patterning system for a specific human selected body type, comprising:

height measurement for said specific selected body type;

weight measurement for said specific selected body type;

an ethnicity solution to add a distinctive feature of said specific human selected body type to said patterning system;

a patterning surface upon which said height, weight, body landmarks measurements and ethnicity solution are combined, recorded and correlatively assembled for said selected body type to thereby form said patterning system that compensates for body depth, body thickness and body width in compliance with an ethnicity solution ratio;

wherein the ethnicity solution compensates for chest circumference, waist circumference, and hip circumference by incorporating an ethnicity solution ratio as defined in FIGS. 3*a* through 8, depending on the ethnicity and gender of the selected body physique type respectively, with a tolerance range of ±2" for the waist, bust and/or hip, and used in combination with the height and weight measurements to calculate a particular body landmark measurement and compensates for specific human body structures and density of muscles not considered by previous industry standards, which are characteristic and distinctive of said specific selected body type and is used in combination with the height and weight measurements to form said pant patterning system; and wherein when said patterning system is for a garment having a buttock covering portion, said patterning system includes at least one cup for the buttocks area.

15. A patterning system for a specific human selected body physique type, comprising:

selecting a body type;

ascertaining a height measurement for said body type in order to provide a first body type variable for said body type;

ascertaining a weight measurement for said body type in order to provide a second body type variable for said body type;

determining a body landmark measurement for said body type;

ascertaining a measurement for said body landmark in order to provide a third body type variable for said body type;

ascertaining an ethnicity solution in combination with said first body type variable, said second body type variable and said third body type variable in order to add a distinctive feature of said specific human selected body type to said patterning system;

wherein the ethnicity solution compensates for chest circumference, waist circumference, and hip circumference by incorporating an ethnicity solution ratio as defined in FIGS. 3*a* through 8, depending on the ethnicity and gender of the selected body physique type respectively, with a tolerance range plus or minus 2" range for the waist, bust and/or hip, and used to calculate particular body landmarks measurement when only one body landmark measurement is known and compensates for bone structure and muscle propensity distribution for said body landmark measurements, not considered by previous industry standards, which are characteristic and distinctive of said specific selected body type and is sued in combination with the height and weight measurements to form said patterning system;

providing a patterning surface;

applying said ethnicity solution and body type variables to said patterning surface correlatively to thereby form said patterning system; and wherein when said patterning system is for a garment having a buttock covering portion, said patterning system includes at least one cup for the buttocks area.

16. The patterning system of claim 15, wherein said patterning surface is an industry standard patterning modified according to said patterning system to accommodate said specific selected body type.

* * * * *